US007857718B2

(12) United States Patent
Tarng et al.

(10) Patent No.: US 7,857,718 B2
(45) Date of Patent: Dec. 28, 2010

(54) GOLFDISCNEY: GOLFDISCNEY WORLD, THE TRIPLE STAR GOLFDISCNEY WORLD AND SANXING GOLFDISCNEY WORLD FOR TRIPLE-STAR GOLF, SANXING GOLF OF GOLFRING, GOLFDISC, GOLFBALL AND GOLFRISBEE, RINGBALL GOLF

(75) Inventors: Min Ming Tarng, San Jose, CA (US); Mei Jech Lin, San Jose, CA (US); Eric Yu-Shiao Tarng, San Jose, CA (US); Alfred Yu-Chi Tarng, San Jose, CA (US); Angela Yu-Shiu Tarng, San Jose, CA (US); Jwu-Ing Tarng, San Jose, CA (US); Huang-Chang Tarng, San Jose, CA (US); Shun-Yu Nieh, San Jose, CA (US)

(73) Assignee: Tang System, San Jose, CA (US)

( * ) Notice: Subject to any disclaimer, the term of this patent is extended or adjusted under 35 U.S.C. 154(b) by 239 days.

(21) Appl. No.: 12/157,785

(22) Filed: Jun. 14, 2008

(65) Prior Publication Data

US 2010/0013160 A1 Jan. 21, 2010

Related U.S. Application Data

(63) Continuation-in-part of application No. 11/210,306, filed on Aug. 24, 2005, now Pat. No. 7,422,531, and a continuation-in-part of application No. 10/842,739, filed on May 10, 2004, now Pat. No. 7,101,293, and a continuation-in-part of application No. 10/091,984, filed on Mar. 6, 2002, now abandoned.

(51) Int. Cl.
*A63B 67/00* (2006.01)

(52) U.S. Cl. ..... 473/465; 473/588

(58) Field of Classification Search ..... 473/465, 473/446, 588; 273/400
See application file for complete search history.

(56) References Cited

U.S. PATENT DOCUMENTS

| | | | | |
|---|---|---|---|---|
| 3,649,027 | A * | 3/1972 | Vallas | 473/169 |
| 3,671,042 | A * | 6/1972 | Garber | 473/165 |
| 3,729,315 | A * | 4/1973 | Conklin et al. | 353/121 |
| 4,872,686 | A * | 10/1989 | Trasko | 473/169 |
| 5,163,683 | A * | 11/1992 | Oswald | 473/409 |
| 5,184,824 | A * | 2/1993 | Riedinger | 473/156 |
| 5,203,566 | A * | 4/1993 | Ricigliano | 473/158 |

(Continued)

*Primary Examiner*—Gene Kim
*Assistant Examiner*—Mike Chambers

(57) ABSTRACT

The Golf Discney World or GolfDiscney World is the combinatory hot topic on golfdisc, ancient China mystery, SanXingDui heritage and Eastern Olympics, YanYun. The GolfDiscney World has the versatile Golfing activities. The GolfDiscney World goes through the mysterious China history to find out the ancient 5000 years golf history. It has the SanXing Golf which is reconstructed from the heritage of SanXingDui 3500 years ago. GolfDiscney has the GolfDiscney movie going through the 5000 years timing channel of the Oriental Grand Ming, Oriental Dark Ages, Oriental Renaissance and Oriental Olympics, YanYun Sports. The GolfDisney has the parade of the oriental YanYun Torch team and the ancient golf which are discovered from the SanXingDui heritage. The ancient golf are the YuanShi golf, 7-Sun golf and the GaoShang golf. Furthermore, the GolfDiscney has the modem RingDiscBall golf, ball golf, disc golf, golfrisbee, golfishing, and golfrisbee lifesaving, etc.

20 Claims, 41 Drawing Sheets

U.S. PATENT DOCUMENTS

| | | | | |
|---|---|---|---|---|
| 5,213,330 | A * | 5/1993 | Benson | 473/165 |
| 5,419,561 | A * | 5/1995 | Weber | 473/409 |
| 5,433,646 | A * | 7/1995 | Tarng | 446/473 |
| 6,053,819 | A * | 4/2000 | Wilk | 473/169 |
| 6,200,234 | B1 * | 3/2001 | Hannon | 473/471 |
| 6,808,176 | B2 * | 10/2004 | Billig et al. | 273/400 |
| 6,875,121 | B2 * | 4/2005 | McKeen, Jr. | 473/168 |
| 7,059,600 | B2 * | 6/2006 | Jarimba | 273/108.2 |
| 7,063,623 | B2 * | 6/2006 | Wengert | 473/131 |
| 7,651,404 | B1 * | 1/2010 | Larson | 473/169 |
| 2003/0008719 | A1 * | 1/2003 | Wilk | 473/169 |
| 2003/0032491 | A1 * | 2/2003 | Graham | 473/169 |

* cited by examiner

| | Golf | Disc Golf | Golfdisc/golfrisbee |
|---|---|---|---|
| Swiveling | Club | Arm | Club |
| | Low cost ball | High cost disc | High cost disc |
| Performance | | Personnel Disc | Personnel Disc |
| | Personnel Club | | Personnel Club |
| Playing | Changing Club | | Can change club |
| | | Change Disc | Can change disc |
| Blockages | ***Sand Cave; Pond*** | Tree | ***Tree*** |
| | ***No Tree*** | no pond (cave?) | no pond (cave?) |
| Long Drive | Standing to swivel club | Running to Swivel arm | Standing to swivel club |
| | No running concrete pad | Concrete Pad | No running concrete pad |
| | | | Golf Ring is better Than disc for long distance |
| | | | Having tree using Disc |
| | The golf has ***no Dog-Leg*** capacity | Disc has minor ***Dog-Leg*** flying capacity | Ring has ***great Dog-Leg capacity***; Disc has minor ***Dog-Leg*** flying capacity |
| | Serious Safety problem | Medium safety problem | No safety problem |
| Putting | ***Hole on green*** | Heavy Steel Chain Disc Basket | ***Disc Basket for both ring and disc*** |
| | Using club - Challenge | Using arm - Boring activity | Using club - Challenge |
| | | Has to use the small, heavy and dumped disc to Impact and open the cage of heavy steel chain | |

FIG.1B

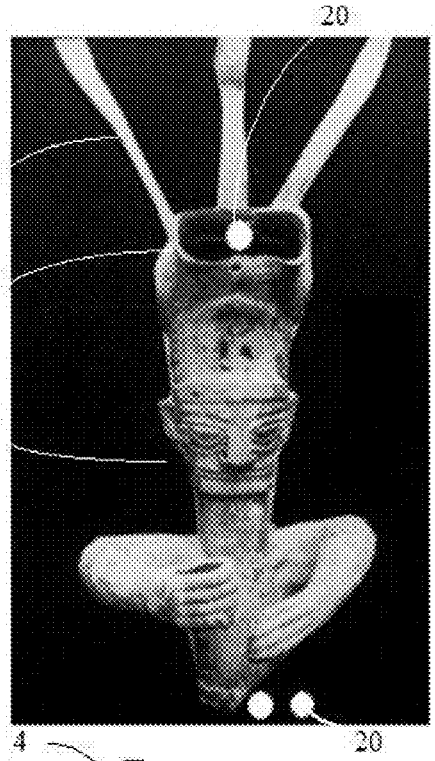
FIG.16A
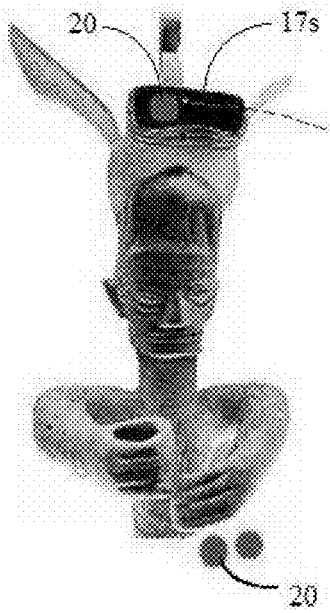
FIG.16B
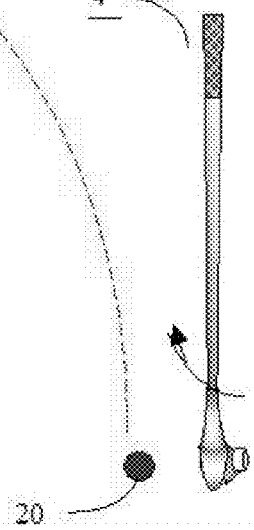

SanXing Golf

Eastern Renaissance & Eastern Olympic

Shu? Yi? SanXingDui & YiChing

Eastern Olympic -YanYun

YiChing Li Section: Sun & Moon Shining on Justice - Fire transfering Fire become Yan - YanYun Sport、YanEmperor Competition Section: Golfring hanging on YuanShih, Ancient King of king used to build the 10 Thousands Countries and keep good relation with kings - The YanYun Sports Carry Out Section: Carry out as emperor, king of kings ShiChing - Business record Long Drive Section 5000 years ago YanYun Sport Oh, YanYun Vacations coming so late We pray the God The Chairman - Yan Emperor - King of Kings order to builds YanYun Fields Giving small golfball and bigball, playing golfing sport for the partnering countries, how quick and high the golfballs being hitted to fly Giving golfdisc and golfring, playing golf horsing for the partnering countries, the golfdisc and golfring flying as the dragon does in the sky Yan Yun Sport facilities being transferred to Chuan After the loss of BanChun battle, the Yan Emperor, King of Kings told followers, " The oriental civilization is destroyed by the barbarians of Xia and Chinese. We cannot fight any more. We have to run away. In the North-East battlefield, we lose partner; in the south-west we get partner. The boats carries the YanYun Sports into Chuan.

As YanEmperor - King of Kings moves southward, meeting the barbarian' s head, using 7-sun to kill the barbarian' s head.

FIG.23A

| | Destroyed Civilization | Destroying Barbarian Country | Renaissance Movements |
|---|---|---|---|
| Western | Greece<br>Roma | Germanic | Renaissance<br>Olympic |
| Eastern | GrandMing,<br>ZhongYuan | Xia,<br>(China)Zhou | Eastern<br>Renaissance<br>Eastern Olympic |

FIG.23B

Civilization InfraStructure

GOLFDISCNEY: GOLFDISCNEY WORLD, THE TRIPLE STAR GOLFDISCNEY WORLD AND SANXING GOLFDISCNEY WORLD FOR TRIPLE-STAR GOLF, SANXING GOLF OF GOLFRING, GOLFDISC, GOLFBALL AND GOLFRISBEE, RINGBALL GOLF

This is a Continuation in Part application claims priority of U.S. patent application Ser. No. 10/091,984, filed Mar. 6, 2002, now abandoned, application Ser. No. 10/842,739, now U.S. Pat. No. 7,101,293, filed May 10, 2004 and U.S. patent application Ser. No. 11/210,306, filed Aug. 24, 2005 now U.S. Pat. No. 7,422,531, which herein incorporated by reference in its entirety.

BACKGROUND FIELD OF INVENTION

The Golf Discney is the Golfdiscney World which is dedicated to the Golfring and Golfdisc. The GolfDiscney, Golf Discney, Golfdiscney, GolfDiscney World and the Golfdiscney World are the trademarks of the Tang System. It should be pointed out, to avoid the trademark of Walt Disney, the Golfdisney is one word instead of two words. The GolfDiscney and Golf Discney have the word Discney. It is emphasized the "GolfDiscney" or "Golfdiscney World" is dedicated to the entertainment activity of golfdisc.

The SanXingDui heritage is the eighth archaeology miracle in the entire world. It is famous known as the 3500 years old of mystery. So far, nobody can explain the SanXingDui mysteries not to mention to use them correctly.

At the same time, in China, there is one of the oldest books and the most mysterious ancient book, Yi-Ching. Nobody can really understand this book, either. However, Yi-Ching has the widest and deepest influence in China. It makes China to be known as the mysterious country to the West.

The Triple Star RingDiscBall (RDB) golf is the most creative and innovative invention in the golf history. We make the breakthroughs in the golf technology. It is the first time, the golfer can throw the disk or ring with the swivel of club. It is promoted to be the new standard of disc golf. Why the Triple Star RDB golf might be the new standard in disc golf? The Triple Star RDB golf doesn't need to run to throw the disc. It is more like the golf standing and swiveling the golf club. We have seen a lot of young disc golfers being so frustrated that they cannot throw the disc far. The disc golf needs the body strength as good as the athlete does. However, for the Triple Star RDB golf, even the cute girl still can swivel club to fly the disc with the reasonable distance to have the good beginning.

Is there any relation among the 3500 years ago mysterious SanXingDui heritage, the mysterious ancient book Yi-Ching and today the most innovative ringdiscball triple star golf? Nobody can recognize the relation among them. It is the need for another superior innovative vision to recognize the relation and make the innovation in the entertainment industry.

To make the most creative and innovative invention the ring-disc-ball triple star golf in golf history to work, we have to overcome many technology barriers. It takes us many years' persistent efforts. To overcome the technology barriers of the throwing disc/ring with swiveling club, we had gone through several different prototypes and innovations to find out the really working principles and technologies. Finally, we find out the secrets and fundamental working principles of the ring-disc-ball golf club head to enable the possibility of swiveling club to throw the disc and ring to fly. After we make the production of our ringball golf invention with the modification of the steel golf club, we come across the SanXing heritage. We are surprised with the similarity between one piece of SanXingDui's jade heritage and the club head of our ringball golf club. It makes us shock that it implies the golf history to be more than 3500 years old and it was the ancient Eastern invented the golf. Of course, the SanXingDui heritage missed key parts and dis-integrated to be components. The golf sport in SanXingDui heritage was for the national defense military applications. We have to apply our scientific research results to integrate the components to reconstruct the original SanXing Golf.

So, we make all the search for the SanXing heritage trying to identify the potential applications with our innovative ring-disc-ball golf technology. Nobody knows or understands the usages and applications of the mysterious SanXing Heritage. We have gone through the innovative invention processes for the SanXing Heritage. In other words, we invent the SanXing golf with the combination of the SanXing heritage. We re-invent the golf with the hint of the Sanding heritage. Furthermore, we unify all the versatile golf and invent the Triple Star golf. The Triple Star golf has dual meanings. The first meaning is that the golfring, golfdisc and golfball of ring-disc-ball golf are the three different golf sports. The second meaning is that the "SanXing" of the SanXingDui has the meaning of "Triple Star".

This is the invention process with the SanXing Heritage. We re-invent the ancient golf with SanXing heritage and name it to be SanXing golf. It is very much surprised that the inventive results are so consistent. It proves that we are on the correct track to, re-construct the 3500 years SanXing golf which was the sport topic in Ancient Eastern Olympics—YanYun. Furthermore, with the combinatory study in the most mysterious ancient orient book, Yi-Ching and the most mysterious SanXing heritage, it is the Northern Yi-Ching academic approach. We have successfully develop the Eastern Civilization Renaissance and the Eastern Olympic-YanYun.

Now, we integrate the SanXing golf and Triple Star golf innovative results to be the GolfDiscney World. The GolfDiscney world can be a new topics in the entertainment industries such as GREAT AMERICA and WALT DISNEY WORLD or one independent entertainment topic unit. The GolfDiscney is the Northern Yi-Ching study of the SanXingDui academic research. With the golf topic, the GolfDisney promotes the Eastern Civilization Renaissance and the Eastern Olympic-YanYun in GolfDisney entertainment way.

As we promote the golfrisbee sport, we often have the challenge question. Why does the disc golf needs the golfing club? The disc golfer can throw the disc with the hand directly. The challenge question brings back the fundamental question. The golfer can throw the stone with hand. Why does the golfing sport need club? For both golfdisc and golfball, the golfing club makes the long-distance long drive being easier and the final accurate putting being challenging. The golfing club makes the golfing sport being much more attractive.

From the civilization viewpoint, the golfers do need the education to have the complete and global view of the golfing sports. It is the educational purpose of the Golf Discney World. It is well know the golf ball people don't like the disc golf people. The golf ball people expel the disc golf people out the golf course. Through the golf course education of the GolfDiscney World, the golfing people will understand all the golf activities of the ball golf, disc golf, ring golf and boomerang golf, etc had the common source of SanXing golf in 6500 years ago. The ball golf and disc golf can learn how to share the same golf course peacefully and develop the hybrid golf, RingBallDisc golf.

DESCRIPTION OF PRIOR ART

There are several reasons that the golf course repels the disc golf. First, the disc golfer throws the heavy disc as the sportsman throws the discus. To overcome the wind problem, the disc must be heavy. To throw the discus type disc in the abandoned park, it needs the flat plate. In the rugged place, the disc golf adopts the concrete plates. The golf course refuses to add the concrete plate in the golf course. Even the park also refuses to add the concrete plate in the park. So, the disc golfers are forced to have their own courses in the abandoned corner of the park. Second, the heavy disc of golf is needed to penetrates the heavy steel chains then falls into the disc basket. The disc of golf disc has to be heavy and small. The small and heavy disk of disk golf is very dangerous to the other people and players. So, the park doesn't forbid the Frisbee to play in the park. However, the park does forbid the disc of disc golf. The golf course also forbids the disc golf to play in the golf course.

Until now, most people in the world still thought (1) the golf was originated from Scotland, (2) the golf history being less than 500 years and (3) the golf has only one type golf, golf ball. However, according to our research in golf history, today's Western golf was derived from the Mongolian West March. One thousand years ago, the golf ball sport was very prosperous in China. During the Mongolian West March, the Mongolian soldier taking all the enemies' soldiers with them and forced them to attack the castle on the first front line. Almost all the golfer in China was taken with Mongolian soldier to sacrifice in the battlefield. However, there were some escaped golfer soldiers. These escaped golfer soldiers brought the golf ball sport to Scotland.

Furthermore, today golf sport has only one kind of golf ball. Even worse, today golf sport in USA, the golf ball sport and the disc golf sport are not compatible. The golf and disc golf repel each other. However, from the ancient Oriental book Shih-Jing, there are four kinds of golf: small ball, big ball, small ring and big ring. In the four kinds of golf, only the small ball type golf is still existent today. The three other kinds of golf disappeared in 3500 years ago. Furthermore, in the SanXingDui heritage, we find out the existence evidences of the other different three kinds of golf which are consistent with the record in the book of Yi-Ching. It implies that there are seven different golf sports in ancient Asia altogether.

Definitely, there are going to have a lot debates that whether our inventions are our own new inventions or we have successfully reconstruct the original SanXingDui golf sport. So far, all the SanXingDui academic research is misled in the wrong direction—Southern Silk Road theory. The Southern Silk Road theory claimed that the SanXingDui was the culture developed by the South-West China and they thought the SanXingDui Heritage was the religious heritage. So far, the Southern Silk Road theory cannot explain any usage of the SanXingDui Heritage. We are the only SanXingDui academic research in the correct direction—Northern Yi-Ching theory. Our Northern Yi-Ching theory claimed that the SanXingDui was the culture developed by the North-East China and we thought the SanXingDui Heritage was the YanYun Sport heritage—the military sport heritage. With the reference to the most mysterious Orient Ancient book Yi-Ching, the Northern Yi-Ching theory can explain all the usage of the SanXingDui Heritage.

However, these arguments and debates between the Southern Silk Road theory and the Northern Yi-Ching theory are no more important. The most important is that we make the innovative progresses in the golf technologies and integrate them to be new entertainment industry—GolfDiscney.

OBJECTS AND ADVANTAGES

Understanding 5000 years tragic golf history, give up the mutual-repellence among the golf, disc golf and ring golf, etc. It is the purpose of the GolfDisney World. In the ancient, the golf is the physical techniques and training for the national defense to protect the Civilization. Comparing the original Eastern Ancient golfer spirit, we feel shame for the today mutual-repellence between the golf and disc golf in US.

We make the innovation from the tradition. We give the new life to the heritage. The GolfDiscney is a new topic of entertainment and education. The GolfDiscney integrates all kinds of golf, ancient golf and modern golf to be a GolfDiscney World. The GolfDiscney World offers a platform for all the different kinds of golf players to play the different golf and share the same one golf family feeling. It will eliminate the hate and the mutual repellence between the golf and disc golf. It helps the golf course to accept all the different kinds golf to share the same world, to share the same course.

DRAWING FIGURES

Figures 1, 2A:
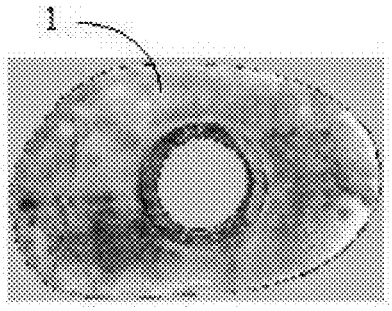

FIG. 9 is the application of the RingDiscBall golf technique to the design of PDGA (Professional Disc Golf Association) standard disc; (A-1) is the RingDiscBall golf screw being applied to the PDGA disk directly; there is the uneven air distribution causing the overturn of the PDGA disk; (A-2) is the section view of the modified PDGA disk as shown in FIGS. 9A-1; (B-1) is the super thin golfdisc design; (B-2) is the section view of the super thin golfdisc as shown in FIGS. 9B-1; (C-1) is the ringball golf screw applying to the PDGA disk with the screw being located between the center and the peripheral; there is no uneven air distribution; (C-2) is the section view of the modified PDGA disk as shown in FIGS. 9C-1; (D-1) is the ringball golf screw applying to the PDGA disk with the screw being located at peripheral; there is an opening at the edge that the uneven pressure distribution is minimized; (D-2) is the section view of the modified PDGA disk as shown in FIGS. 9D-1; (E-1) is the ringball golf screw applying to the PDGA disk with the screw being located at the top surface of the disk; (E-2) is the section view of the modified PDGA disk as shown in FIG. 9E-1; (F-1) is the screw embedded in the thin frame of disc; (F-2) is the side view of the disc as shown in FIG. 9F-1; (G-1) is the rim in segments structure to minimize the airflow resistance; (G-2) is the side view of the disc having the segmented rim as shown in FIGS. 9G-1; (H-1) is the super-thin design for the disc with the combinatory technologies of rim segment, partial rim opening, fin stability and air-passage buffer; (H-2) is the side view of the super-thin design as shown in FIGS. 9H-1.

FIG. 10 is the composite material screw having the rubber inside to increase the holding force to increase the throwing distance; (A-1) is the rubber being filled on the screw; (A-2) is the section view of FIG. 10A-1; (B-1) is the rubber being filled at the valley of the female screw; (B-2) is the section view of FIG. 10B-1; (C-1) is the rubber being filled at the valley of the male screw; (C-2) is the section view of FIG. 10C-1; (D-1) is the rubber screw inside the slotted screw body; (D-2) is the section view of FIG. 10D-1; (E-1) is the rubber screw outside the slotted screw body; (E-2) is the section view of FIG. 10E-1.

FIG. 11 (A) is the ice ring having the universal ice-knife beneath the ring; (B) is the roller ring having the universal roller beneath the ring.

Figure 12:
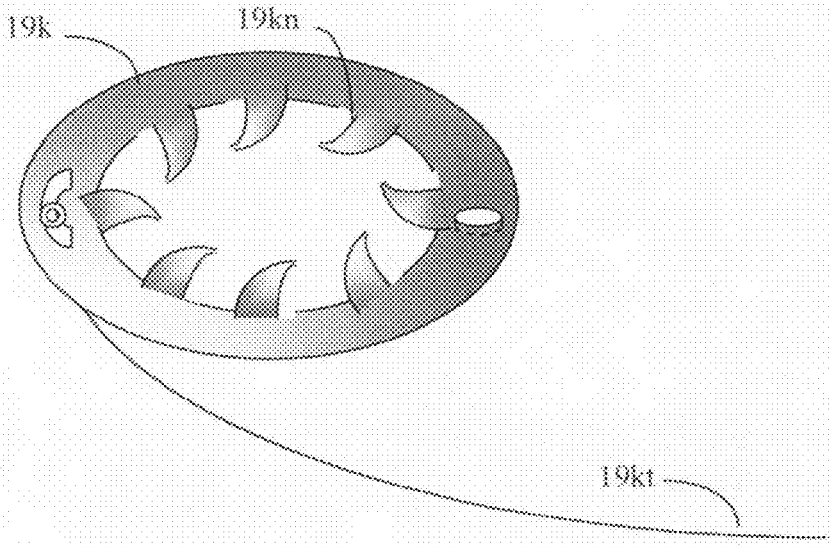

FIG. 12 is the head-cutter made of the flying ring.

Figure 13:
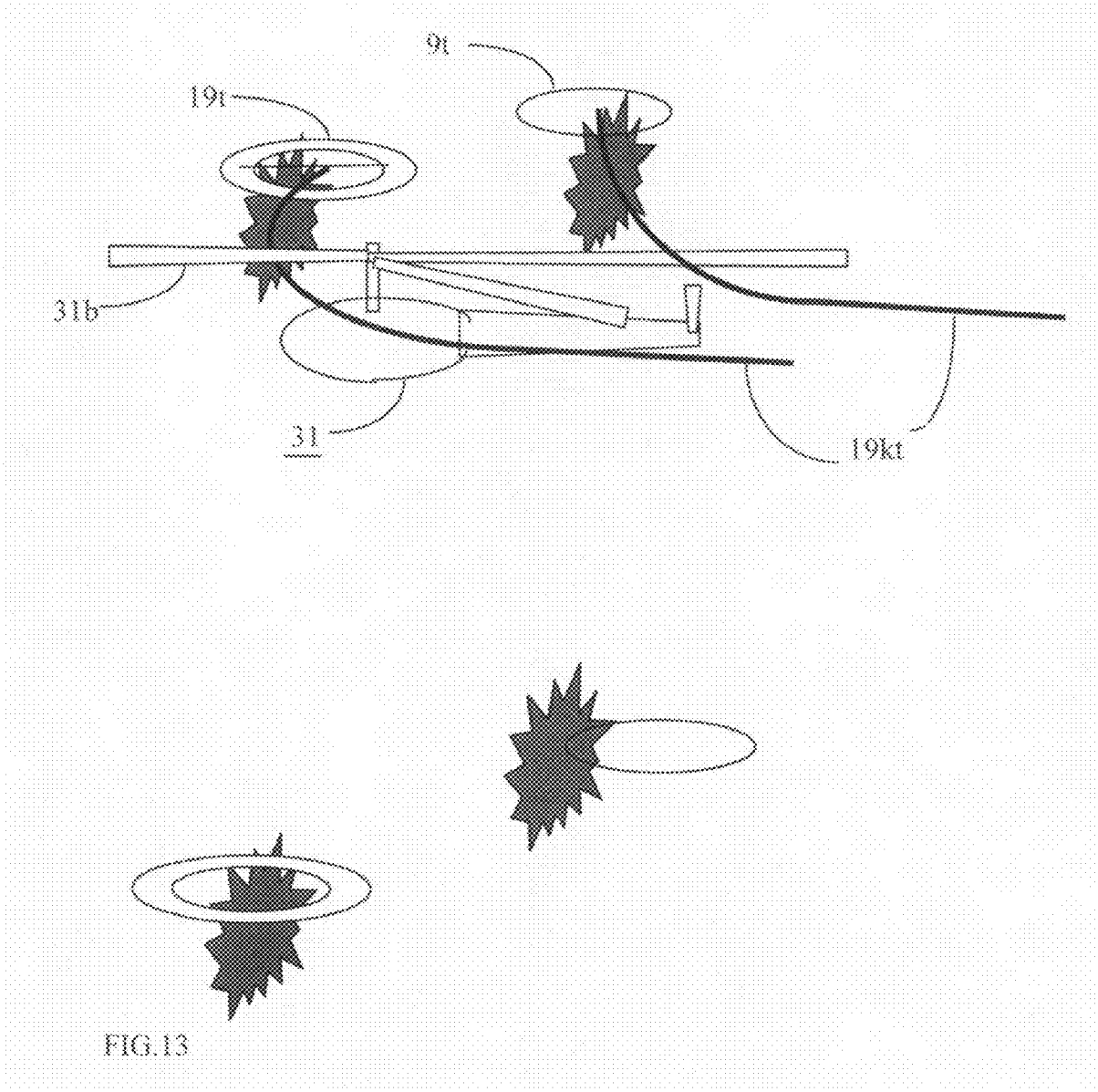

FIG. 13 is the golf swiveling bomb application and animation for the video games, movies and the modern battlefield.

FIG. 14 (A) is the golfer holding the Eastern Olympic fire followed by the golf warrior; (B) is the mask and eye protective cover being worn by the golf warriors.

FIG. 15 (A) is the giant YuanShi of SanXingDui heritage; (B) YuanShi has the bronze sculls to be the hanger of the golfing; swiveling the RingDiscBall club to fly the golfing to hang on the bronze sculls on the YuanShi.

FIG. 16 (A) is the GaoShang of SanXingDui heritage; (B) GaoShang is the target of flying golfball; swiveling the RingDiscBall club to hit the golfball to fly into the slot on the head of GaoShang.

FIG. 17 (A) is the Big Head of SanXingDui's heritage; it can either hit the golfball to hit the forehead target or swivel the RingDiscBall club to fly the half-ring type boomerang 7-Sun to hit on the temple; (B) swiveling the RingDiscBall club to fly the half-ring type boomerang 7-Sun to hit on the temple; (C) shows the size of big head in SanXingDui heritage.

FIG. 18 (A) is the long drive of the golfring; (B) is the putting of the golfring.

Figure 19A:
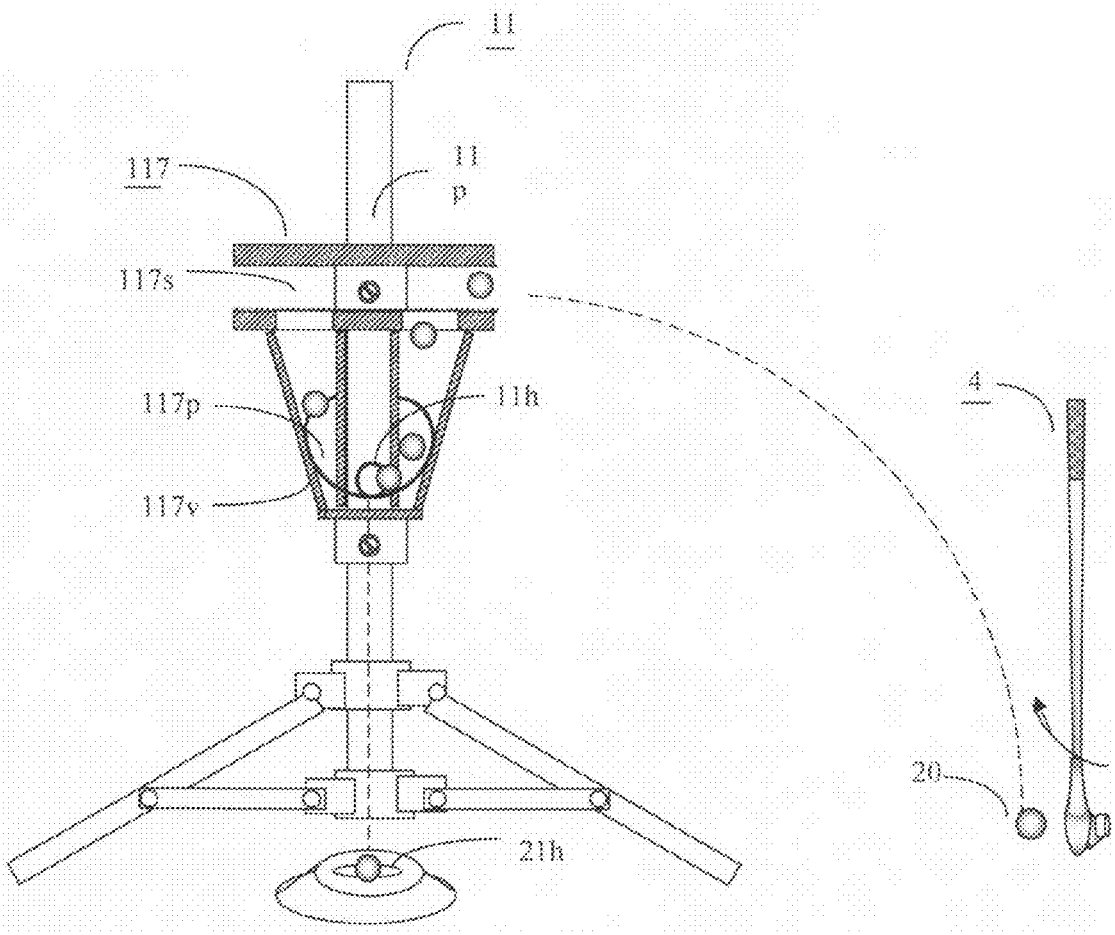
Figures 2, 19B:
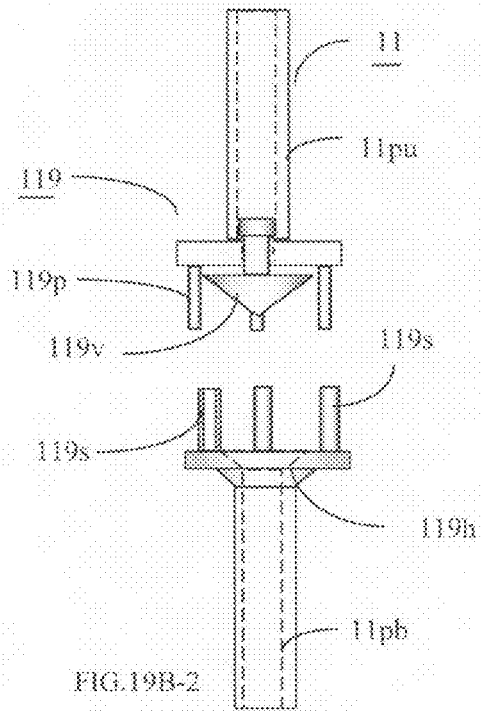
Figures 1, 19B:
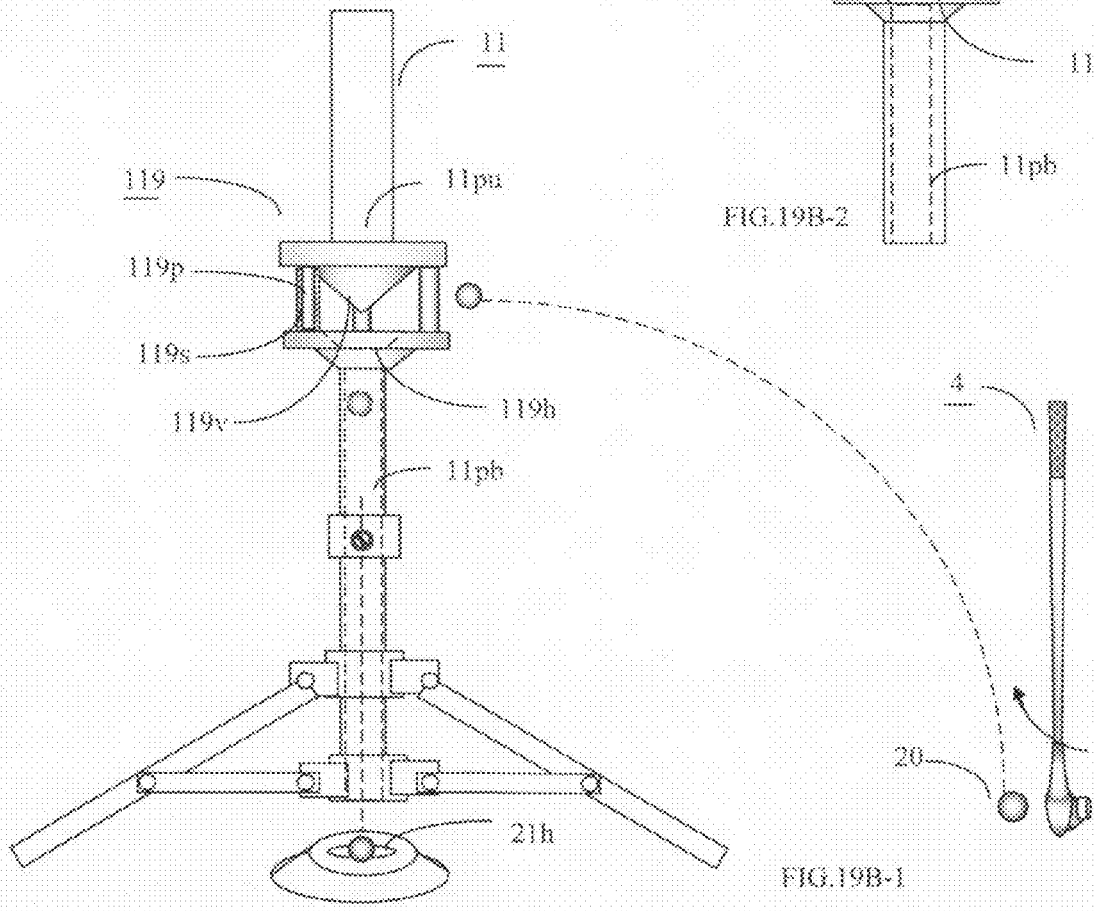

FIG. 19 (A) is the portable slot for the flying golfball; (B-1) is the alternative design of the portable slot for the flying golfball; (B-2) is the detailed structure to show the potting slot for the flying golfball.

FIG. 20 (A) is the package for the SanXing golf; (B) is the package including the Golfring and Golfdisc; (C) is the complete set for the Triple Star golf for sale.

FIG. 21 (A) shooting the golfball into the slot on the Triple Star Golf basket; (B) is the disengagement of the portable Triple Star golf basket.

FIG. 22 (A) is the flag of Eastern Olympics, YanYun Sports; (B) is the organization to promote the Triple Star Golf and YanYun Sports; (C) is the Five-Doll & Five-Ring symbol of the Eastern Olympics, YanYun Sports; (D) is the Triple Star golf and the Triple Star Golf Oscar type Winner Prize.

FIG. 23 (A) is the original documents on the Eastern Olympics, YanYun Sports; (B) is the comparison table between the West Civilization, Western Olympics, Western Renaissance and Eastern Civilization, Eastern Olympics, Eastern Renaissance; (C) is the infrastructure of civilization for the West Civilization, Western Olympics, Western Renaissance and Eastern Civilization, Eastern Olympics, Eastern Renaissance; (D) is the joint fire of the Western Olympics torch and Eastern YanYun torch.

FIG. 24 (A) is the core structure and floor planning of the GolfDiscney; (B) is GolfDiscney including the ringball golf course.

Figure 25:
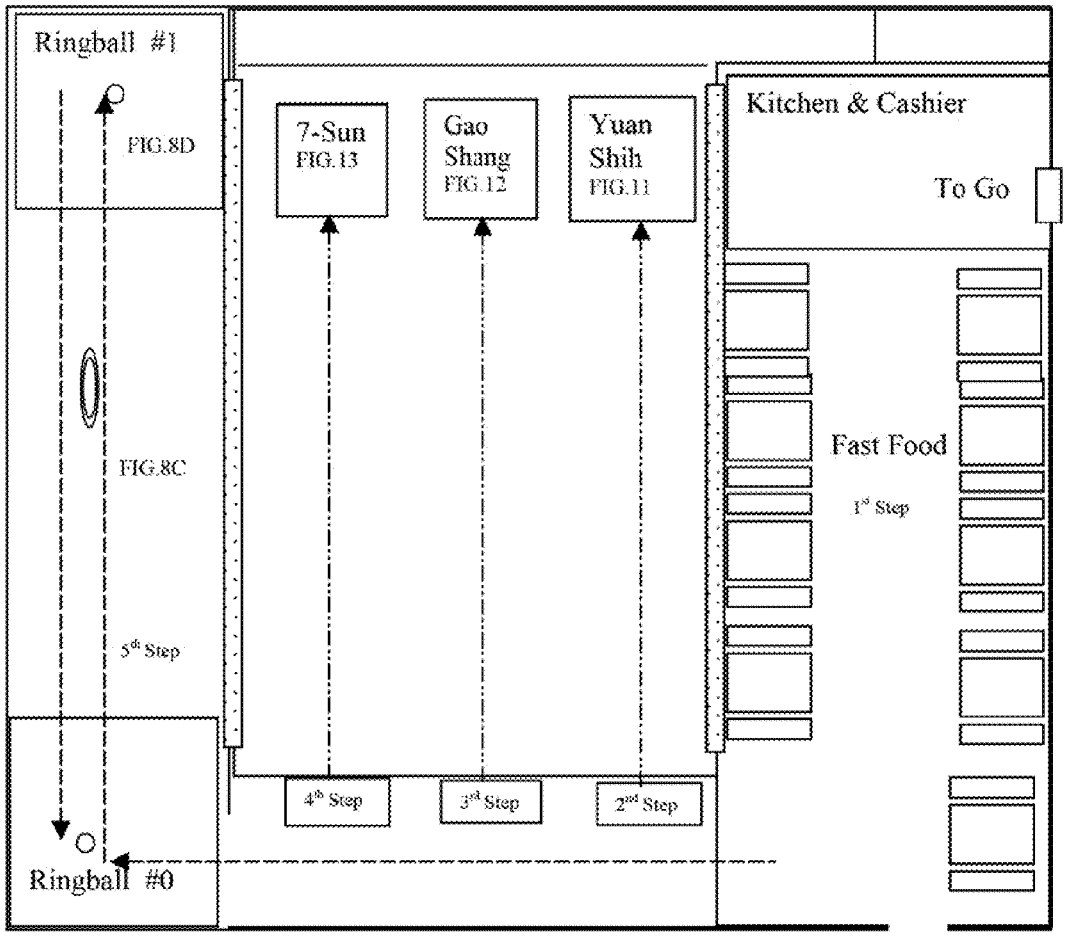

FIG. 25 is the Triple Star franchises which includes the fast food, GolfDisney and ringball golf course.

Figure 26:
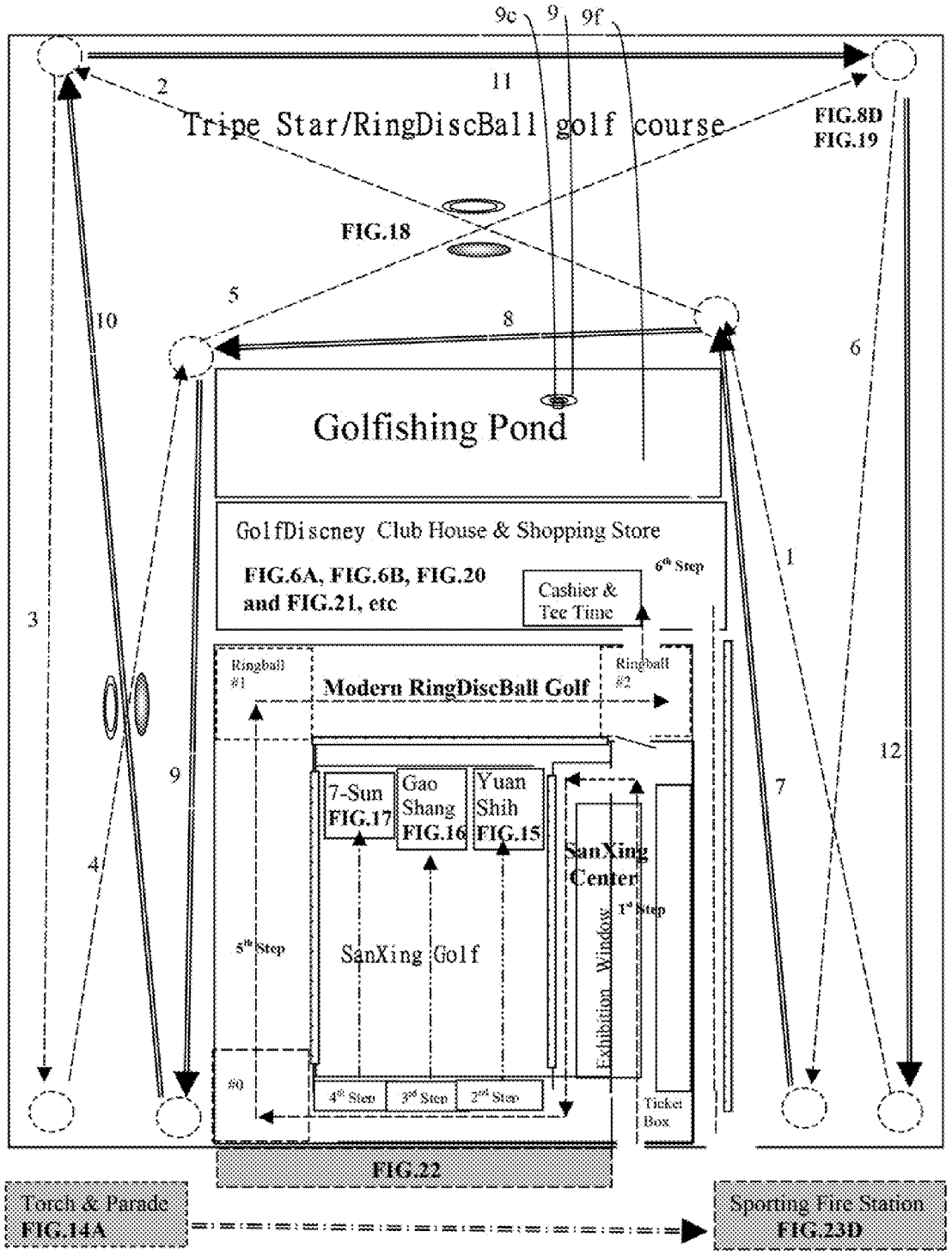

FIG. 26 is the GolfDiscney having the golfishing pond.

DESCRIPTION AND OPERATION

Figure 1A:
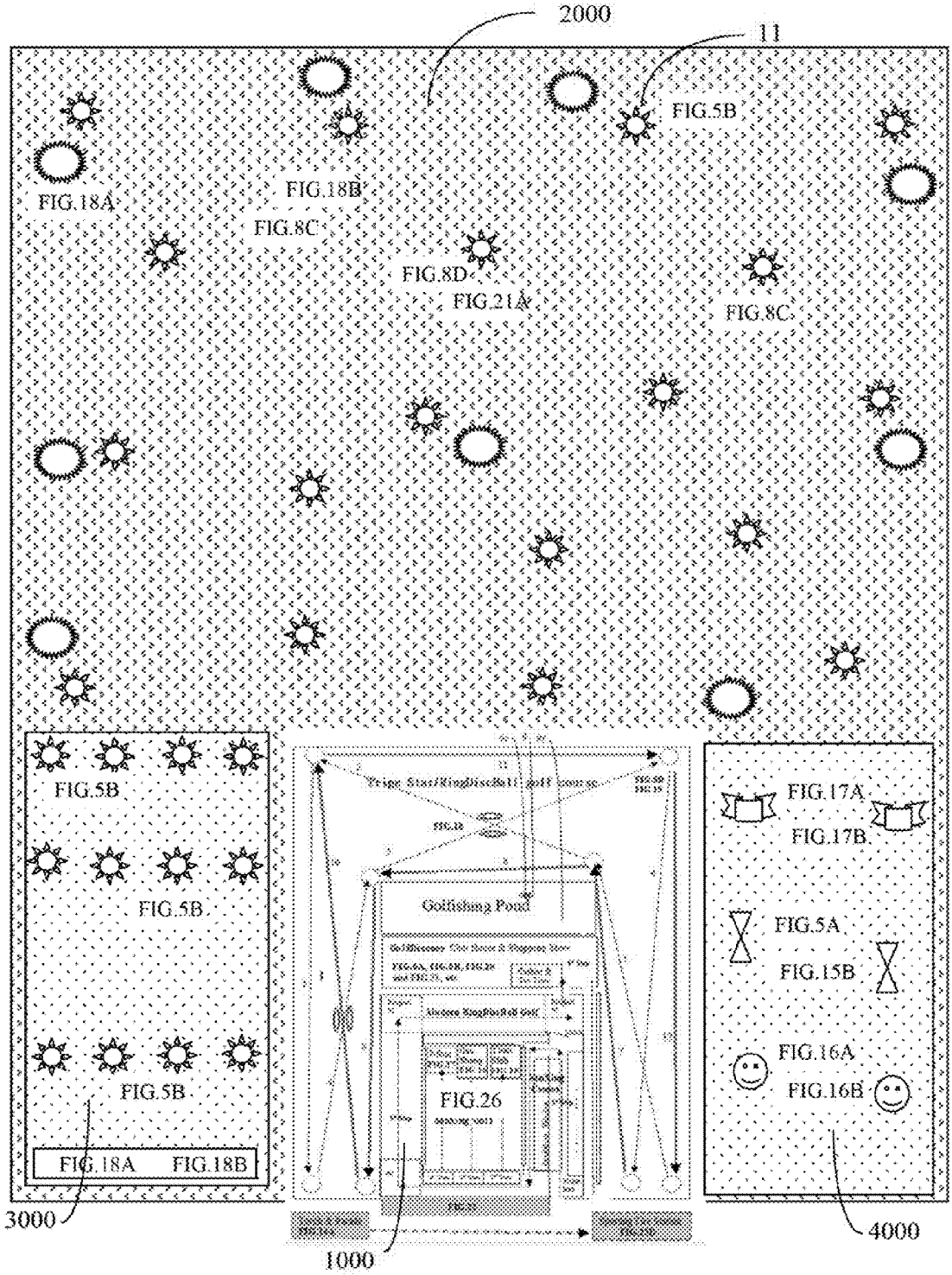
FIG. 1 (A) is one illustrative example of the Golfrisbee/Golfdisc/Golfring/Golfball Golf Topic Park for the Golf Discney World: (B) the table for the Comparison among Golf Sport, Disc Golf Sport and Golfdisc Sport; (C) is the scientific methodology, research and innovation flow for the RingDiscBall golf, Triple Star golf and'SanXing golf.
Figure 24A:
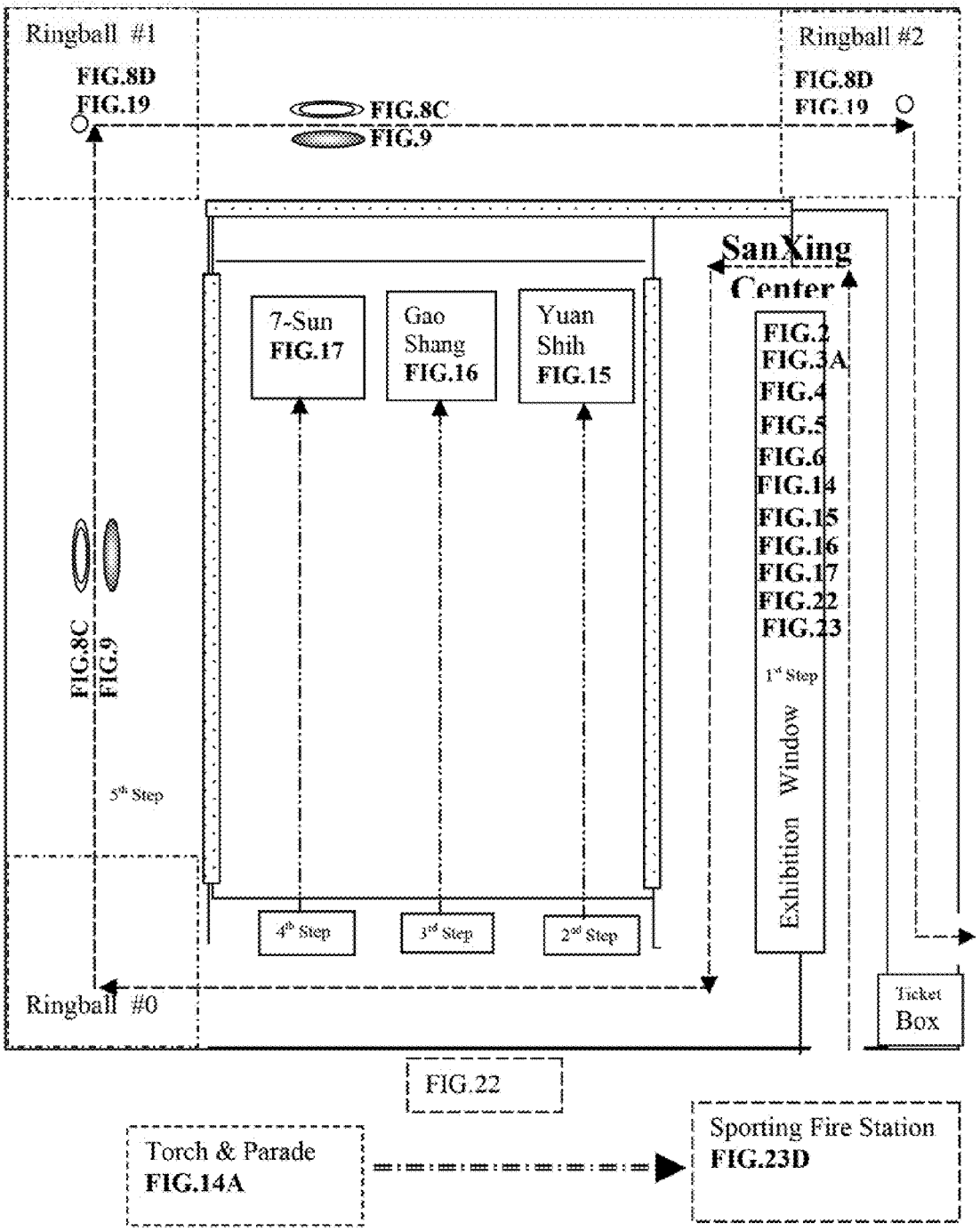

The GolfDiscney is the combination of Golf, Disc and DISNEY. This is the first entertainment center with the golf sport being the topic of the park. The Tang System does wish to promote the GolfDiscney through the versatile cooperative strategies. As shown in FIG. 1A, FIG. 24A and FIG. 26, they show the global views of the GolfDiscney World, the GolfDiscney Topic Parks in Walt Disney, Grand America, etc and the Miniature GolfDiscney Franchise chain stores. Hopefully, the trademarks of Golfdiscney, etc can bring up the interests of the WALT DISNEY, GREAT AMERICA, etc in the cooperative joint venture program.

FIG. 1A is one illustrative example of the GolfDiscney World. A GolfDiscney apparatus comprises golfdisc sports and golfdisc course. The golfdisc sports are played in the golfdisc course. The golfdisc sports comprise golfing club and flying disc, etc. The flying disc is mounted on the head of a golfing club. Swiveling the golfing club, the flying disc rotates and takes off from the head flying target.

Figure 17A:
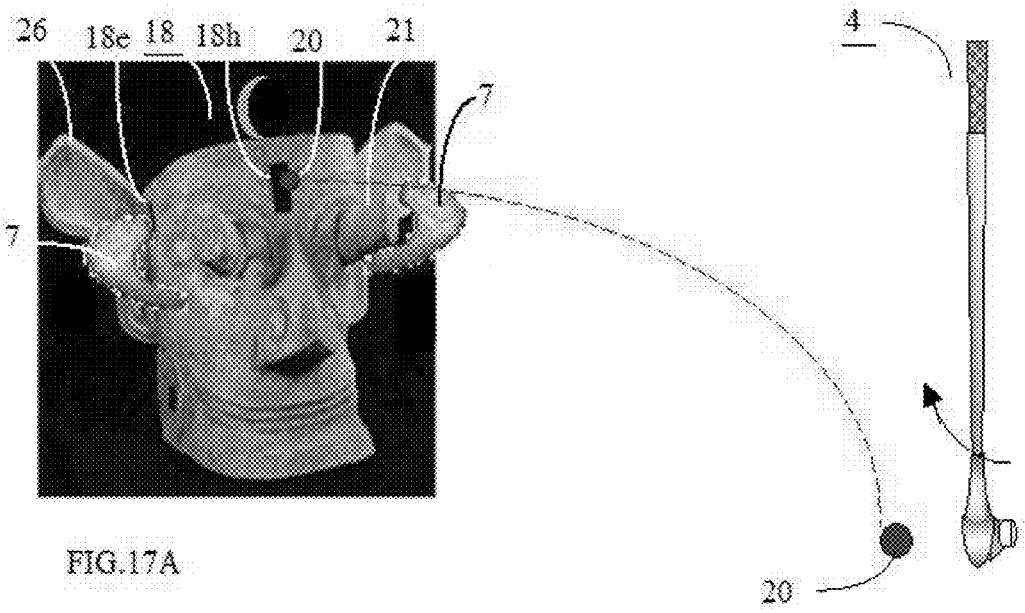

As shown in FIG. 1A, the GolfDiscney World is made of the GolfDiscney Center 1000, the Golfrisbee course 2000, the golfdisc practice course 3000 and the Ancient SanXing Golf course 4000. On FIG. 1A, there are small tags marked with the figure number in the drawing. They are the views and setup of the GolfDiscney World in the corresponding place. Referring to these figures in the drawing, it can easily imagine the activities in the GolfDiscney World. The GolfDiscney Center 1000 is shown as FIG. 26. The Golfrisbee course 2000 has the long drive of the golfrisbee/golfring as shown in FIG. 18A and the putting of the golfing as shown in FIG. 18B. The golfdisc practice course 3000 is the place to practice both the long drive and putting as shown in FIG. 18A and FIG. 18B, etc. The ancient SanXing Golf course 4000 is to practice the ancient Golf as shown in FIG. 17A, FIG. 17B, FIG. 5A, FIG. 14B and FIG. 16B, etc.

Figure 8A:
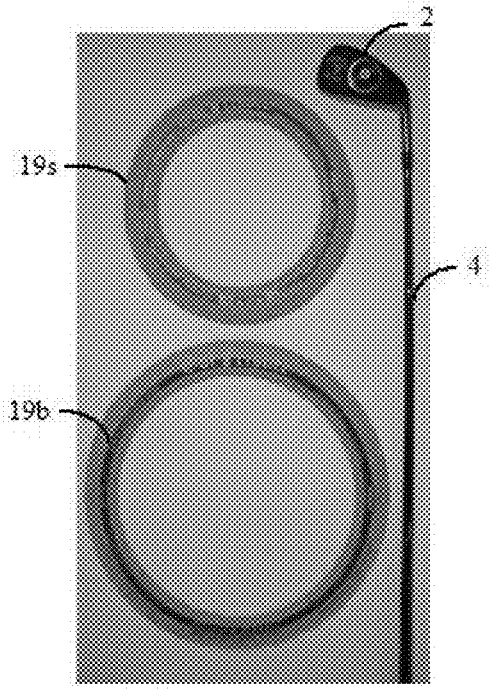
FIG. 8 (A) is the ring set of the modern Triple Star golf; (B) is the complete set of the Triple Star RingDiscBall golf set which includes the golf basket, golf hole, golf disc, golf ring and RingDiscBall golf club; (C) shooting the golfring toward golf basket with the RingDiscBall golf club; (D) putting the golfball into the hole with the RingDiscBall golf club.
Figure 8B:
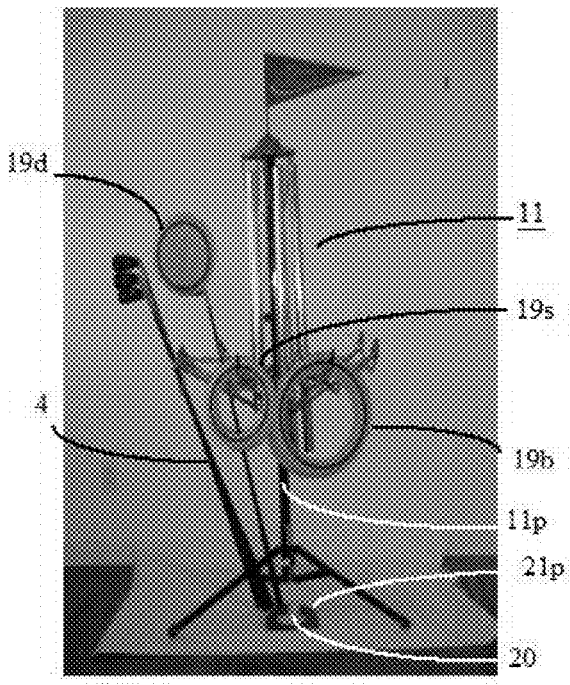
Figure 8C:
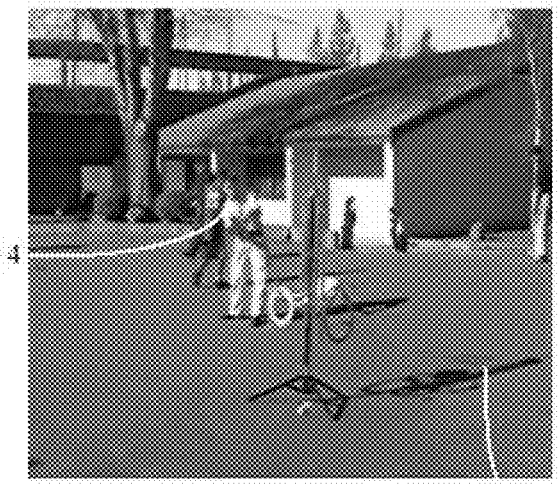
Figure 8D:
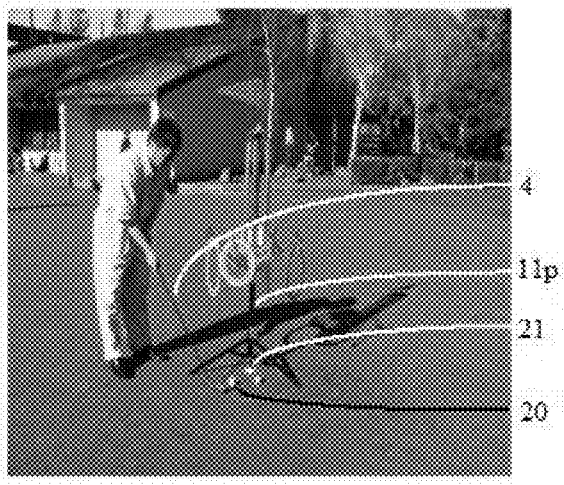

FIG. 24A is the core of the GolfDiscney World. All the activities in the GolfDiscney World are marked with the number of figures on the FIG. 24A. Referring to FIG. 24A, at the front of the GolfDiscney World, there are the golf dolls and YanYun tokens as marked and shown in FIG. 22. The YanYun torch parade as shown and marked with FIG. 14A walks around outside the GolfDiscney World first. At the end of the parade, the parade lights the fire of the Olympic-YanYun Flame basin as marked and shown in FIG. 23D. This YanYun torch parade is held every two hours. After the visitors by the ticket from the ticket box, they walk into the SanXing Center of the GolfDiscney World. In the Exhibition Window, there are the ancient golfball, golfing and golfdisc, etc heritages and movies, etc as marked and shown with FIG. 2, FIG. 3A, FIG. 4, FIG. 5, FIG. 6, FIG. 14, FIG. 15, FIG. 16, FIG. 17, FIG. 22 and FIG. 23, etc. After the visitor has the GolfDiscney educational course, they can start the practice of the ancient classical golf such as YuanShih, GaoShang and 7Sun, etc. As shown in FIG. 24A, the $2^{nd}$ station is the YuanShih Golf as marked and shown with FIG. 15. It is the golfing to fly the ring to hook up on the frame. The $3^{rd}$ stationis the GaoShang Golf as marked and shown with FIG. 16. It is golfball to fly the ball into the slot on the head. The $4^{th}$ station is the 7-Sun Golf as marked and shown with FIG. 17. It is the boomerang golf to hit the temple slot of the head. After the ancient classical golf, then it is the practice of the modern golfdisc, golfring and golfball, etc. Surrounding the golfdiscney core is the golfdisc/golfrisbee course. The visitor can swivel the club to fly the golf ring and/or golf disc as shown and marked with FIG. 8C and FIG. 9. As the disc or ring fall in the green area marked with Ringball#1 and Ringball#2, the disc golf or ring golf are changed to be the ball golf as marked and shown with FIG. 8D or FIG. 19. The visitor can putt the ball to roll into the cup/hole as shown in FIG. 8D. The visitor can putt the ball to fly into the cup/hole as shown in FIG. 19. After the short practice of the versatile golf, then the visitor finishes the GolfDiscney tour and walks out the GolfDiscney world.

FIG. 26 is the center of the GolfDiscney World having the golfdisc course, golfdisc store, golfishing pond and the golfdiscney core as shown in FIG. 24A. After the golfdiscney tour, the visitor can go to the golfdisc shop to buy the golf arts and golfrisbee sets as shown in FIG. 6A, FIG. 6B, FIG. 20 and FIG. 21, etc. As the visitors buy the golfrisbee sets, the visitor can go to the golfishing pond to golfishing or go the Tripe Star/RingBall golf course to enjoy the RingDiscBall golf as marked and shown in FIG. 18.

The golfdisc course design is completely different from the conventional golf course. The comparison table is shown in FIG. 1B. The golfer stand still and swivels club to hit the ball to fly. The golfer carries a lot of clubs and the golfer changes clubs. However, the golfer doesn't change the ball. The golf course uses the sand caves and water ponds as blockages. In the golf course, there is absolutely no tree in golfing zone. For the long drive, the ball cannot have the dogleg-flying path. There is no running on the concrete pad for the long drive. Putting ball is to use the club hit the ball to roll the ball into hole on the ground.

The disc golfer swivels arm to throw the disc to fly. The disc golfer cannot change arm. However, the disc golfer does change discs. The disc golfer carries a lot of disc.

The disc golf course uses the tree as blockages. There is no blockage of sand caves in the disc course. There is no water pond, either. The disc golfer runs on the concrete pad for the long drive. The disc golfer throws the disc into the basket mounted on a standing pole.

The golfdisc player swivels club. The golfdisc player can change both clubs and discs. The golfdisc course uses the tree as blockages. There are no blockages of sand caves. There is no water pond, either. The golfdisc player doesn't run on the concrete pad for the long drive. They stand and swivel the club to launch the discs to fly. The putting of the golfdisc is to swivel the club to fly into the basket on a standing pole.

There is no sand cave in the disc golf course and golfdisc course. For the disc golf, the disc golfer use hand to hold the disc. For the golfdisc, the disc is mounted on the golf club. The sand cave doesn't cause the difficulty.

Different disc has different flying characteristics. The disc golfer carries many discs. The disc costs a lot. It costs too much to lose the disc in the water pond. So, there is no water pond in the disc golf course, either.

In the golf course, the high-flying golf ball is extremely dangerous. It can kill the people. The safety is the first concerns. It must have the clear view to make sure that no other people in the golf ball flying direction. So, for the golfing zone, there is no tree in the golf course.

In summary, the golf course has the sand caves, water ponds, hole on the green and no tree in golfing zone. The golfdisc course has tree and doesn't have sand caves, water pond and green. The golfdisc course is completely different from the golf course. In golf, a hole in one or hole-in-one (also known as an ace, mostly in American English) is when a player hits the ball directly from the tee into the cup with one shot. In golfdisc, a basket in one or basket-in-one is when a golfdisc player flies the disc directly from the "tee" into the basket with one "shot". However, in the golfdisc course, the golfdisc basket hides behind the tree. The golfdisc player has to use the dogleg-flying path to have the basket-in-one. The dogleg style basket-in-one is the peak performance of the golfdisc. The golf doesn't have the dogleg flying style at all. Therefore, the golfdisc is completely different from golf. The golf and golfdisc are not only having the difference of the hardware of the tree, sand and pond but also having the difference of the ways to play hole-in-one and basket-in-one, etc.

With the above global view of the GolfDiscney World, then we go through each figure to under the details of the GolfDiscney World. The SanXingDui heritage is the eighth Archaeological miracle in the world. It is well known as the thousands years of Archaeological mystery. To the Western, China is mysterious. The Ancient China is mysterious of mysterious. The SanXingDui heritage is the mysterious in Ancient China to be the triple mystery. To the Chinese, the SanXingDui heritage is never recognized in Ancient China documents. How to decode the SanXingDui heritage correctly is a civilization challenge to the academic societies. To decode the SanXingDui heritage correctly, where and what is the key to decode?

We are not only the technologist but also the civilization scholar. We apply our unique Triple-Star Golf technologies to decode the SanXingDui heritage successfully to be the SanXing Golf. We not only re-write the history of golf but also re-write the history of the civilization.

Figure 1C:
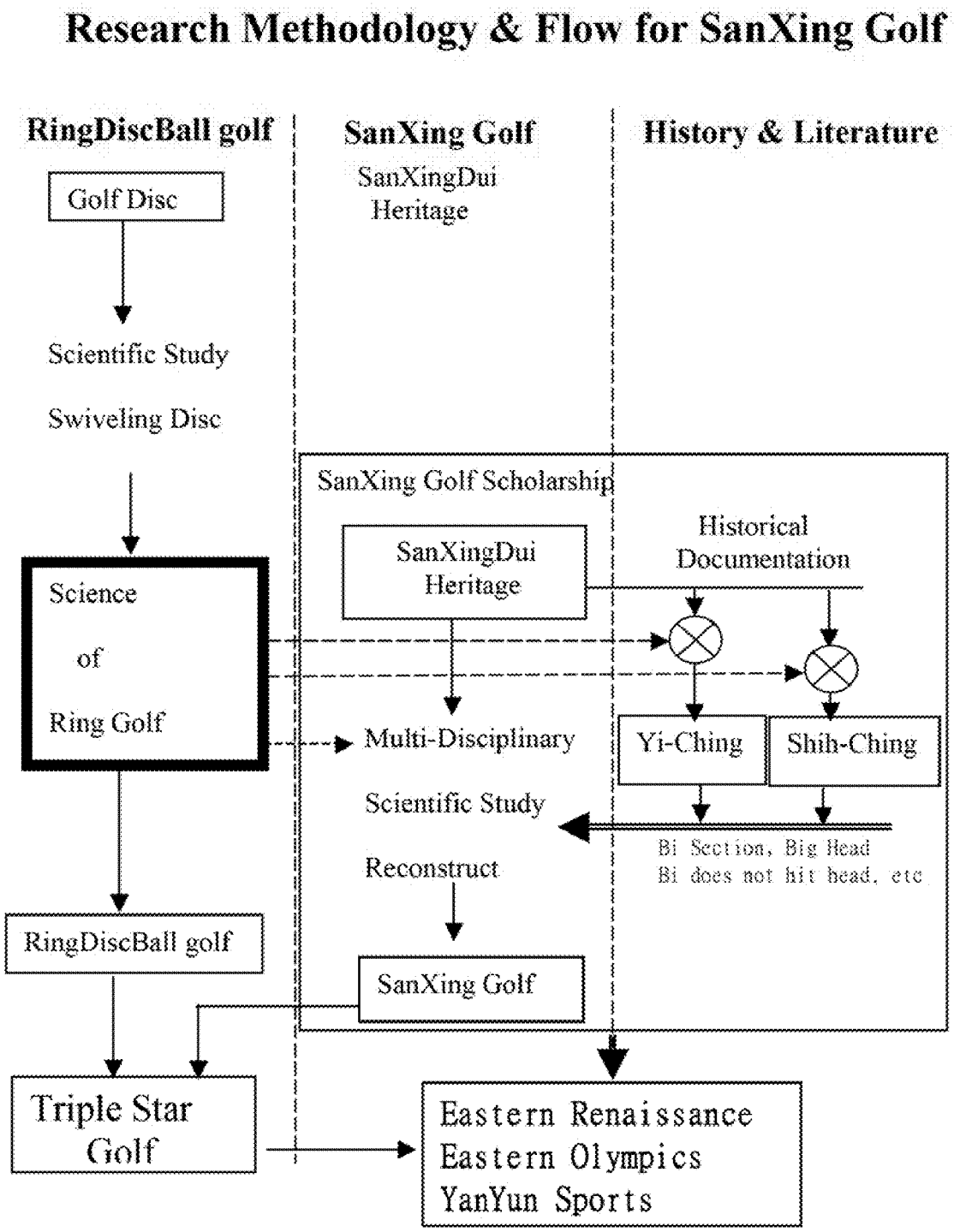

How we make the breakthrough in the RingDiscBall golf to decode the SanXingDui archaeology heritage and invent the SanXing Golf? FIG. 1C shows the innovative study process for the Triple Star golf and the SanXing golf. Before the Triple Star golf of RingDiscBall golf, there is no ring golf, not to mention the science of ring golf. Without the science of ring golf, it is impossible to understand the SanXingDui heritage and the ancient SanXing golf documentations, such as YiChing (易經) and ShihChing (詩經). So, the science of ring golf is the fundamental basis to understand the SanXingDui heritage for the SanXing golf.

The science of ring golf is coming from the research on the defect of disc golf. Until today, there are almost 3000 disc golf courses in US. However, the disc golf player still uses the hand to throw the disc. There is no club swiveling disc golf. To have the club swiveling disc golf, we made the fundamental study for the science of ring golf. With the science of ring golf, we recognize the usage of the SanXingDui heritage and find out the correspondent record in the ancient books of YiChing (易經) and ShihChing (詩經). So, as the SanXing golf heritage came out from the earth in SanXingDui, 1986, there was nobody in the world understood the purpose and application of the SanXingDui golf heritage. They guessed the SanXing golf heritage was for the purpose of the religion. They didn't recognize the SanXingDui golf heritage being for the national defense physical education. Furthermore, based on our discovery of the SanXing golf to be the ancient national defense sport, we find out the lost ancient Oriental civilization. Then we start to promote the Eastern Renaissance and Eastern Olympics, YanYun. To promote the Eastern Renaissance and Eastern Olympics, we start to make the Triple Star GolfDisney World innovation in the entertainment industry.

To decode the SanXingDui golf heritage with the invention of golfrisbee is a long story. We have invented the golfrisbee and get the patents. As we prototype our golfrisbee invention, we have met a lot of technical challenges. Since we name our invention as golfrisbee, naturally, we select the traditional golf club to be the club. We try to mount the golfrisbee head on the back of the golf club head that the modified golf club can be ringball golf club. The ringball golf club can swing to hit the golf ball with one side and can swing to launch the disc/ring to fly with the other side. There are three kinds of clubs, wood club, steel club and the putting club. The wood club head is too big and the putting club is too small to mount the launching screw of the ringball golf club head. So, we have only one choice to select the steel club head to be the base of the ringball golf club.

Figures 2, 2A:
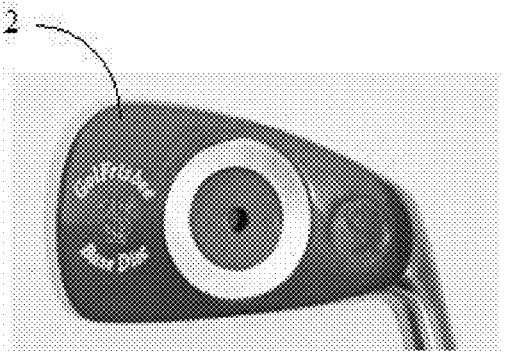
FIG. 2 (A-1) is the 3500 years ago SanXing's ringball golf club head made of jade coming out of the SanXingDui heritage; (A-2) is the RingDiscBall golf head made of the steel for the Triple Star RingDiscBall golf; (B-1) is the 3500 years ago SanXing golf club made of jade head and golden stick; (B-2) is the modern triple Star RingDiscBall (RDB) golf club made of steel head and fiber-carbon stick.
Figures 1, 2B:
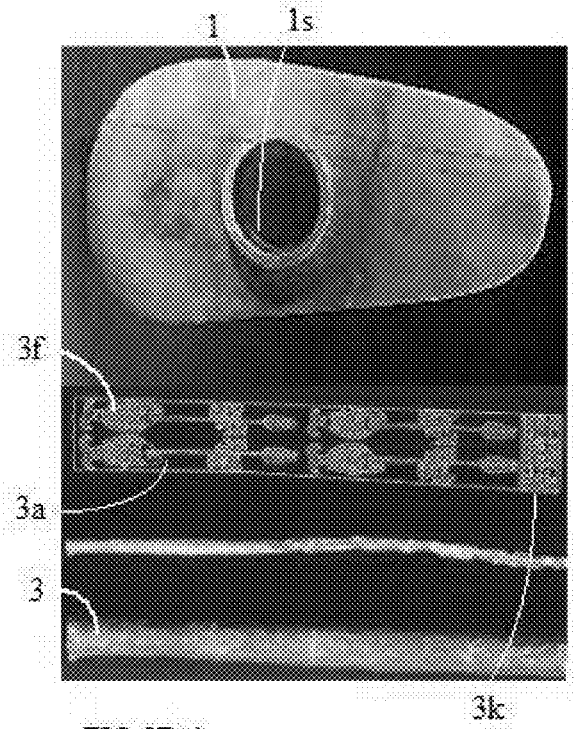
Figures 2, 2B:
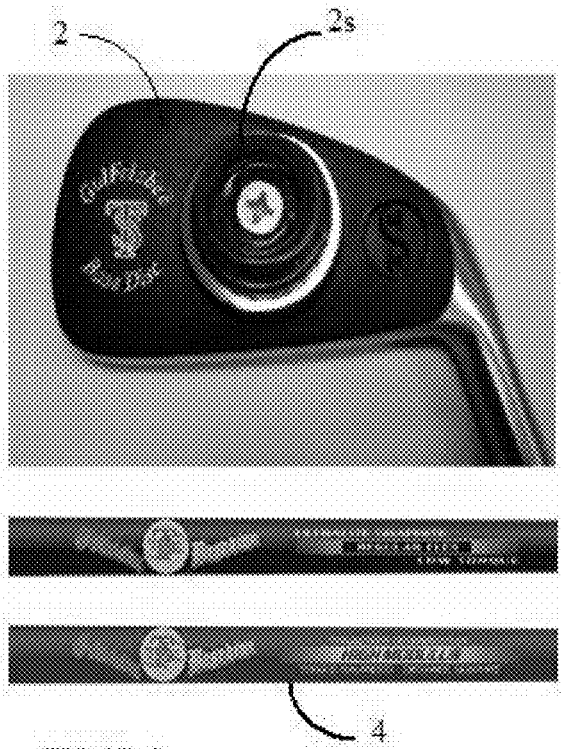

As we finished the prototype of the ringball golf club head 2 as shown in FIGS. 2A-2, for several years, we come across the SanXing golf club head 1 of the SanXing heritage as shown in FIGS. 2A-1. We feel very strange why the shape of this SanXing heritage is so familiar? It seems that we had seen it before. Suddenly we understand it is our Triple-Star golf's ringball golf club head 2. As shown in FIGS. 2B-2, it is the $2^{nd}$ generation of the ringball golf club head 2 which has the adjustable launching screw to adjust the launch angle for the disc/ring to fly. For the $1^{st}$ generation of the ringball golf club head, the launching screw is fixed. The $1^{st}$ generation of the ringball golf club head is much more similar to the SanXing heritage 1 as shown in FIGS. 2A-1.

So, from the comparison between the SanXing heritage 1 in FIGS. 2A-1 and our ringball golf head 2 in FIGS. 2B-1, we get the hint that we might hold the key to decode the SanXing heritage. The SanXing heritage actually is ancient ringball golf sport.

As shown in FIGS. 2B-2, the ringball golf club has golf stick 4. If the SanXing heritage is golf sport, it must have a golf club. Where is the stick of the SanXing golf? As we search the SanXingDui heritage, we really find a golden skin of stick of the SanXing golf (中道). As shown in the FIG. 2B-1, it might be the golf club of the SanXing heritage. The SanXing golf club has the composite material with the golden skin 3 wrapping around the elastic wood. The SanXing golf club 3 is constituted of the composite material, the golden skin 3 and the wood core. The wood core already has decayed and disappeared and only the golden skin 3 is left to prove that the SanXing golf had the club 3.

In FIGS. 2B-2, the Triple Star golf club head 2 has the launching screw 2*s*. This is an external screw on the launching screw 2*s*. As shown in FIG. 28-1, the SanXing golf club head 1 might have the internal screw 1*s* on the interior wall of the SanXing golf club head 1.

As shown in FIGS. 2B-2, there is logo mark on the carbon fiber plastic club 4. As shown in FIG. 2B-1, at the end of the SanXing golf club, there is the logo of the "king of light" 3*k*. It represents the former owner of this SanXing golf club being the "king of the Source of Civilization". The light source of human civilization was the Ming in 5000 years ago. There are four commanding arrows 3*a* plugging into the fishes 3*f*. The logo of commanding arrow 3*a* plugging into the fish is exactly corresponding to the written record in the ancient orient book YiChing. It proves that the SanXingDui heritage has the relation with the YiChing.

From our own research on the decode of the ancient Oriental history, 5000 years ago, during the civil war of the rebelling Chinese barbarian, the "King of Ming" stepped out as the "Emperor of Yan" to lead the YanYun Sportsmen to fight against the rebelling Chinese barbarian. The SanXingDui heritage actually was the heritage of the "Eastern Olympics, YanYun. After the Chinese barbarian taking over the North China, the Emperor of Yan took the national defense secrete training facilities, YanYun heritage, with him and fled to the South China. Finally, thousand years later, under the mass attack of Chinese barbarian, the national defense secret training facilities, YanYun heritage, was buried under the earth of SanXingDui to be the SanXingDui heritage in 3500 years ago. From then on, East Asia was under the control of the rebelling Chinese barbarian and is named as China (羌哪). East Asia lost its civilization and it is 3500 years Oriental Dark age until today. So we need to promote the Eastern Renaissance and Eastern Olympics to reconstruct the ancient Oriental Civilization. Why the Western Renaissance and Western Olympics were much easier and completed earlier and the Dark Age was much shorter than the Eastern Renaissance and Eastern Olympics? The Western barbarian was honest and the Western barbarian didn't cheat and distort the history. The Eastern Chinese barbarian was cheating, distorting the history, dedicating to ruin and wipe out the Eastern civilization completely. So, as the Western heritage coming out from Italy, everybody recognize it belong to ancient Greece and Roma. As the Eastern heritage coming out from SanXingDui, nobody can recognize it and nobody know it should belong to which civilization.

Figures 1, 3A:
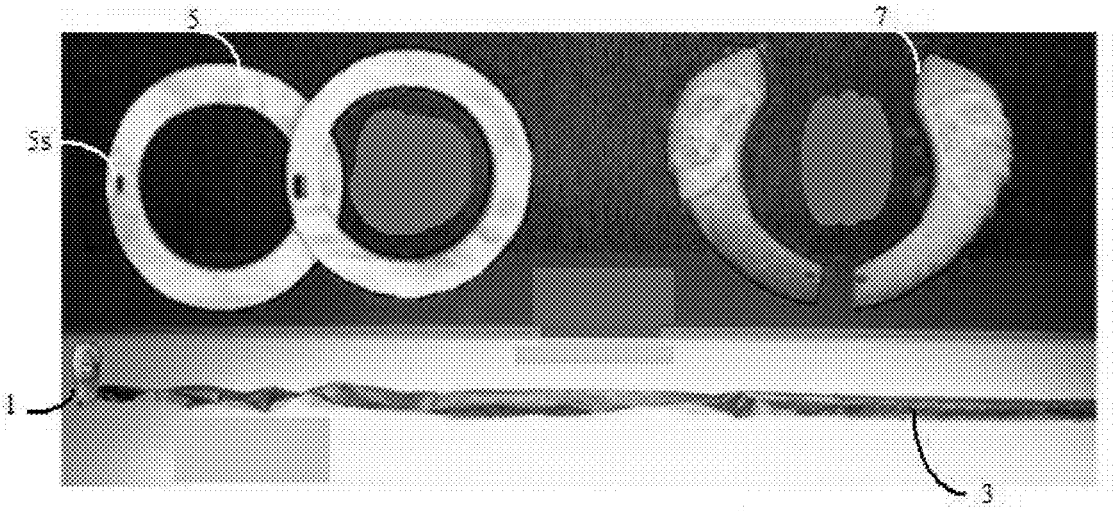
Figures 2, 3A:
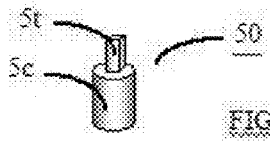

According to the principle of the Triple Star Golf, we invent the SanXing golf with the components we found in the SanXingDui heritage. As shown in FIGS. 3A-1, it is the complete set of the SanXing golf being composed of the SanXingDui heritage. The jade club head 1 is mounted on the golden stick 3 to be the SanXing golf club (丈). The ring (元) 5 is made of the jade having a slot 5*s*. There should be a wooden plug adaptor 50 as shown in FIGS. 3A-2 to make the SanXing golf club 1 to be able to throw the ring 5 to fly. The rectangular end 5*t* is plugged in the slot 5*s* of the ring 5. The cylindrical end 5*c* of the wooden plug adaptor is fitted into the cylindrical hole having the inner screw 1*s* as shown in FIGS. 2B-1. Swiveling the golf club 3, the ring 5 rotates and the inner screw 1*s* expels the wooden plug 50 out of the cylindrical hole during rotation. Then the ring 5 takes off to fly in the sky.

A GolfDiscney apparatus has the flying disc to be boomerang. The boomerang is mounted on the head of a golfing club. Swiveling the golfing club, the boomerang rotates and takes off from the golf club head flying toward a target.

As shown in FIG. 3A-1, there is one killer application of the half-ring type boomerang (七日) 7. The head of the half-ring boomerang 7 is in the shape of semi-circular cone. It is to attack the enemy head as shown in FIG. 17A. The half-ring type boomerang (七日) 7 is known as the 7-Sun (七日) in the ancient orient Book YiChing. As shown in FIGS. 3A-1, FIG.

Figure 17B:
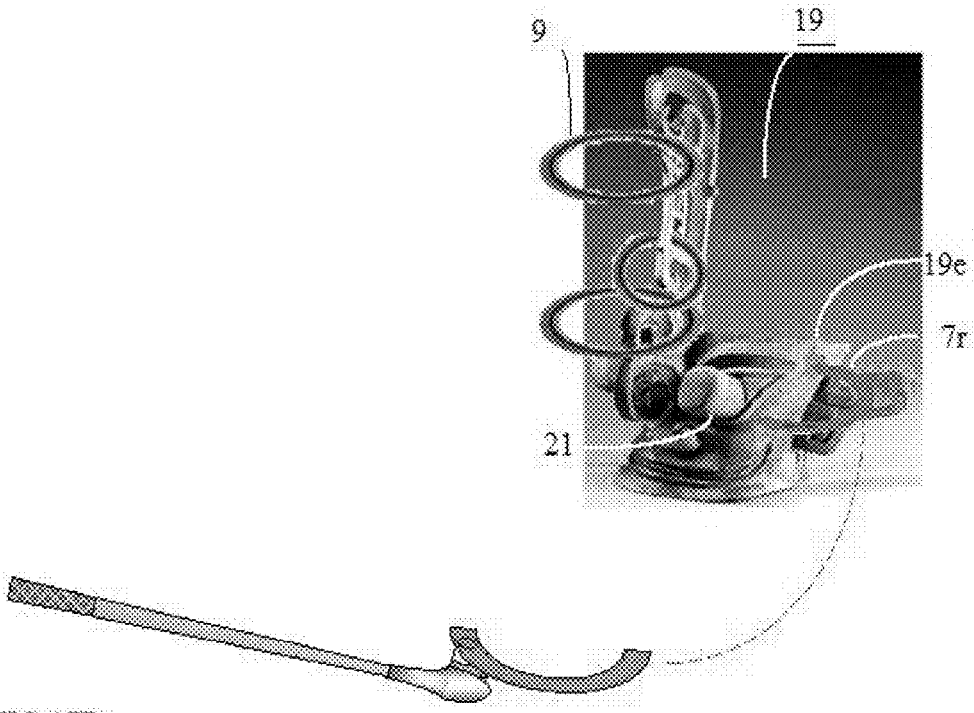
Figure 18A:
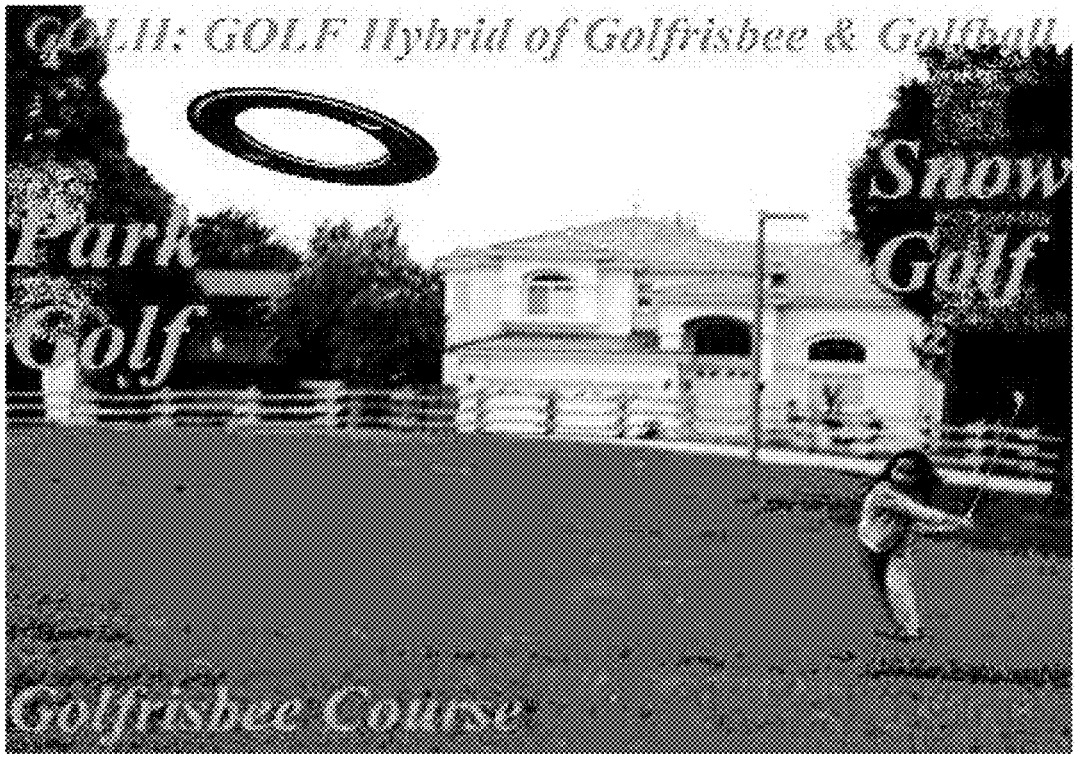
Figure 18B:
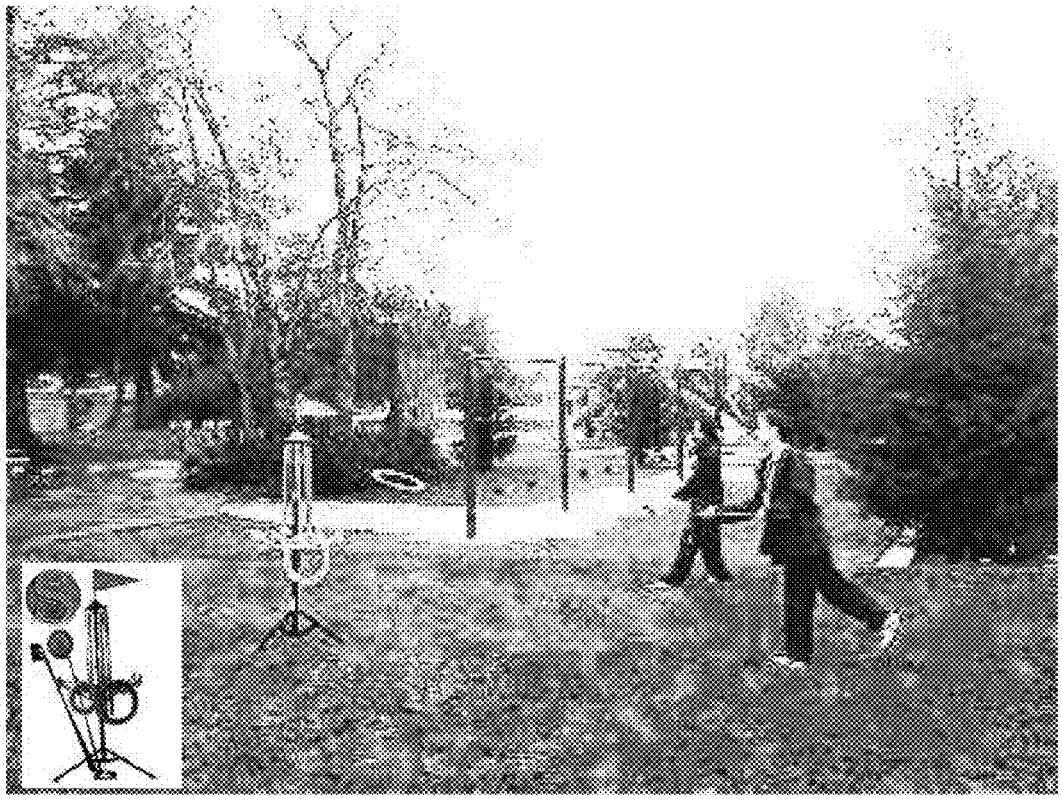

17A and FIG. 17B, the 7-Sun 7 hits on the temple. As the 7-Sun hits on the enemy's temple (太陽穴), the enemy's eyeballs jump out of orbital. As the 7-Sun 7 hits on the side of the head, the large impact force and rotating drilling force of the 7-Sun 7 will drive the eyeball 21 to jump out of the orbital. So, in FIG. 17A and FIG. 17B, the big head 18 and big head 19 have the eyeball protruded outside the orbital. It is quite descriptive bronze art.

The big head is the target. The 7-Sun is the boomerang 7. The temple 18*e* is the trapping hole. The ear 26 has the means of the guiding slot. The target further comprises the means for trapping and a means for guiding. The boomerang 7 hits on the guiding ear 26 and is trapped by the trapping hole 18*e*.

This deadly weapon 7-Sun 7 is especially dedicated for the enemy general. The hit enemy general will die instantly at the spot. It would be the tremendous shock to the enemy troops. The rebelling barbarian troop would retreat immediately after the general had been killed with 7-Sun at the spot.

Figure 3B:
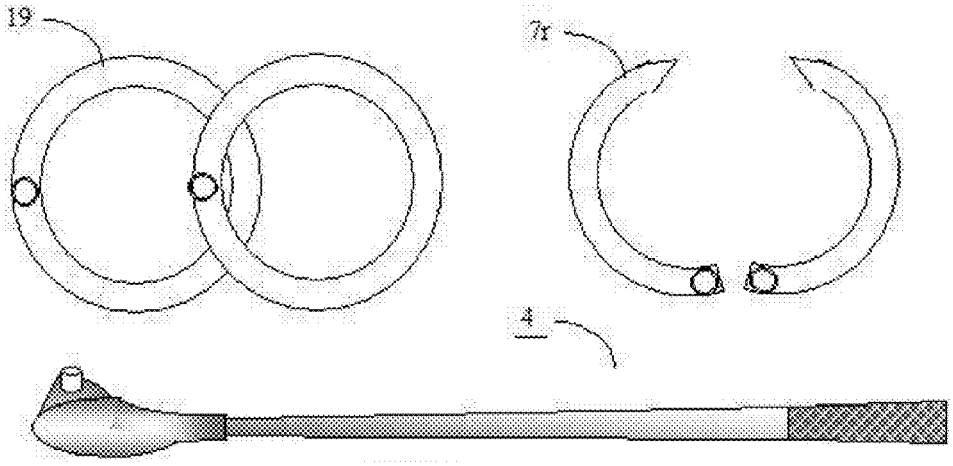
FIG. 3 (A-1) is the complete set of the 3500 years ago SanXing golf set; (A-2) is the missing wooden adaptor part in SanXing golf; (B) is the modern Triple Star RingDiscBall (RDB) golf club set.
Figure 20A:
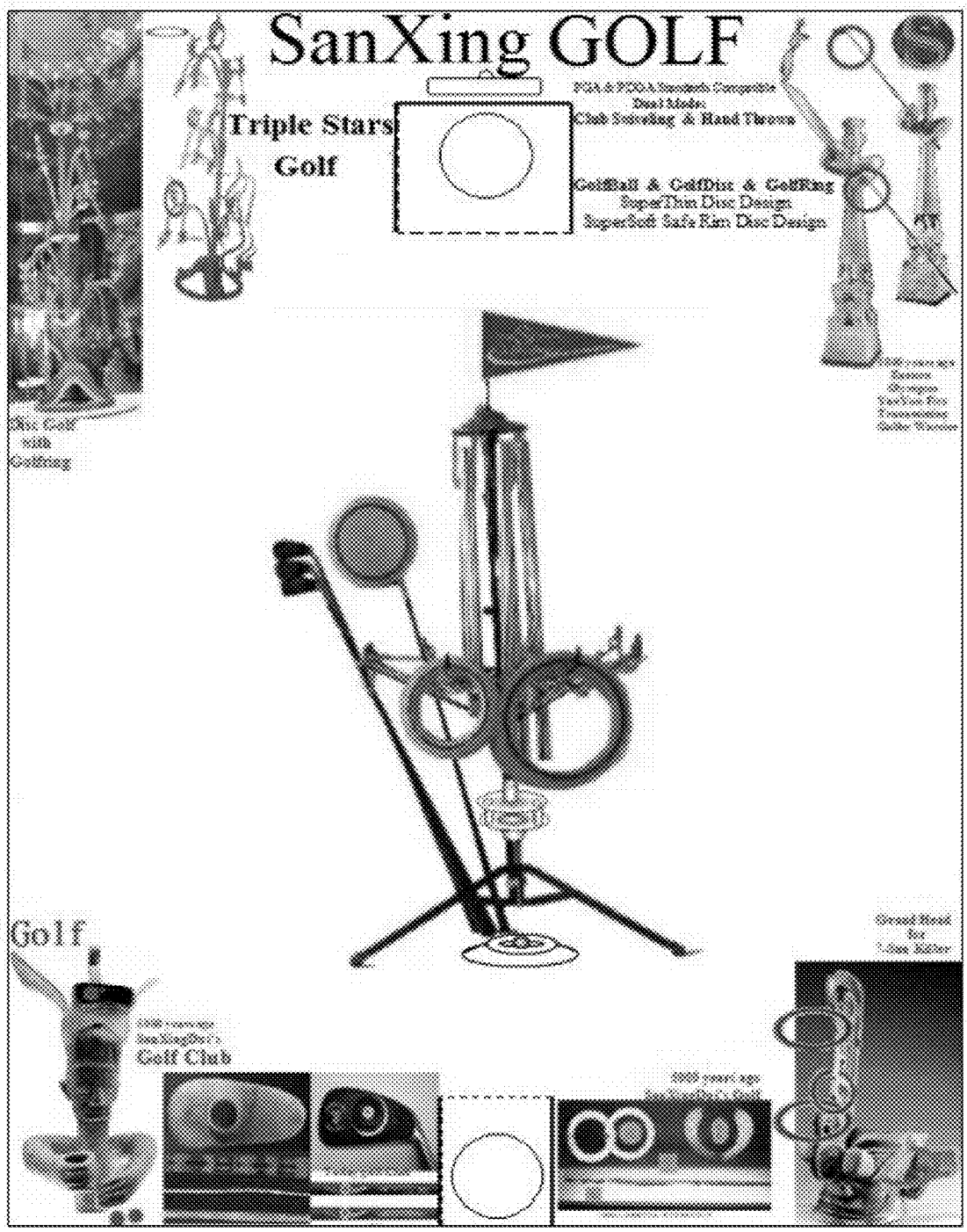

As shown in FIG. 3B, the ring 19, the SanXing Golf is made of the Triple Star Golf club 4, ring 19 and the half-ring 7*r*. The Triple Star Golf is as shown in FIG. 8A and FIG. 20C. The adaptor is screw 2*s* as shown in FIGS. 2B-2.

A target of the GolfDiscney apparatus comprises a plurality forks. The plurality forks can hook up the flying disc. The flying disc has a hole to be a golfring to be hooked up by the plurality forks. The plurality forks further comprise blocking means to block the flying disc to catch the flying disc with the plurality fork.

Figure 5A:
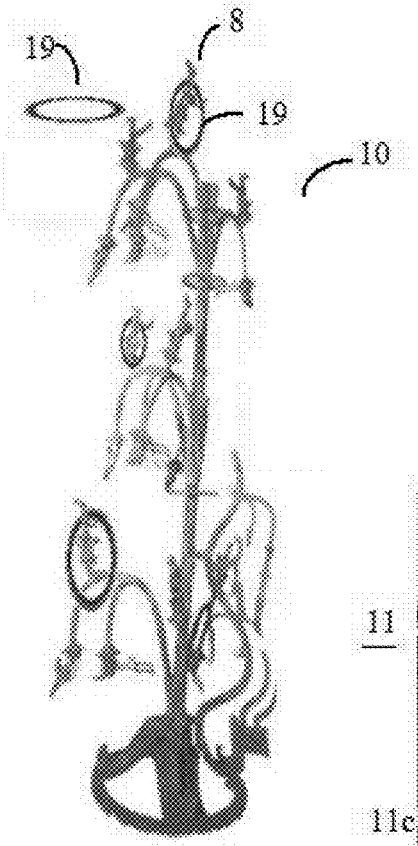
FIG. 5 (A) is the 3500 years ago YuanShi of the SanXingDui heritage which serves as the hanger for the golfing. The golfrings fly and target on the nine sculls on the YuanShi; (B) is the modern DiscRing basket which has net and hooks serving as the target of golfing and golfdisc.
Figure 5B:
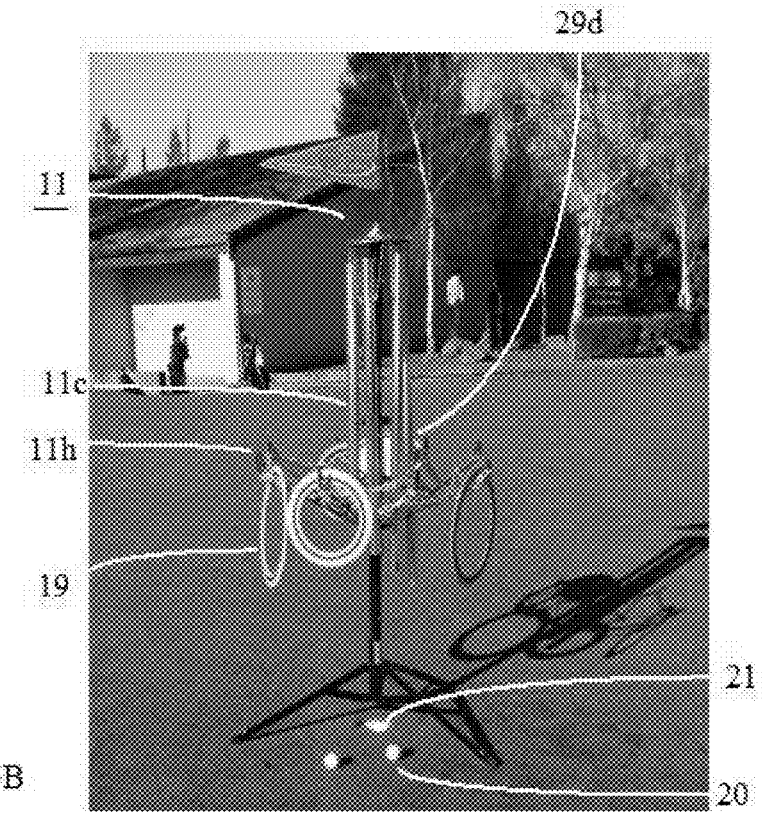
Figures 21A, 21B:
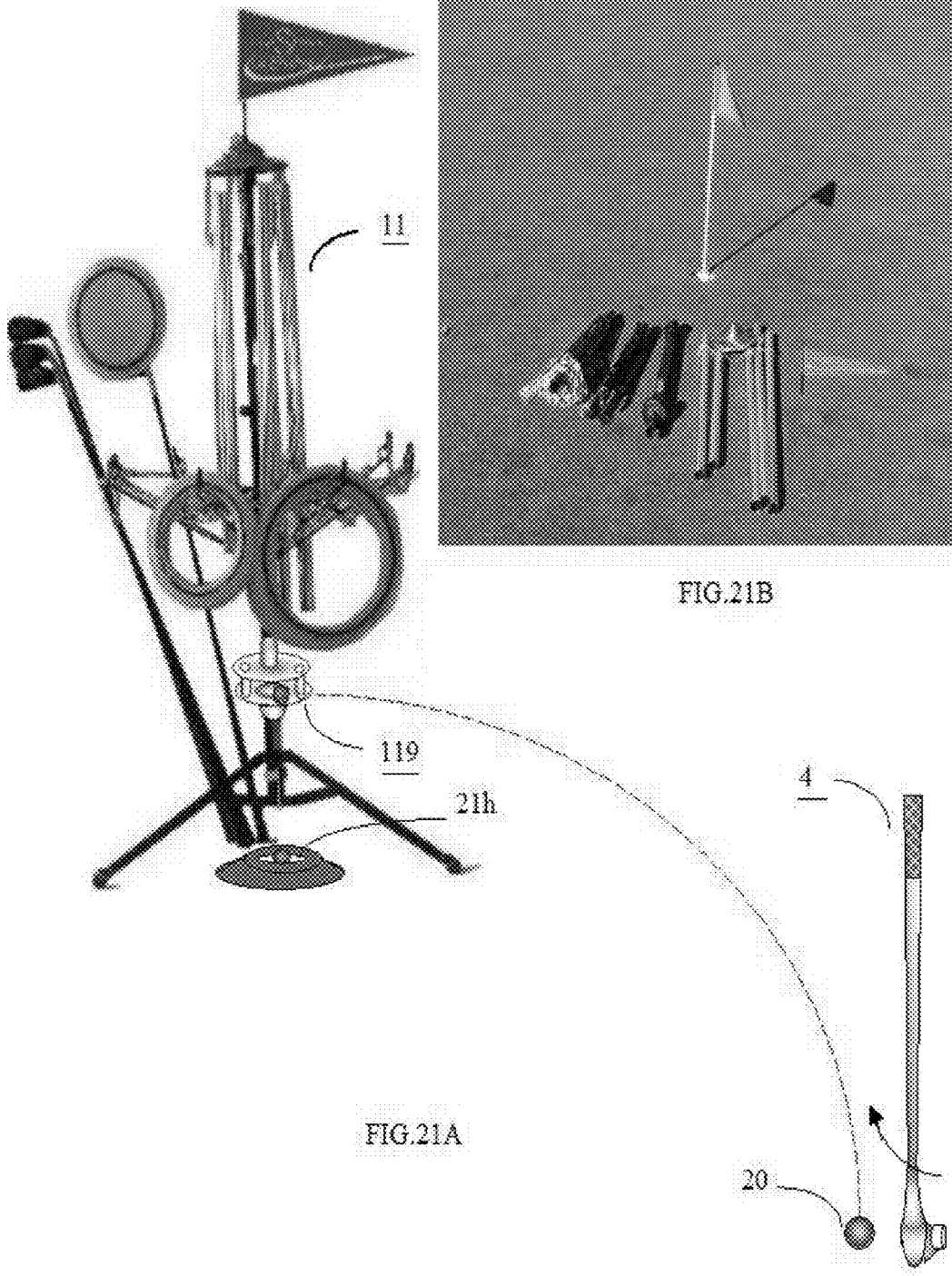

In the modern ringball golf sport, as shown in FIG. 5B, there is one golf basket 11 to be the target of the flying golf ring 19. The basket is made of wind chain 11*c*, nets of steel chains 11*n* and hooks 11*h*. The flying ring 19 hits on the wind chain 11*c* and either falls into the basket or hangs on the hook 11*h*. The golf ball 20 is putt to roll into the hole 21. The golf basket 11 is portable and can be placed over the hole 21 directly. For the ringball golf, outside the green, it uses the flying ring; on the green, it uses the rolling ball 20. It is the safe and enjoying golf. The ringball golf is compatible with the conventional golf course today. As shown in FIG. 21A, for the Triple Star golf basket, the golfball 20 can be a flying ball 20. Swiveling the golf club 4, the golfball is hit to fly into the slot 119 on the post of the basket 11.

Figure 4A:
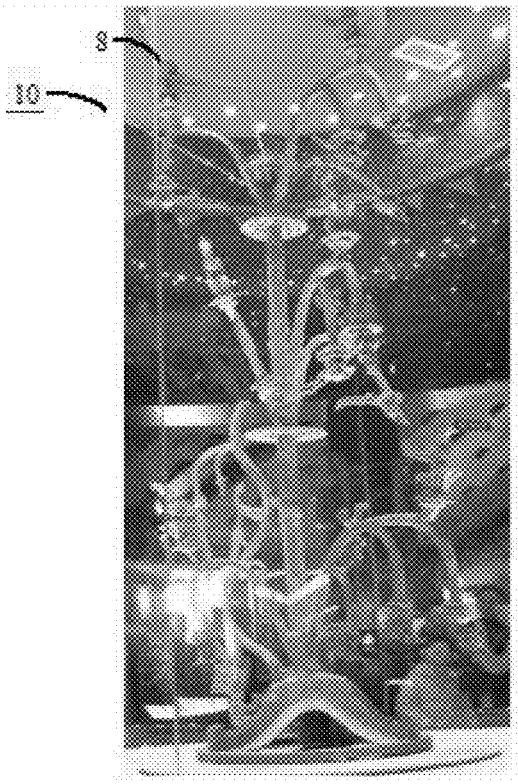
FIG. 4 (A) is the 3500 years ago YuanShi of the SanXingDui heritage which had nine sculls sitting on the branches of the ocean tide; (B-1) is the scull; (B-2) is the bronze scull on the bronze YuanShi tide; (B-3) is the golfing hit on the fan on the back of the bronze scull; (B-4) is the golf ring falling on the back of the bronze scull.
Figures 1, 4B:
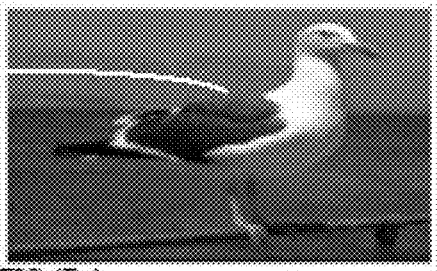
Figures 2, 4B:
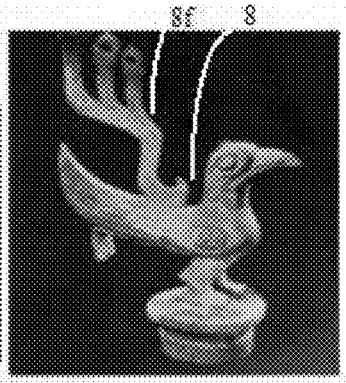
Figures 3, 4B:
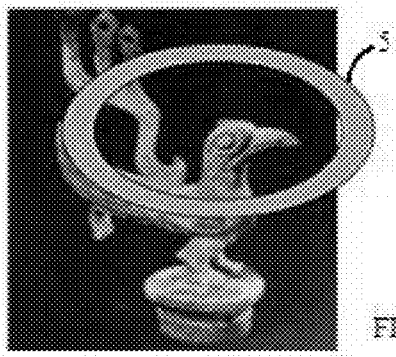
Figures 4, 4B:
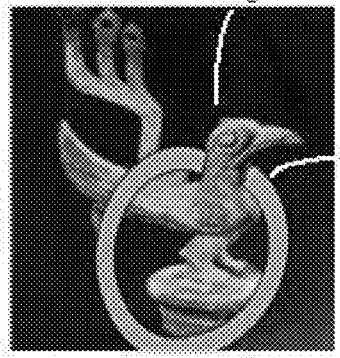

What is the target in the Ancient SanXing golf? As shown in FIG. 4A and FIG. 5A, the YuanShi (原筮; 中原=中道源筮; 中國=中道立國) 10 of the SanXingDui heritage is the target of the SanXing golf. In FIG. 4A, there are the travelers. It can show how huge the giant YuanShi (原筮) 10 is. The YuanShi (原筮) having the Ocean Tide structure is the target for the golfring. There are nine sculls 8 riding on the ejecting tide to be the hanging hooks of the flying rings 9. As shown in FIGS. 4B-4, the target of the ring is a scull type hook. Comparing the real life scull 6 in FIGS. 4B-1 with the bronze bird 8 of SanXingDui heritage in FIGS. 4B-2, the bronze bird 8 of SanXingDui heritage is scull. The scull 6 is only existed in the ocean beach. It proves that the SanXingDui heritage came from the ocean civilization, not the inland river civilization or prairie culture as the Chinese barbarian culture does today. The SanXingDui heritage is not the Chinese barbarian culture. It is no wonder that the Chinese does not recognize the SanXingDui heritage. The Chinese think the YuanShi (原筮) to be a tree. The SanXingDui heritage is actually the lost oriental ocean civilization. The YuanShi (原筮) 10 is in the shape of the ejecting of ocean tide. The YuanShi (原筮) 10 is not a tree at all. There are spray and dangling shells decorations on the YuanShi 10. Both spray and shells only exist on beach. It is the scene on the beach. As shown in FIG. 4A and FIG. 5A, the target of the ring is scull.

How can we prove that the YuanShi (原筮) 10 in FIG. 4A is the ring hanger to be the target of the ring 5 as shown in FIGS. 3A-1? As shown in FIGS. 4B-2, it is the bronze scull 8. The bronze scull 8 is corresponding to the hook 11*h* of the golf basket in FIG. 5B. As shown in FIGS. 4B-2 and FIGS. 4B-3, on the back of the bronze scull, there is one extra fan 8*f* to stop the flying ring 5. As shown in FIG. 5B, the wind chain 11*c* is to block the flying ring 19. The extra fan 8*f* is to block the flying ring 5. As shown in FIG. 4D, the blocked ring 5 falls on the back of the scull 9 and the scull 9 is a hook to hang the ring 5. Furthermore, on the YuanShi (原筮) 10, all the extra fan 8*f* is broken and disappeared. The extra fan 8*f* was under the repeated impact of the jade ring 5 in FIG. 3A-1 that all the fans 8*f* on the YuanShi (原筮) 10 were broken due to the material fatigue. It proves that the YuanShi (原筮) 10 is the ring hanger to be the target of the flying ring 5 of SanXing golf.

So, from the above discussions, we get the conclusion that we have found the clue for the golfring sport in the SanXing heritage. However, to have the versatile type golf in the GolfDisney world, we need to include all the different kinds of golf sports.

Figure 6A:
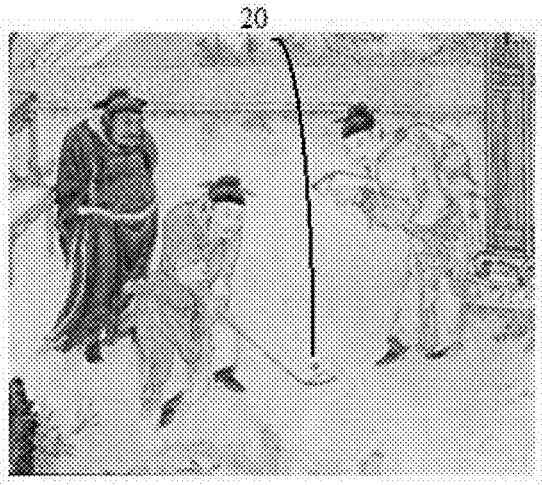
FIG. 6 (A) is the 1000 years ago ancient China golf drawing which shows the golfball sport is actually originated from the Orient; (B) is the 1000 years ago ancient China lady golf drawing which shows the lady golf sport is actually originated from the Orient.
Figure 6B:
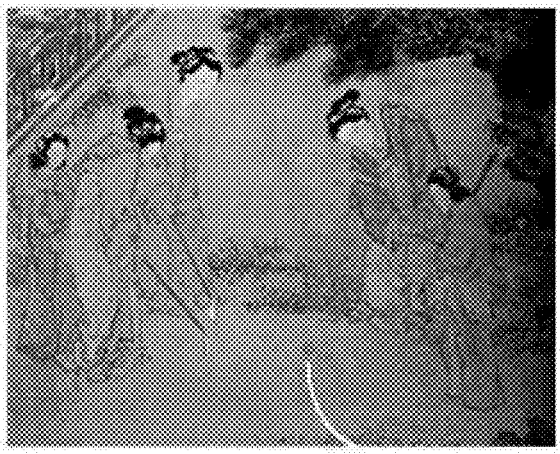
Figure 7A:
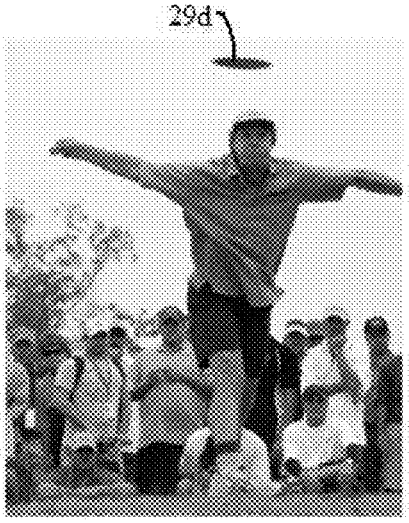
FIG. 7 is the modern Disc Golf; (A) is the long drive of hand-thrown disc golf; (B) is the putting of hand-thrown disc golf. They show even today the US still doesn't have the club-swiveling disc golf technology.
Figure 7B:
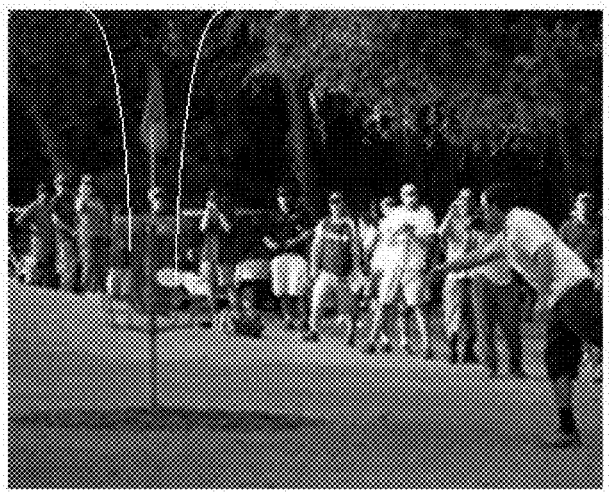

For the classic golf ball sport, today almost all the people in the world believe that the modern golf was originated from Scotland. However, this is not true. As shown in FIG. 6A, it is the golf sport drawing in Ming Dynasty of China 1000 years ago. As shown in FIG. 6B, it is the lady golf in Ming Dynasty of China 1000 years ago. At that time, the golf sport in Scotland didn't start yet. The golfball sport disappeared from China due to the Mongolia and Mandarin barbarian. In Qing Dynasty of China, the golf sport completely disappeared in China. Today, even Chinese in China thinks that the golf is originated form Scotland. The barbarians and wars in China had completely destroyed the oriental civilization several times. So, the golf technology is completely lost. Today golf technology is much lag behind the ancient golf technology 5000 years ago. Due to the technology barrier of the swiveling club launching flying disc, as shown in FIG. 7A and FIG. 7B, today modern disc/ring golf sport in US, the new generation still plays disc with the hand throwing flying disc. There is no other choice for the poor US disc golfer. It is similar to the golfer play the golf with the hand-thrown stone, the disc golfer play the disc golf with the hand-thrown disc. However, in the ancient oriental Asia 5000 years ago, the people already could fly the'ring with the club swiveling. It is the human civilization tragedy.

With our developing effort, the disc golf technology has made the breakthrough. As shown in FIG. 8A and FIG. 20C, it is the Triple Star golf set being constituted of the golf ring, golfdisc and ringball golf club. As shown in FIG. 8B and FIG. 20A, it is the complete product line of the Triple Star golf which includes the golfball, golfdisc and golfring to be one golf family. As shown in FIG. 8C, using the ringball golf club 4, the ringball golfer shoots the ring toward the golf basket. Even the fast flying ring cannot be seen, however, the shadow 19*w* on the ground shows the flying ring going to hit on the wind chain. As shown in FIG. 8D, with the same ringball golf club 4, the ringball golfer putts the golf ball into the hole 21. As shown in FIG. 21A, the golfball is hit to fly into the slot 119 then drops into the hole 21*h*. We emphasize using the same ringball golf club 4 is to eliminate the difference and mutual-repellence between the golf and disc golf.

Why is the golf disc is more popular than the golf ring? Today most disc golf courses are the abandoned portion of the park. There are a lot of trees and strong wind. The light ring 9 will hang on the tree and the wind will have a lot impact on the performance of light ring. The heavy disc 9*d* will not hang on the tree and the performance can be kept the same in the strong wind. So, the ringball golf has to be the RingDiscBall golf, RDB golf, to include the disc. In ancient SanXingDui golf, the ring is made of the jade. It is heavy. It doesn't have the wind problem. Today, for the safety purpose, the ring is made of the polycarbonate and soft rubber. It is light. It has the wind problem. So, we increase the weight and reduce the radius of the ring to be disc. Furthermore, the disc is compatible with the disc golf. It is easy for the disc golfer to accept the golfdisc than the golfing. As shown in FIG. 20C, the RDB RingDiscBall golf is the most complete golf. The golfring is for the long drive; the golfdisc is for the medium drive and putting. For the place having the tree-hanging problem, it uses the golfdisc. For the golf course, it uses the golfring.

The disc golf is the most relative sport to the ringball golf. The disc golfer has the tendency to repel the ringball golf. The disc golfer has forgotten how the golf repelled the disc golf before. The disc golfer adopts the same aptitude toward the ringball golf. Of course, the aptitude of the golf course is much worse than the disc golf course.

Figures 1, 9A:
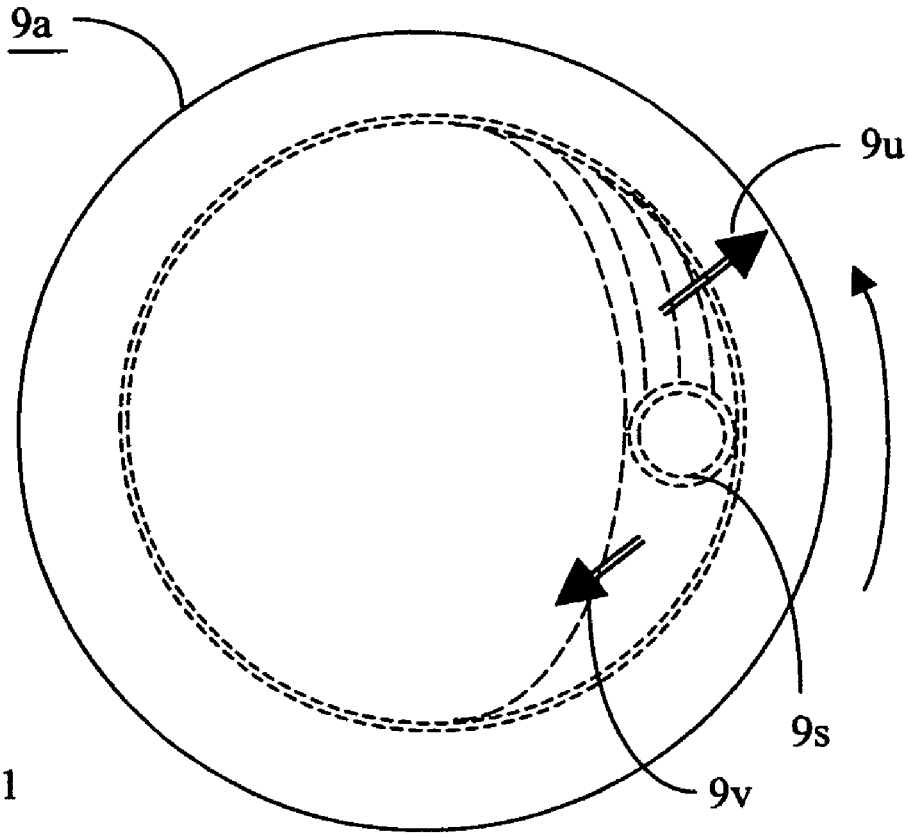
Figures 2, 9A:
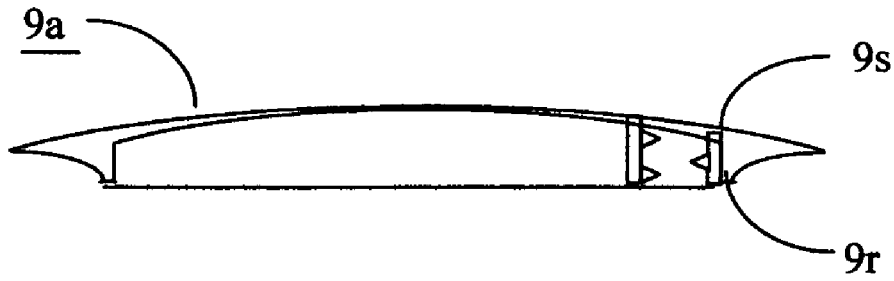

Anyway, we try to make the friends with the other kinds of golf. As shown in FIG. 9, we try to apply the ringball golf technology to the disc golf. A GolfDiscney apparatus comprises golfing sports. The golfing sport comprises a golfing club and a flying disc. The golfing sports have adaptors to mount the flying disc on the head of golfing club. Swiveling the golfing club, the flying disc rotates and takes off from the head flying toward a target. As shown in FIGS. 9A-1 and FIGS. 9A-2, the core technology of ringball golf is applied to the disc of the disc golf. The screw 9*s* is at the edge of disc 9*a*. There is no space between the rim 9*r* and the screw 9*s*. As the disc 9*a* rotates, at the front region, there is a high pressure region and have the up lift force as shown by the arrow 9*u*; at the rear region, there is a vacuum or low pressure region and have the downward force as shown by the arrow 9*v*. It builds up a torque and rotational momentum around the disc 9*a* itself. So, as the disk 9*a* flies in the sky, the disk 9*a* rotates, turns over and falls to the ground. Due to the disc 9*a* being swiveled by the stick, the rotation speed of the disc 9*a* is much higher than the rotational speed of the disc which is thrown by the hand. As we throw the disc 9*a* with hand, the disc 9*a* can fly horizontally. However, as we throw the disc 9*a* with the ringball golf club 4, due to the much higher rotational speed of the disc 9*a*, the disc 9*a* will turnover and fall to ground. It is especially worse for the left side blowing wind. So, to apply the core technology of the ringball golf to the disc 9*a* of the disc golf, we must not induce the disturbance of the air pressure distribution of the disc 9*a*.

Figures 1, 9B:
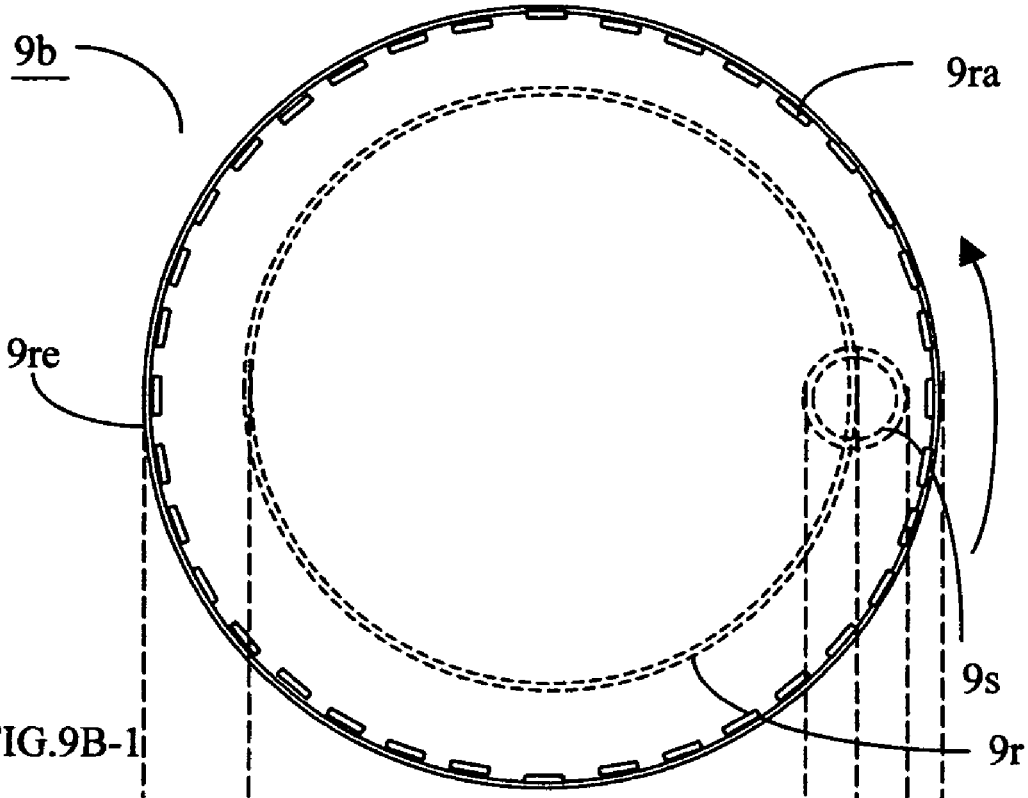
Figures 2, 9B:
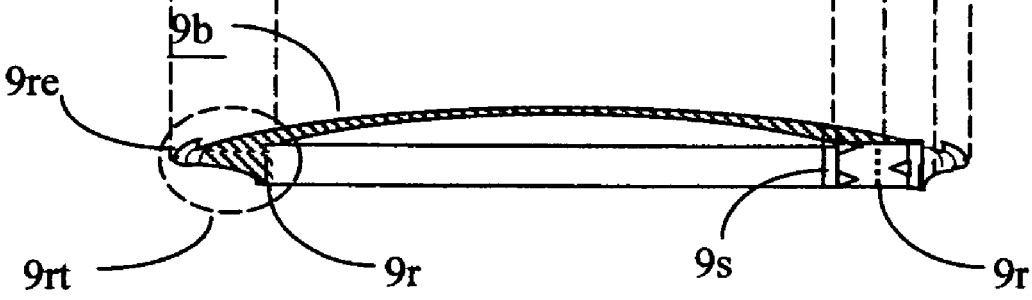

As shown in FIG. 9B1, FIG. 9B2 and FIG. 20B, the GolfDiscney apparatus has the flying disc 9*b* comprising an annular rim and a central section joined together by an annular shoulder. The rim has a lower edge defining a lower plane of said disc. The central section has an upper zone defining an upper plane of the disc. The rim has a substantially equilateral triangular cross-section with a lower rounded corner forming the lower edge. An outer rounded corner and an upper corner merges with the shoulder with the outer corner located between the upper and lower planes. The shoulder decreases in thickness from the rim to the central section with the thickness of the shoulder at the rim in the order of twice the thickness of the central section. The outer surface of the disc from the rim outer corner to the central section has a continuous smooth curved lifting surface. The upper surface of the central section is substantially flat when the disc is stationery. The central section is sufficiently thin and flexible to dome upwards when in flight. As shown in FIGS. 9B-1 and FIGS. 9B-2, the screw 9*s* is embedded in the thick rim 9*rt*. The inner edge 9*r* of the disk is in vertical straight line. The rim 9*rt* is enveloped with the top curve, bottom curve and the inner edge 9*r*. Half the circle of the screw 9*s* is outside the inner edge 9*r* and half the circle of the screw 9*s* is inside the inner edge 9*r*. There is no dead zone to entrain the air to build up the high air pressure. Furthermore, the disc 9*b* has the super-soft rim to have the air-passage 9*ra* design to be the safety buffer. The disc 9*b* has the tiny triangle edge 9*re* to be the stability fin along the rim on the top surface of the disc to be super-thin design.

Figure 20B:
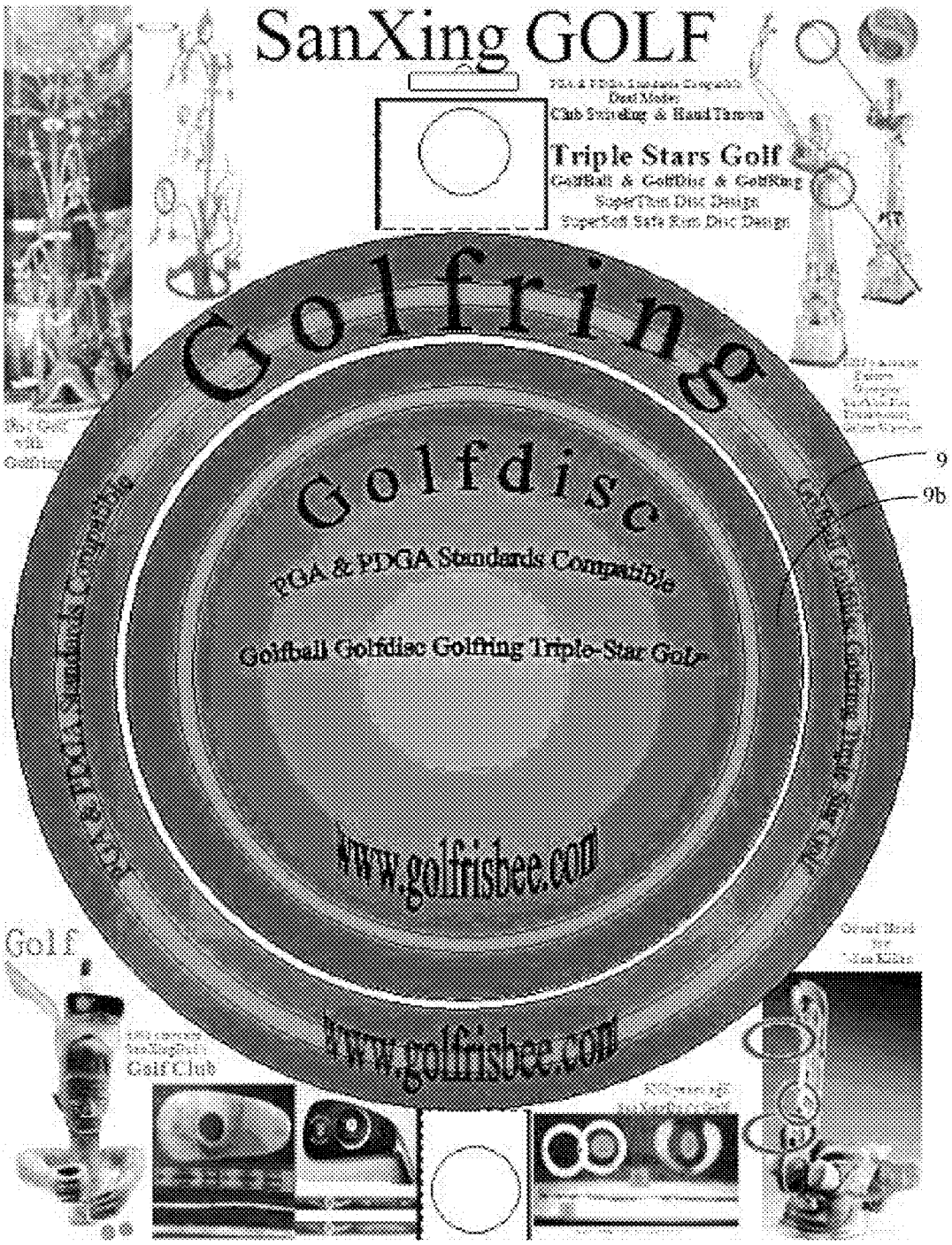
Figure 20C:
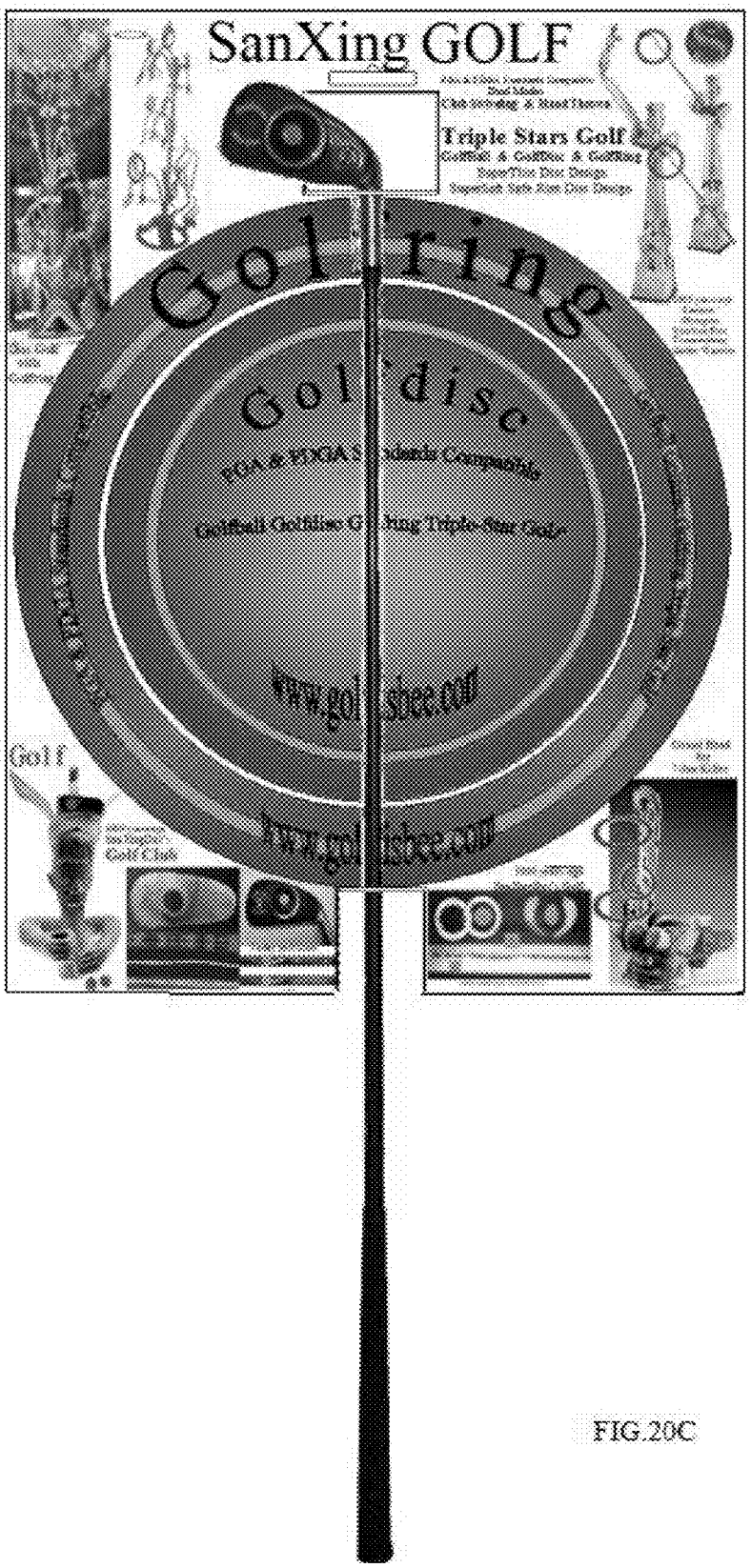

As shown in FIG. 9B2 and FIG. 20B, the GolfDiscney apparatus has the annular rim of the flying disc further comprises a separator lip 9*re* on an upper surface and located on or near the outer rounded corner. The separator lip 9*re* extends to a narrow peak which is higher than the immediately adjacent portion of said upper surface. Furthermore, the flying disc 9*b* has an option to add the air slot between the upper surface and the separator lip to have the bumper effect to reduce impacting force.

There is one famous rule, to have stable flight, the vertical height of the disc must be larger than 1/20 of the horizontal width. However, the larger the vertical dimension, the more drag on the disc that the flying distance is reduced. To have stable flight and longer flying distance, the stability fin 9*re* is applied to the rim of the disc that the vertical dimension of the disc can be reduced. The stability fin 9*re* is core technology of the super-thin disc design. The disc has the thick rim in the triangle segment 9*rt* that the most mass and weight is along the rim of the disc. So, the disc still can be considered to be a ring design. The three technologies (1) stability fin 9*re*; (2) triangle thick rim; and (3) buffer with air pass, make the super-thin disc to be realizable.

Figures 1, 9C:
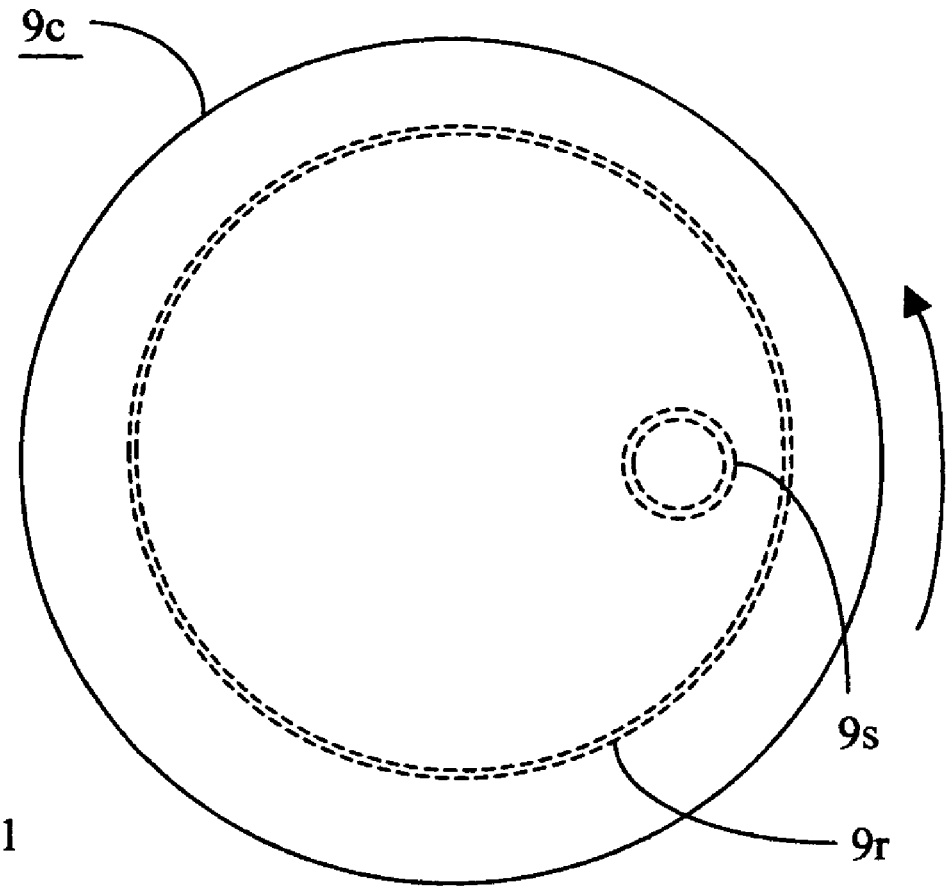
Figures 2, 9C:
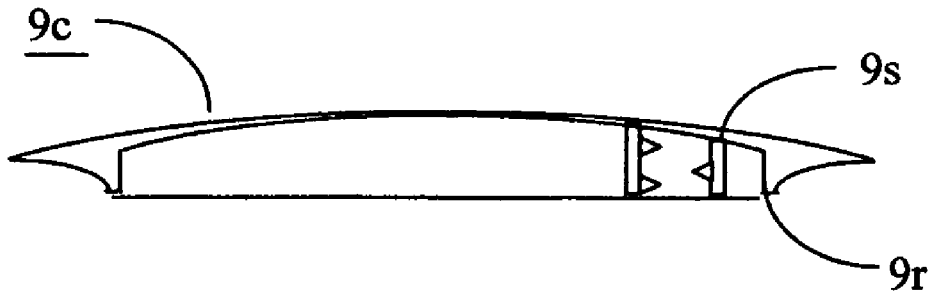

As shown in FIGS. 9C-1 and FIGS. 9C-2, the screw 9*s* is located in the interior position between the center and the peripheral of the disc 9*c*. There is the bypass path that the airflow disturbance is minimized. The disc 9*c* can fly horizontally in the sky for a long distance.

Figures 1, 9D:
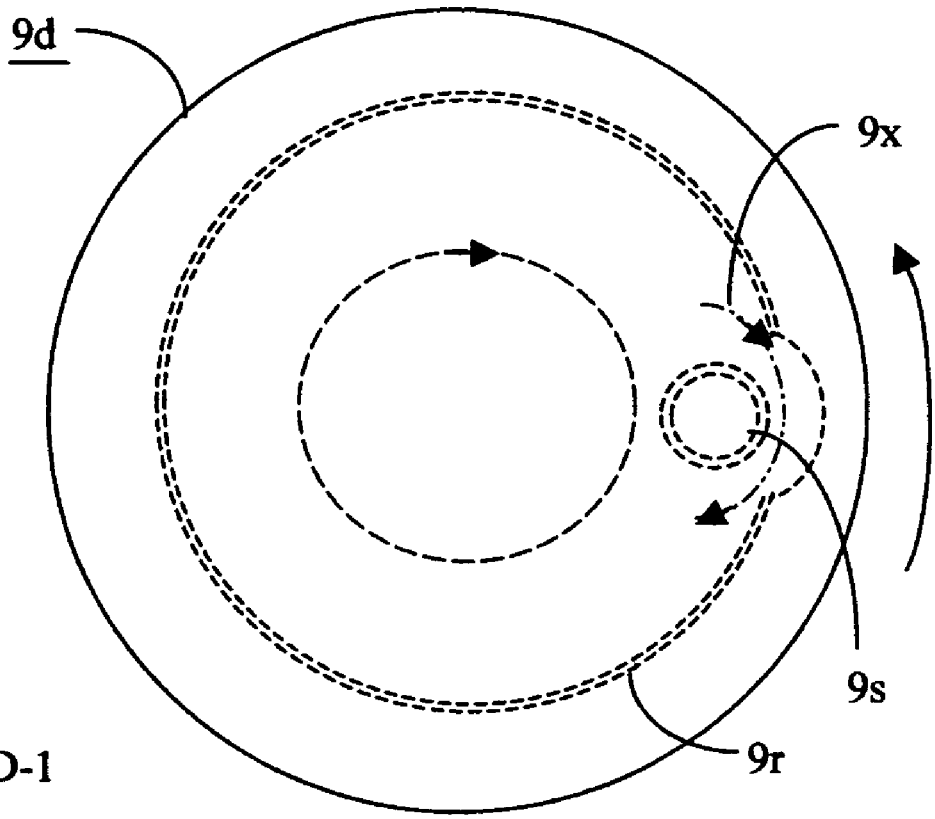
Figures 2, 9D:
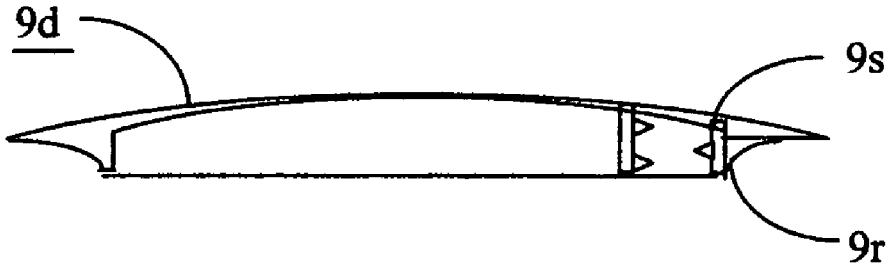

As shown in FIGS. 9D-1 and FIGS. 9D-2, the screw 9*s* is located at the peripheral of the disc 9*d*. Portion of the rim has been removed. The air 9*x* in the front portion can leak outside that the air pressure will not build up as the disk in FIG. 9A does. At the rear portion, the air 9*x* can flow in that the air pressure will not drop, either. There is the exchange air path that the air pressure disturbance is minimized. The disc 9*d* can fly horizontally in the sky for a long distance. The sidewall of the screw 9*s* serves as the stability fin as the rim 9*r* does. It has the duplicated stability function of the sidewall 9*s* and rim 9*r* at the peripheral of the screw 9*s*. So it can eliminate the portion of the rim 9*r* near the screw 9*s*. There is a bypass path for the airflow that the local pressure will not build up to generate the torque to turnover the disc 9*d* in the sky. The rotation of disc 9*d* is high speed that the flow inside and beneath the disc 9*d* is high-speed, too. As shown in FIG. 9D-1, the high-speed bypass airflow 9*f* is similar to a windshield to block the external air flow to flow into the sealed region.

Figures 1, 9E:
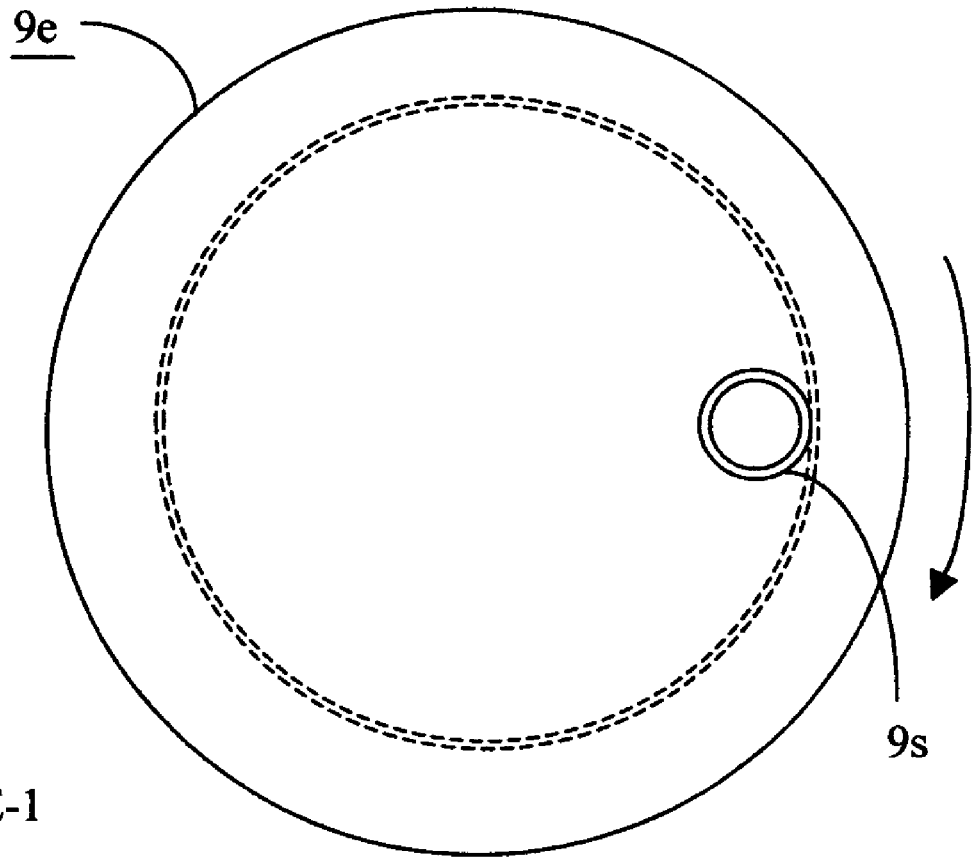
Figures 2, 9E:
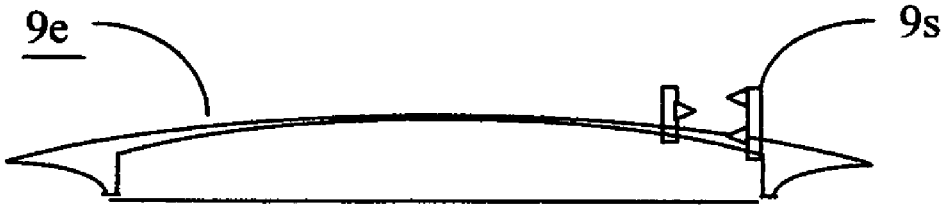

As shown in FIGS. 9E-1 and FIGS. 9E-2, the screw 9*s* is located at the top of the disc 9*e*. This is completely open space on the top of the disc 9*e*. For the open space, the disturbance of air pressure distribution is minimized that there is no torque force on the disc 9*e* to turnover the disc. The throw of the disc can be kept to be horizontal. However, the throw direction will be reversed. If the original throw is right hand throw, the screw at the top will be left hand throw.

Figures 1, 9F:
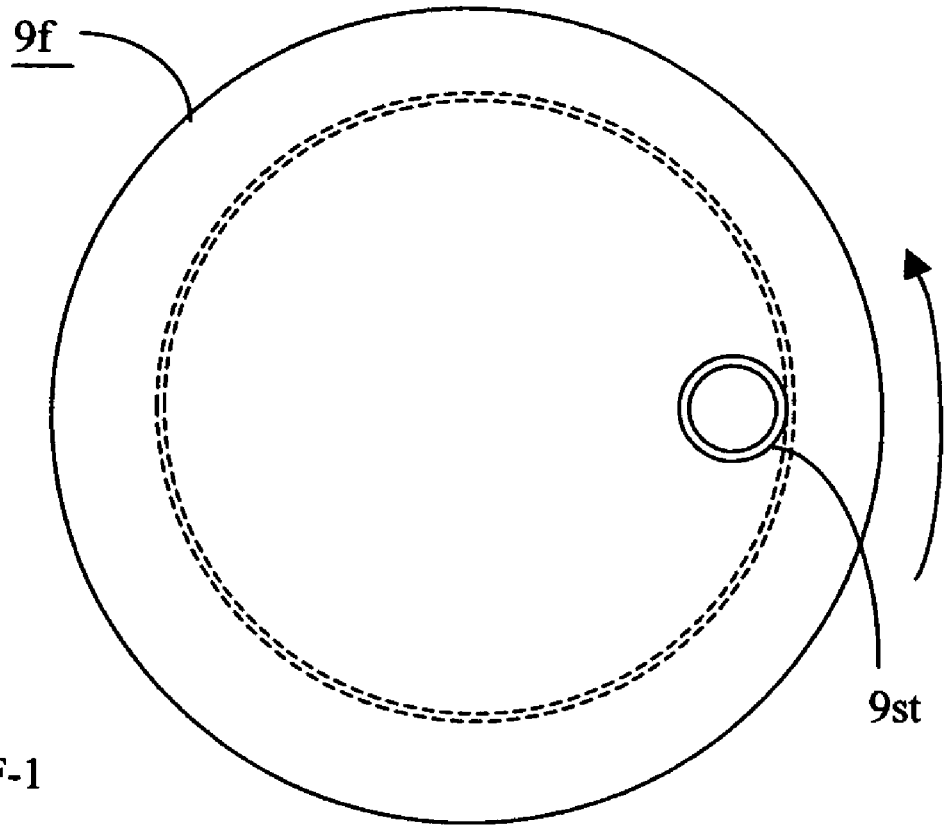
Figures 2, 9F:
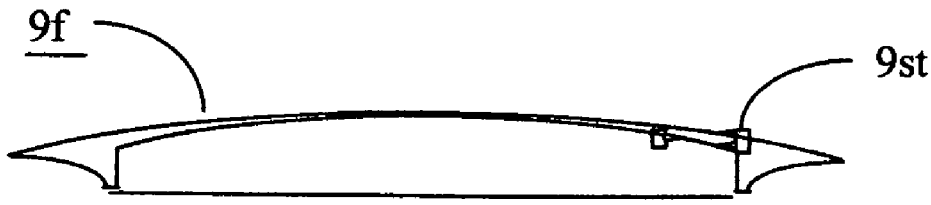

The best alignment is the fine screw 9*st* that the screw 9*st* can be embedded in the frame of disc 9*f* as shown in FIG. 9F-1 and FIGS. 9F-2. The airflow and air pressure distribution of disc 9*f* is the same as disc of disc golf. So, it can be thrown as horizontally as the disc golf does.

Figures 1, 9G:
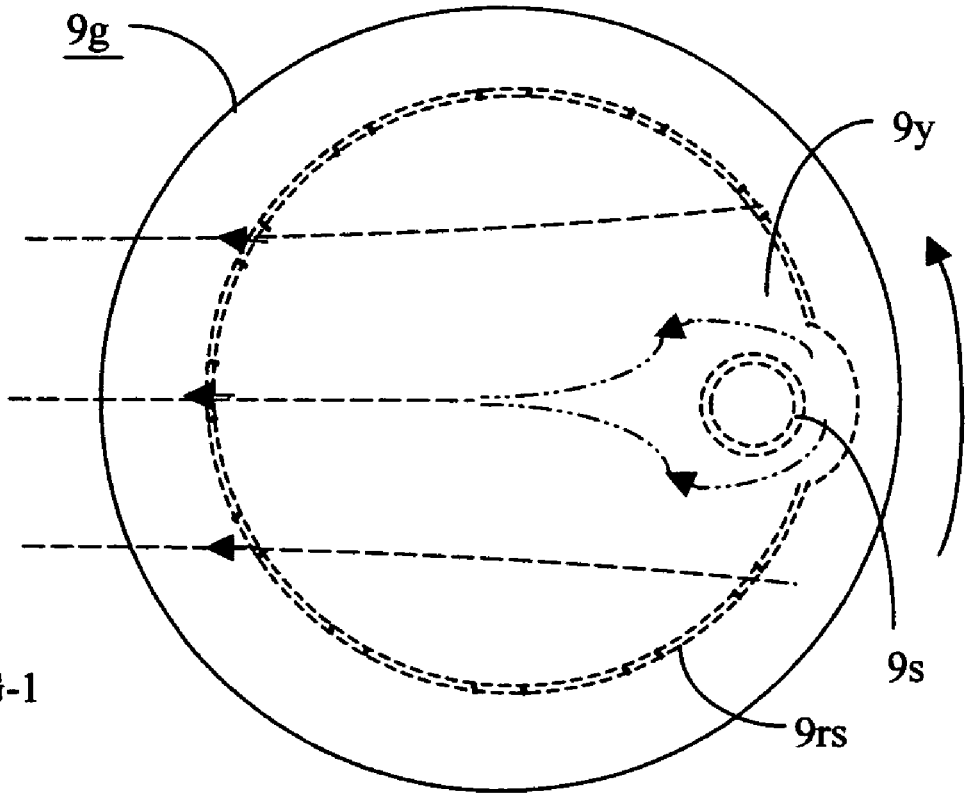
Figures 2, 9G:
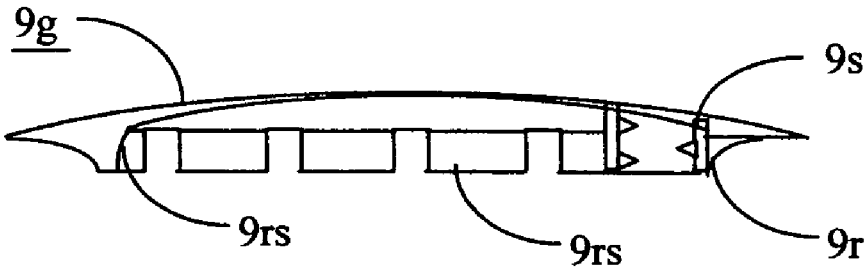
Figures 1, 9H:
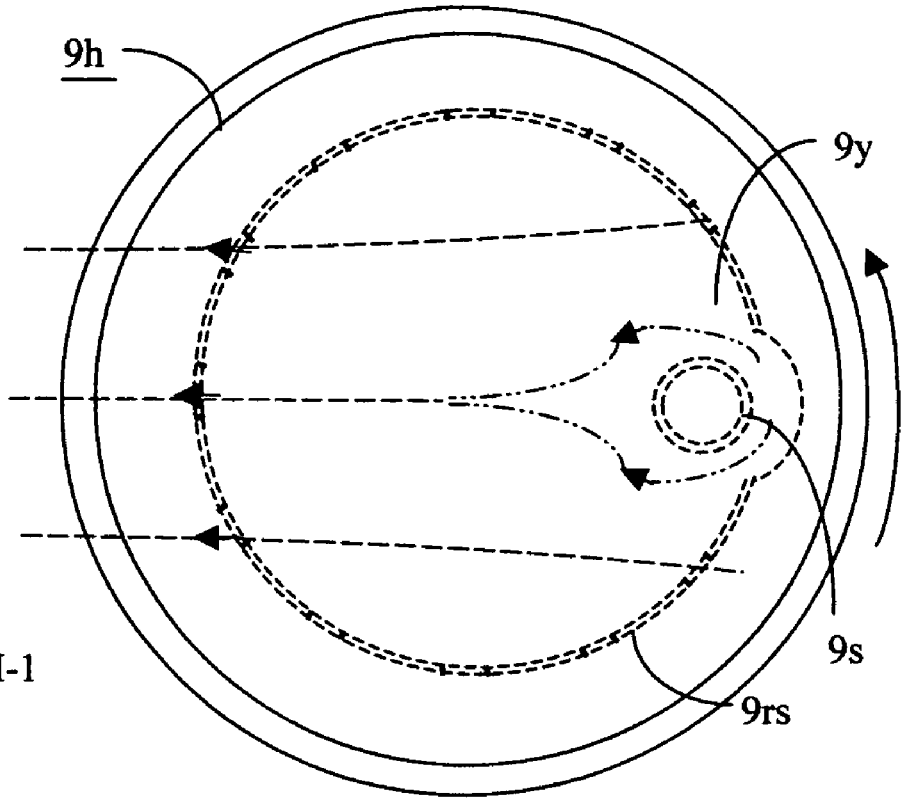
Figures 2, 9H:
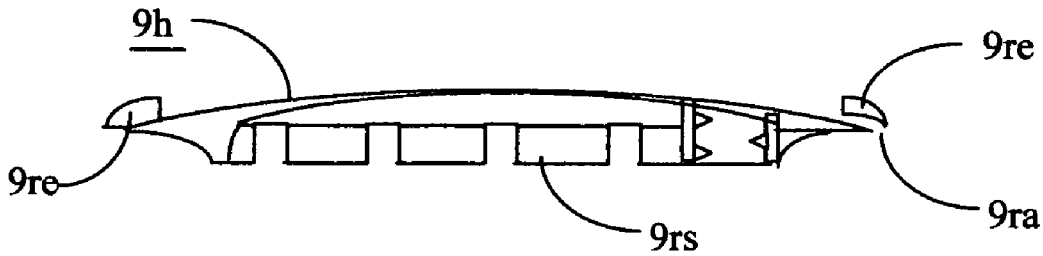

To minimize the airflow resistance, as shown FIGS. 9G-1 and FIGS. 9G-2, the rim is in segments. The air will flow through the slots between the rim segments to flow underneath the disk 9*g*. To minimize the resistance, as shown in FIGS. 9G-2, the interior wall 9*rs* is in the curved downward shape. To increase the safety and super-thin design, as shown in FIG. 9H-1 and FIG. 9H-2, there is a raising edge 9*re* and the air-path 9*ra*. It is the combinatory design of the technologies in FIG. 9B and FIG. 9G.

To increase the flying distance, the tighter the grasping force of the screw 9*s* of the golf club head is, the farther the disc/ring flying distance is. A GolfDiscney golfing sports comprising golfing club and flying disc. There is a plurality of adaptors to mount the flying disc on the head of golfing club. Swiveling the golfing club, the flying disc rotates and takes off from the head flying toward target. To increase the flying distance, the plurality of adaptors is made of the resilient material covering on the hard structure to increase holding force to increase flying distance of the flying disc.

Figures 1, 10A:
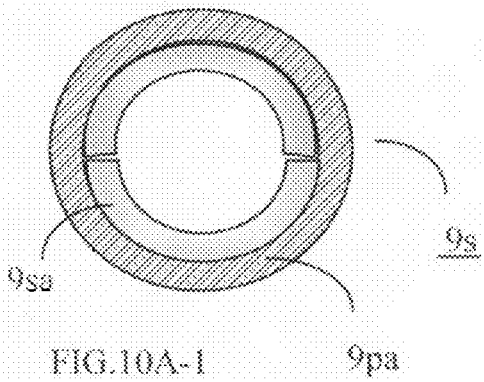
Figures 2, 10A:
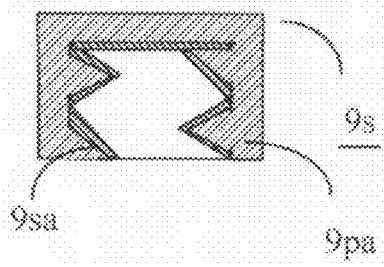
Figures 1, 10B:
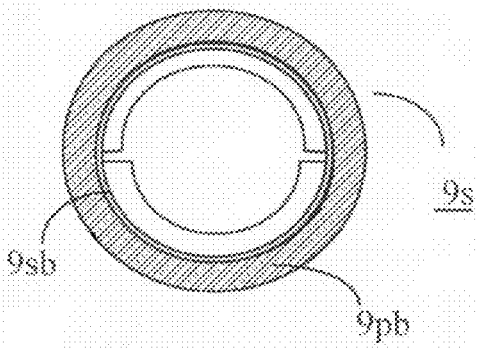
Figures 2, 10B:
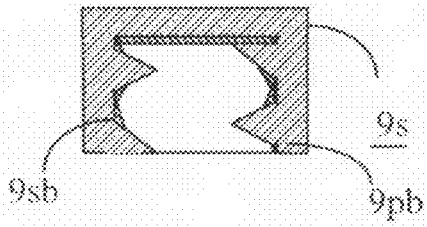
Figures 1, 10C:
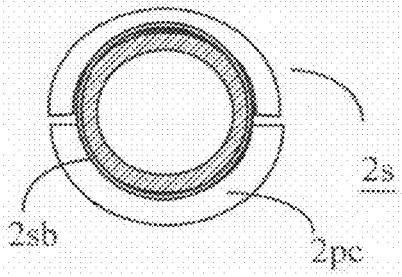
Figures 2, 10C:
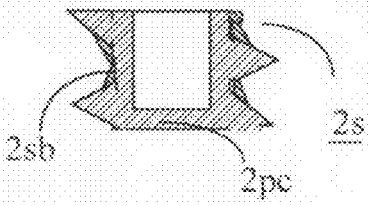
Figures 1, 10D:
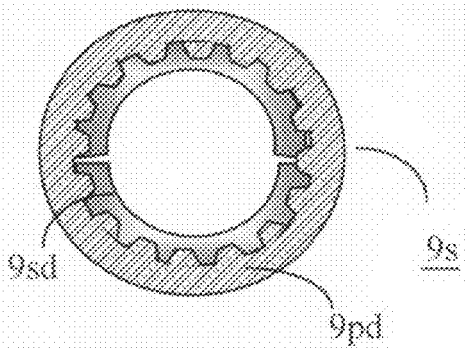
Figures 2, 10D:
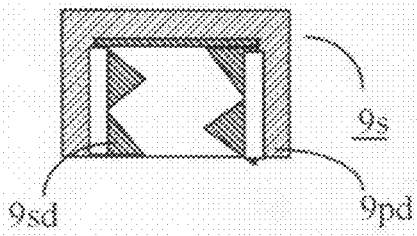
Figures 1, 10E:
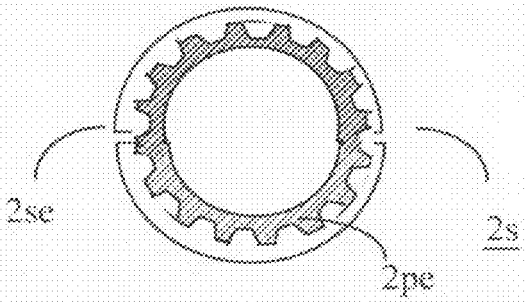
Figures 2, 10E:
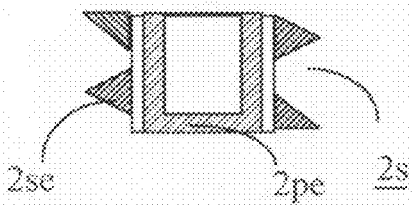

As shown in FIGS. 10A-1 and FIGS. 10A-2, to increase the distance, the screw 9*s* is made of the rubber 9*sa* and the solid frame 9*pa*. The rubber 9*sa* covers on the screw 9*pa*. As shown in FIGS. 10B-1 and FIGS. 10B-2, there is alternative design for the composite screw 9*s*. Only the valley of the screw 9*pb* is filled rubber 9*sb*. The same principle also can be applied to the male screw. As shown in FIG. 10C-1 and FIGS. 10C-2, the screw 2*s* has the rubber 2*sb* being filled at the valley of the screw 2*pc*. As shown in FIGS. 10D-1 and FIGS. 10D-2, it shows the alternative design of the screw 9*s*. The solid frame 9*pd* is in the form of the multiple slots. The rubber screw 9*sd* is covered over the slot 9*pd*. FIG. 10D-1 and FIG. 10D-2 are for the female screw. The same principle can be applied to the male screw, too. As shown in FIGS. 10E-1 and FIGS. 10E-2, it shows the alternative design of the screw 2*s*. The solid frame 2*pe* is in the form of the multiple slots. The rubber screw 2*se* is covered over the slot 2*pe*.

Figure 11A:
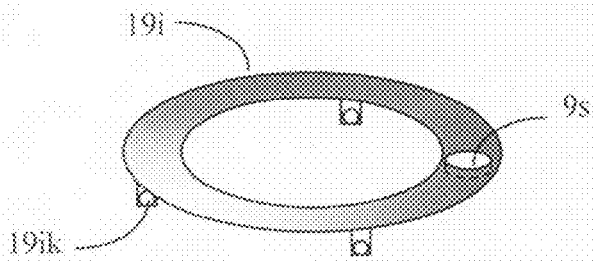
Figure 11B:
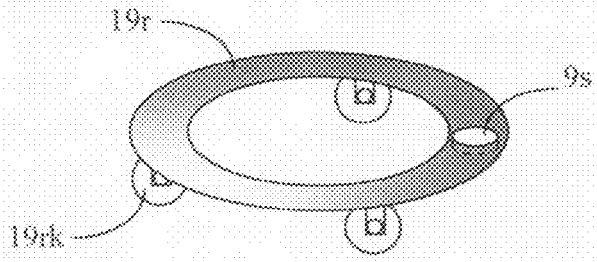

The ring golf sport can be enhanced to be the ice sport to be the Ice Ring Hockey sport. As shown in FIG. 11A, under the ring 19*i*, there are three universal ice knives 19*ik* are mounted. The ring 19*i* either can fly with the swivel of club or putt it to slide on the ice. FIG. 11B is the Ring Hockey. Under the ring 19*r*, there are three universal roller 19*rk* are mounted. The ring 19*r* either can fly with the swivel of club or putt it to slide. FIG. 12 is the head cutter application of SanXing Golf. The golfring 19*k* has the saw teeth 19*kn*. The golfring 19*k* carries a thin line 19*kt* to fly. As the golfring 19*k* falls on the enemy head, pulling the line 19*kt* to cut the enemy head with the saw teeth 19*kn*. It shows the real application of the golfring on the battlefield. In the dark eve, it can attack and kill the enemy guard with a surprise.

The GolfDiscney not only shows the golfing application in the ancient battlefield but also shows the golfing and golfdisc applications in the today battlefield. A GolfDiscney apparatus has the flying disc to be a grenade. The grenade has timing trigger or wiring trigger to trigger the grenade to explode. The grenade can be triggered to explode by the timing trigger or pulling a wire triggering means for wiring trigger to trigger the grenade to explode. The golfing grenade has no firing smoke and sound. It can fly even higher and farther than the rifle grenade. It is very powerful weapon in the modern battlefield.

FIG. 13 shows the golfing grenades is even much more powerful than the rifle grenades. The golfing grenade 19*t* drags a thin line 19*kt* to fly toward the helicopter 31. As the blades 31*b* of the helicopter 31 hits on the thin line 19*kt*, the thin line 19*kt* will pull the trigger of the golfring grenade 19*t* to explode. The broken pieces of the golfing grenade 19*t* will shoot down the helicopter 31. On the ground battle, the golfring grenade and golfdisc grenade will explode with hit or timing explosion to kill the ground enemy directly.

In the 5000 years ago, the Ancient Orient Golfer practiced the multiple different golf techniques to protect the civilization. They have the Eastern Olympics, YanYun. The SanXing Golf is the main topic sports of the Eastern Olympics, YanYun. The Olympic topic sports are the 3-steel sports: Shot Put (鉛球), Discus (鐵餅) and Javelin (標槍). They are the western national defense sports. Being similar to the Olympic 3-steel sport, the SanXingDui heritage golf sport also has three different kinds of national defense golf sports.

A GolfDiscney apparatus comprises golfing sports. The golfing sports comprising golfing club, flying disc and golfing ball. On one side of the head of golfing club having a adaptor to mount the flying disc. Another side of the head can be used to hit said golfing ball to roll or fly.

As shown in FIG. 15, FIG. 16 and FIG. 17, the three national defense golf sports are named as YanYun-3Yuan (炎運三元) sports. The YanYun 3Yuan is Yuan-Shih (原筮中原) (FIG. 15), GolFu/GolfShang (高夫高尚) (FIG. 16) and 7-Sun/Cutting Head (七日匕首) (FIG. 17). Comparing with the record in the Ancient Orient book Shih-Jing, the GolFu/GolfShang is small ball; 7-Sun/Cutting Head is for big ball and big ring; the Yuan-Shih is for small ring and big ring.

Figure 23C:
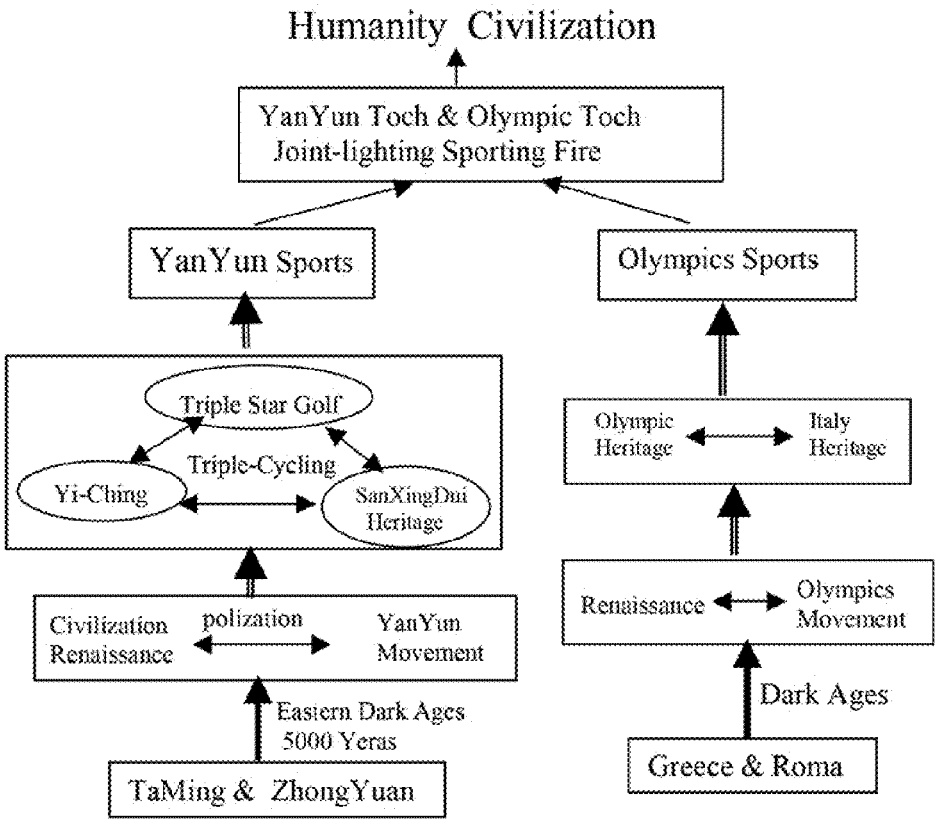
Figure 23D:
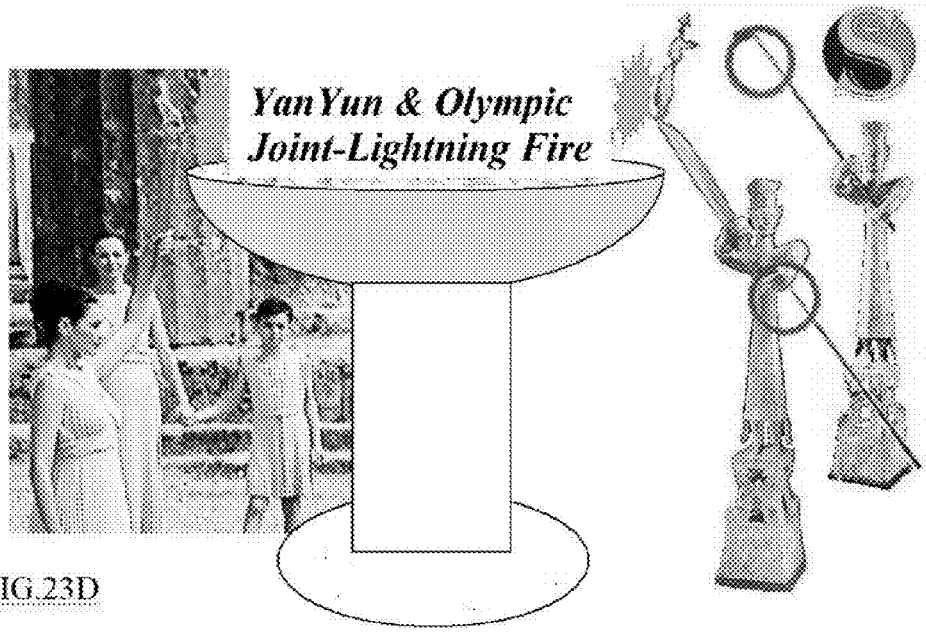

As shown in FIG. 23D, the GolfDiscney apparatus comprises Olympic style fire station. GolfDisney is to reproduce the original golfer spirit in the YanYun 5000 years ago. As the travelers arrives the GolfDisney, there are five stops for the travelers to visit. At beginning, the golfer team leads the travelers to the GolfDisney as shown in FIG. 24A, then the Olympic torch and the YanYun torchlight the fire together as shown in FIG. 23D.

Figures 14A, 14B:
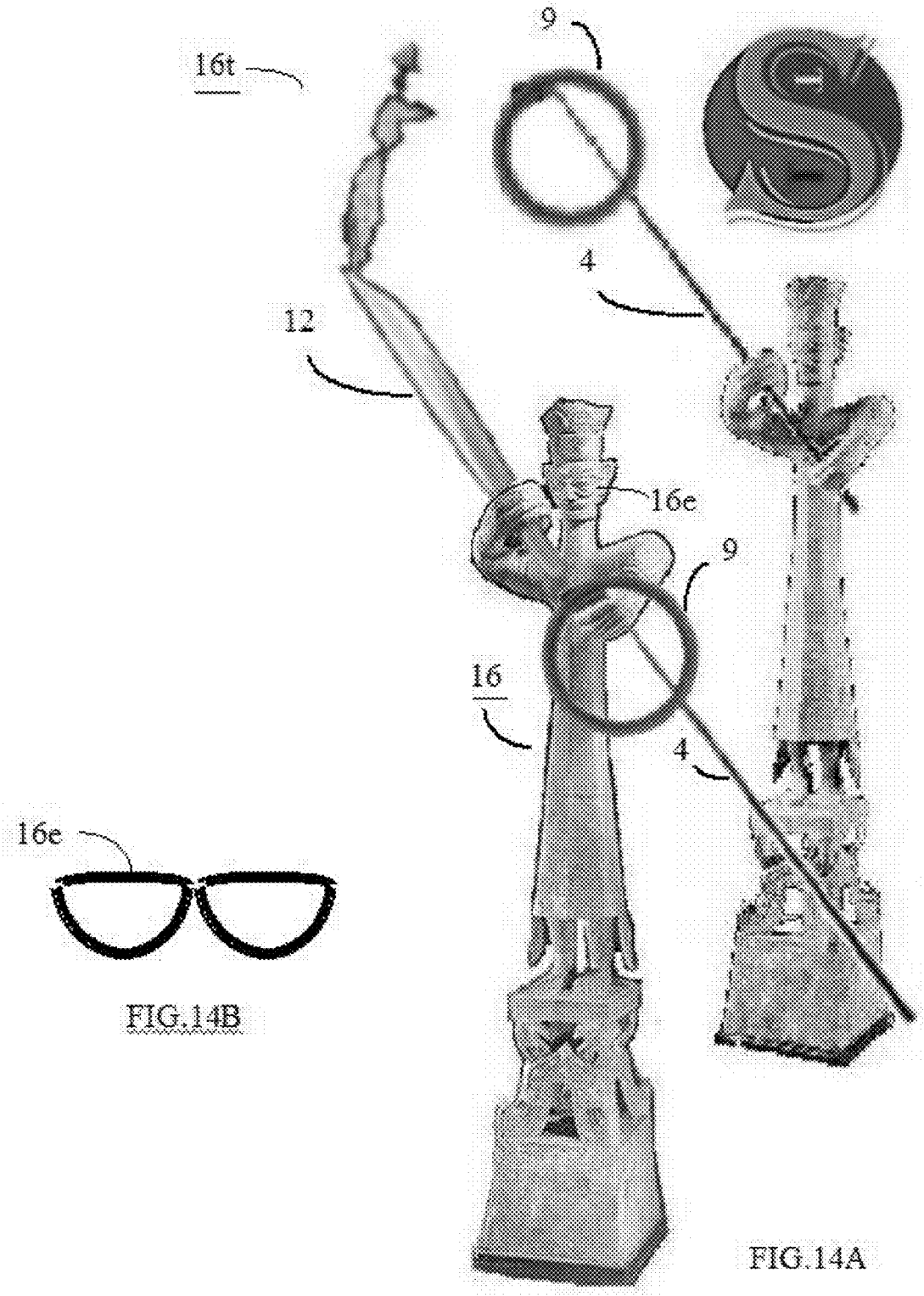

As shown in FIG. 14A, the leading golfer (明火執仗 ZhangRen 丈人) 16 uses the right hands to hold the Eastern Olympic Torch (Yan-Yun Ming-Huo 炎運明火) 12 and the left hand holds the ringball golf club (Zhang 丈，中) 4. The follower golfer (執仗相隨) 16 has two hands to hold the ringball golf club 4. This is the team of the military troop (Zhang-Dui 仗隊) of golfer (ZhangRen 丈人) 16.

A GolfDiscney apparatus further comprises a parade of golfing clubs and torches. As shown in FIG. 14A, in 5000 years ago, the golfer had the eye mask 16*e* as shown in FIG. 14B. SanXingDui heritage has both golden facemask and golden eye mask. It proves the bronze golfer 16 does wear the eye mask 16*e* and other golden mask. However, the eye mask 16*e* is more like the eye mask for the secret mission troops to protect the personal identity in secret mission. It is due to the golfer team was the special mission task force. The golfers needed the eye mask to protect their identities.

However, the South-Silk-Road academic people didn't understand the function of this eye mask 16*e*. All the people guess the golfer (ZhangRen) to be alien. It is the biggest joke in the archaeology. In the SanXingDui heritage, there did have a lot of golden masks. It means that the mission group had the base at SanXingDui. They did have the long-range missions to the North China barbarian. It was the reason that the Chinese barbarian of Zhou Dynasty had the long-range attack on SanXingDui and destroyed SanXingDui. In this long-range attack, the Zhou Dynasty Chinese barbarian got the book of YiChing and the destroyed bronze head which was not buried yet. Recently, the destroyed bronze head was found in the Northern China. It proves that the SanXingDui was destroyed in the Zhou Dynasty Chinese barbarian long-range attack and the YanYun heritage was buried under the SanXingDui ground 3500 years ago.

The eye mask 16*e* is multiple purposes mask. Even in 5000 years ago, the golfer had developed the eye cover to protect the eye and sharp the vision. The golfer plays in the golf yard, you never expect when the golf ball or ring will hit on your eye. There are a lot of tragic stories that the golf ball hits on the eye and the golfer becomes blind. In the GolfDisney Park, the safety is very important. All the traveler is requested to wear the plastic eye cover to protect eyes. The ring ball golf in the GolfDisney adopts the softball and soft ring. There is the soft rubber wrapping around the outside of the golf ball and golf ring. So, even the ball and ring hits on the people, there is no harm. However, it still hurts the people as the ball or ring hits on the eyeball. So, all the travelers and the golfers are requested to wear the plastic protect eye cover as shown in FIG. 14B.

Today's people underestimates the technology 5000 years ago. Actually, the 5000 years ago golf technology was much more advanced than today golf technology. 5000 years ago, the golfer already knew how to throw the disc/ring with the swiveling stick. Until now, the PDGA (Professional Disc Golf Association) still uses the hand to throw the disc or ring. 5000 years ago, the golfer already had the eye protect cover. However, today the golfer still doesn't follow the safety rule to wear the eye protection cover 16*e*.

The 1$^{st}$ stop in the GolfDisney is to take the view of the display of SanXing Golf show. As shown in FIG. 24A, the traveler takes view of the exhibitions of the research results of the Northern Yi-Ching theory about the SanXingDui history, Eastern Olympics-YanYun and Eastern Renaissance with YiChing.

Just like the WALT DISNEY WORLD has the oriental story cartoon movie MULAN, the GolfDisney World has the oriental story cartoon movie SANXING. A GolfDiscney apparatus golfdisc course also can be animated golfdisc course. Furthermore, in the GolfDisney has the motion animation of SanXing characteristic roles.

Then the travelers will go through the timing channel to return to the 5000 years ago for the YanYun venture.

As shown the ancient documentation in FIG. 23A, combining the SanXing heritage, the 3D cartoon movies will show how the SanXing heritage was transferred from the North-East China to the South-West China and finally be buried in the ground of SanXingDui.

As shown in the comparison table in FIG. 23B, this is the tragic history of the Oriental Civilization was destroyed by the Chinese barbarian and how the golfer defended for the oriental Civilization until the last minutes. The Eastern Olympic YanYun torch extinguished in SanXingDui for more than 3500 years.

As shown in FIG. 23, it is the SanXing Golf and Eastern Renaissance & Eastern Olympic. FIG. 23A is the original documents of the Yi-Ching and Shih-Ching about the Eastern Olympics, YanYun. Yi-Ching describes the mission and sports of the YanYun. Shih-Ching describes the grand performance of the YanYun sports. Furthermore, Yi-Ching describes how the YanYun heritage was transferred from Northeast China to the Southwest China through the sea and Yangtze River. In the transferring process, the King of Ming/Emperor of Yan (Ming-King-Yan-Emperor 明王炎帝) killed one barbarian King (縱目) with the 7-Sun, etc.

FIG. 23B is the table for the comparisons between the Western Renaissance, Western Olympic Sports and the Eastern Renaissance, Eastern YanYun Sports. It illustrates how important role of the GolfDisney World in the oriental civilization renaissance.

As shown in FIG. 23, our GolfDisney mission is to promote the Eastern Renaissance and Eastern Olympics. According to our innovative plan, as shown in FIG. 23C, integrating the fragments of the original documents to be an infrastructure, it is our innovation to have the joint civilization effort of the Western Olympic torch and Eastern Olympic Torch. As shown in FIG. 23D, one topic activity in the GolfDisney, the Western Olympic Torch and the Eastern Olympic Torch will light the Sporting Fire together.

The GolfDisney World will create the Eastern Olympic YanYun game, creating the SanXing Game over the topic of war game with the RDB golf weapons of SanXingDui heritage. As shown in FIG. 23D, the Olympic torch and YanYun torch light the fire together to finish the 1$^{st}$ stop activity.

Figure 15A:
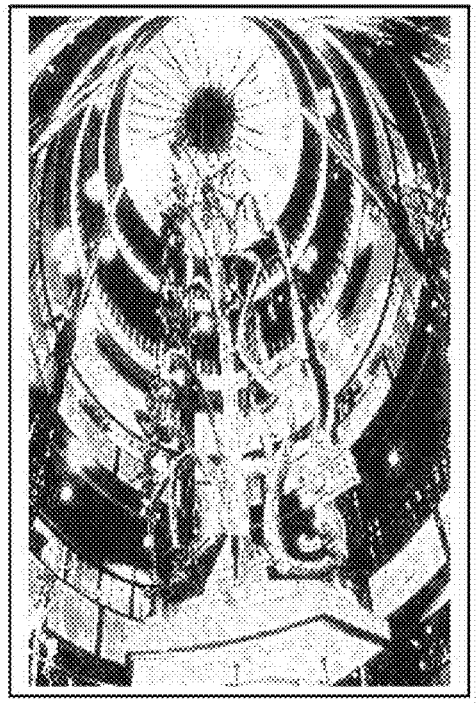
Figure 15B:
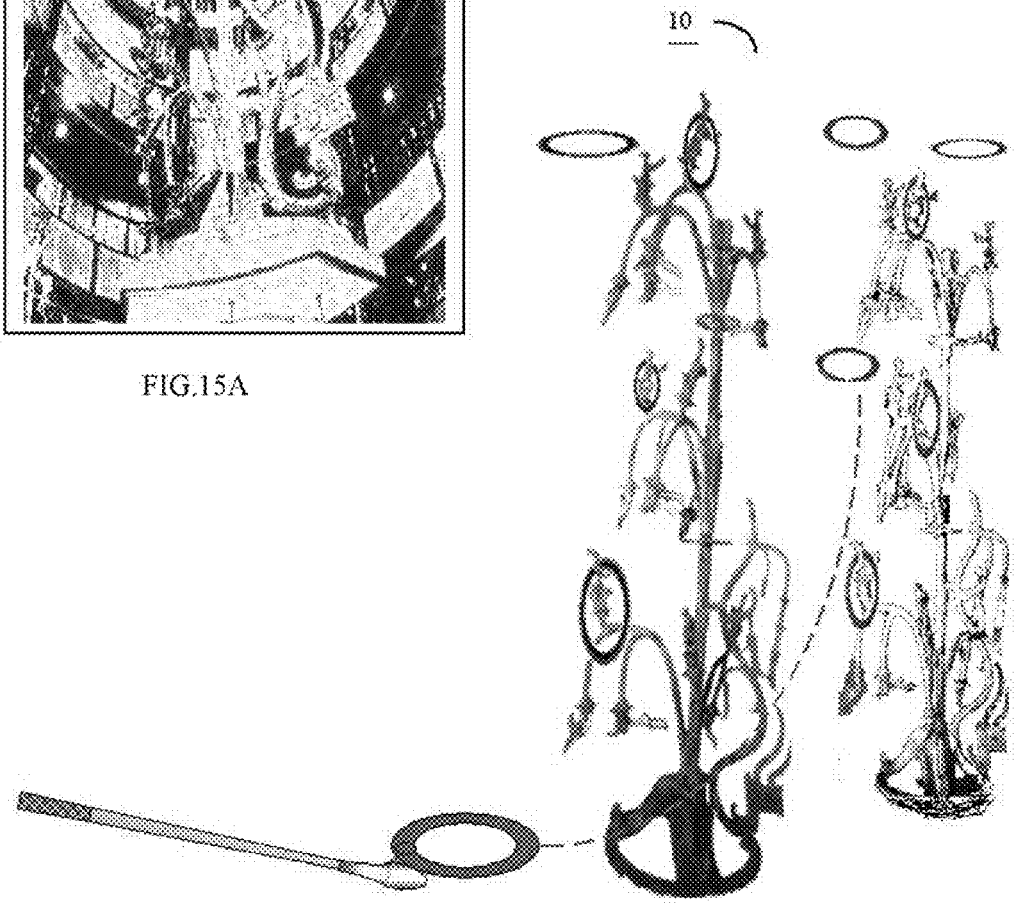

The 2$^{nd}$ stop is the traveler taking practice to shoot the golfring 9 toward the YuanShi as shown in FIG. 15A, FIG. 15B and FIG. 24A. As shown in FIG. 15 and FIG. 24, the traveler tries to swivel the Triple Star golf club to fly the ring to hit the fan on the bird and hang the golfring on the bird shaped hook 8 as shown in FIGS. 4B-3 and FIGS. 4B-4.

As shown in FIG. 5, FIG. 8, FIG. 15 and FIG. 20B, the GolfDiscney apparatus has the means for flying disc being a golfing 9. The golfing 9 comprises a closed-figure airfoil having a planform comprising a central opening, an upper and lower surface. An inner perimeter encompasses the central opening. An outer perimeter encompasses the inner perimeter. An axis of revolution which is substantially normal to the planes described by the inner and outer perimeters. The airfoil has a cross-section comprising a line defining the lower surface and a convex line defining the upper surface. The convex line reaching a zenith which is the highest point on the airfoil section of the golfring 9. A separator lip 9*re* as shown in FIG. 9B2 on the upper surface and located on or near the outer perimeter. The separator lip 9*re* extending to a narrow peak which is higher than the immediately adjacent portion of the upper surface. The golfing has an option to add the air slot between the upper surface and the separator lip 9*re* to have bumper effect to reduce impacting force.

The 3$^{rd}$ Stop is the traveler takes practice to shoot the golf ball 20 toward the GaoFu (丈人高夫, 高夫尚武, 高人高尚) as shown in FIG. 16 and FIG. 24A. The name Golf is originated from the sound of GaoFu.

As shown in FIG. 16, FIG. 17A and FIG. 21, the GolfDiscney apparatus comprises a target which is a slot 17*s* and 119 or hole 18*h*. Hitting on the golfing ball, the golfing ball flying or rolling into the target.

Just like the William Tell (羅賓漢) shot the apple on the head, the golfer shoots the golfball into the slot on the head of GaoFu. The original golf sport is military training to have the practical application in the battlefield. As shown in FIG. 16B and FIG. 24, the traveler swivels the Triple Star golf club trying to shoot the golfball 20 into the mailbox type slot 17*s*. The three plates 17*g* is to mark the position of the entrance slot 17*s* which make the golfer be able to identify the slot entrance 17*s* at a long distance. This ball is the small ball as claimed in the ancient oriental book, Shih-Ching.

Figure 17C:
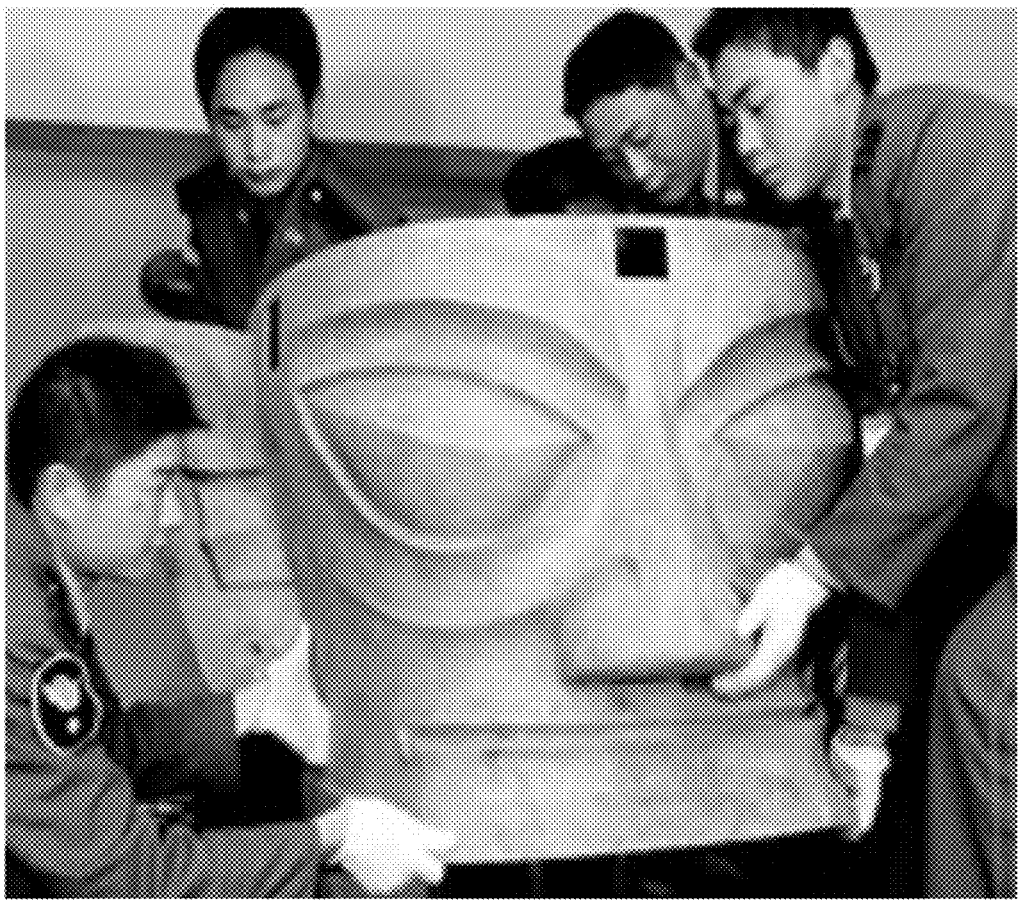

The 4$^{th}$ Stop is the traveler takes practice to shoot the 7-Sun 7 type half-ring 7*r* toward the big-head 18 as shown in FIG. 3A, FIG. 17 and FIG. 24. The traveler swivels the Triple Star golf club to throw the half-ring 7*r* to pass through the hole 18*e* and 19*e* on the temple of the big-head 18 and big head 19. In FIG. 17A, on the front head there is a rectangular hole 18*h*. It is the target for the big ball 20*b*. The golfer swivels the Triple Star golf club to drive the golfball 20*b* to pass through the target hole 18*h*. This ball is the big ball as claimed in the ancient oriental book, Shih-Ching. The big head of SanXing- Dui heritage is really big as shown in FIG. 17C. It is really for the long drive practice of the half-ring boomerang 7-Sun 7*r*.

The 5$^{th}$ Stop is the modern Triple Star golf. As shown in FIG. 16B, the SanXing golf is flying ball, not rolling ball. As shown in FIG. 21A, the new golfing basket has a new way to play the flying ball with golfing club as the ancient SanXing golf does. Now, the golfer has two ways to play golf ball, the rolling ball and the flying ball.

The golfing club is not putting club. It is not designed to putt the ball to roll. Instead of the conventional putting rolling ball, the golfring club is steel club. The ball should be hit to fly with the steel club. To be consistent with steel club, the new slot structure is invented to mount on the pole of the golf basket.

As shown in FIG. 19 and FIG. 21A, the GolfDiscney apparatus comprises a means for target. The target comprises the golfing basket 11 for flying disc and the golfing slot and hole 119 and 21*h* for the golfing ball. The golfing basket 11 and the golfing slot 119 are mounted on the pole 11*p*. The disc flies into the golfing basket. The ball flies into the golfing slot 119 or the ball rolls into the golfing hole 21*h*.

As shown in FIG. 19A, the slot 117 is similar to the GaoShang 17 as shown in FIG. 16. The golf ball 20 flies into the slot opening 117*s*, then drops into the shovel 117*v*. There is a plate 117*p* having slope to lead the ball to roll toward and into the hole 11*h* on the standing pole 11*p* of the ringball basket 11. Inside the pipe 11*p*, the ball falls into the hole 21*h* of the portable hole.

As shown in FIGS. 19B-1, the slot 119 is the alternative design the GaoShang 17 as shown in FIG. 16. FIGS. 19B-2 is the disengagement of the slot 119 as shown in FIG. 19B-1. It uses the junction of the portable basket 11 to build up the slot 119. There are three poles 119*p* on the upper post 11*pu* and three sleeves 119*s* on the lower post Ilpb. The poles 119*p* inserts into the sleeves 119*s*, the slot 119 is automatically formed. There is a movable cylinder cone 119*v*. The golfball 20 shoots into the slot opening 119*s* and hits on the cone 119*v*. The cone 119*v* moves up to absorb the impact force and the golfball 20 is deflected into the concave cavity 119*h* and falls through the pipe 11*pb* of the post 11 and drops into the cavity 21*h* of the portable hole.

FIG. 21 is the portable Triple Star golf basket. It is constituted the wind chain and reverse umbrella with the hooks to hang the ring. Comparing the new basket as shown in FIG. 21A with the old basket as shown in FIG. 8D, there is a slot structure for the flying golf ball. So, in our new golf basket design, we include the flying ball way to play the golf.

As shown in FIG. 8C, FIG. 8D and FIG. 24A, the modern ringball golf track is around the SanXing golf center. At the Ringball #0 green, the traveler swivels the club to throw the flying ring toward the Ringball #1 green. Outside the Ringball #1 green, as shown in FIG. 8C, the traveler swivels the club to throw the ring with the swiveling of ringball golf club 4. On the Ringball #1 green, changes the ring to be ball 20 at the center of the falling ring 9, the traveler either putts the ball to roll into the hole or hits the ball to fly into the slot on the post of the golf basket. As shown in FIG. 8D, the traveler putts the ball into the hole on the Ringball #1 green; as shown in FIG. 21A, the traveler hits the ball to fly into the slot. At the Ringball #1 green, the traveler swivels the club to throw the flying ring toward the Ringball #2 green. Outside the Ringball #2 green, as shown in FIG. 8C, the traveler swivels the club to throw the ring with the swiveling of ringball golf club 4. On the Ringball #2 green, the traveler changes the ring to be ball 20 and put the ball at the center of the falling ring 9. Then as shown in FIG. 8D, the traveler putts the ball into the hole on the Ringball #2 green; or as shown in FIG. 21A, the traveler hits the ball to fly into the slot. This is the end of the practice of golf in GolfDisney.

Figure 24B:
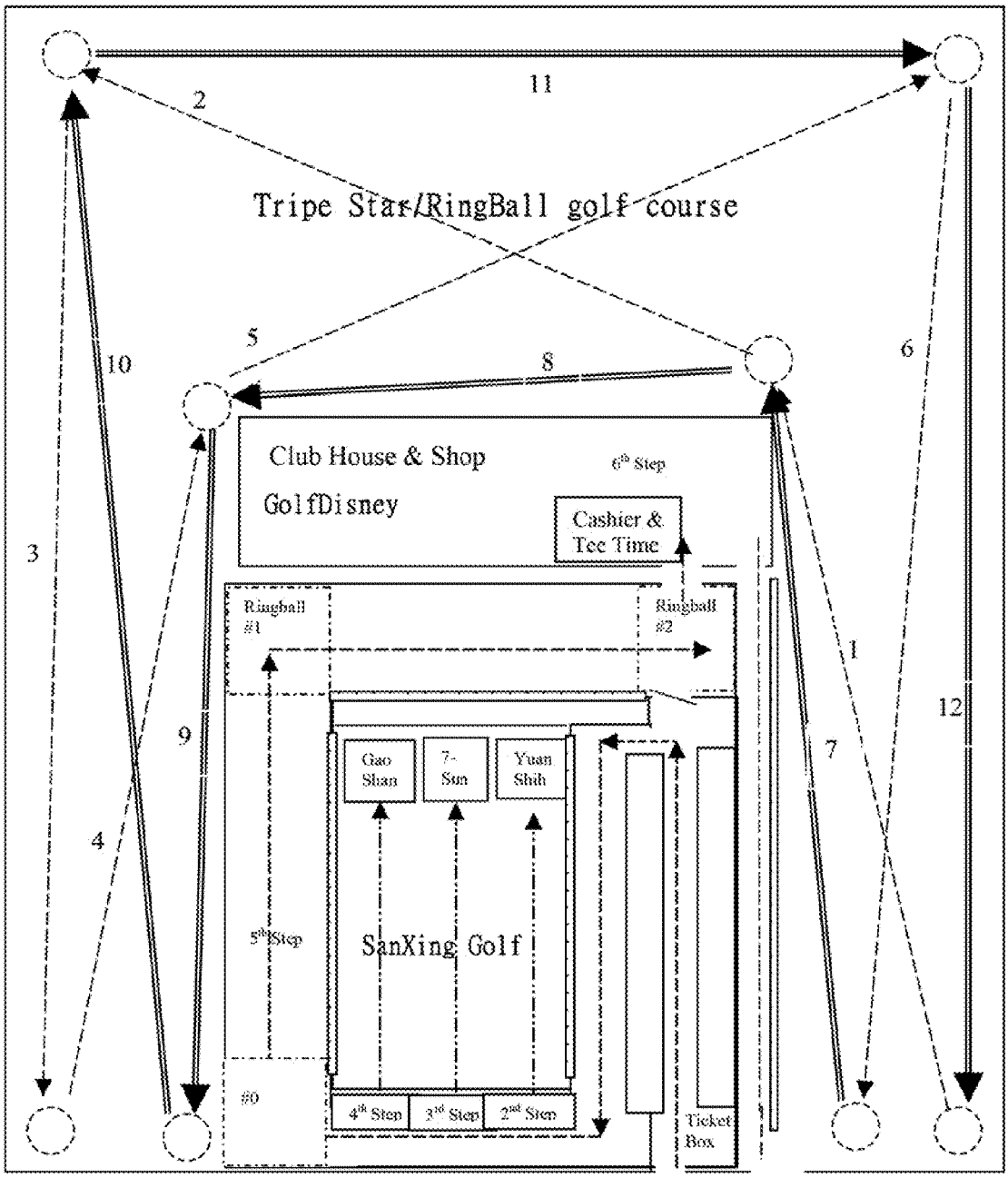

As shown in FIG. 24B, after the customer finishes the practice of versatile golf, he can go into the shop and bar of the GolfDisney. There are the GolfDiney art and products as shown in FIG. 20, FIG. 21 and FIG. 22. They show the special characteristics of the GolfDisney.

FIG. 20A is the package for the Triple Star golf. On the top right corner is the YanYun Torch team. On the top left is the golfing of the SanXing golf. On the bottom left is the golfball of the SanXing golf. On the bottom right corner is the ring type boomerang of the SanXing golf. In the middle is the complete set of Triple Star golf. FIG. 20B shows the golfring and golfdisc being packaged in the package. FIG. 20C shows the golfing, golfdisc and golf club being packed in the package FIG. 21A shows the portable Triple Star golf basket for the golfring, golfdisc and golfball. The golfball can be putt to fly into the slot on the post of the golf basket. FIG. 21B is the disengagement of the portable Triple Star golf basket.

Figure 22A:
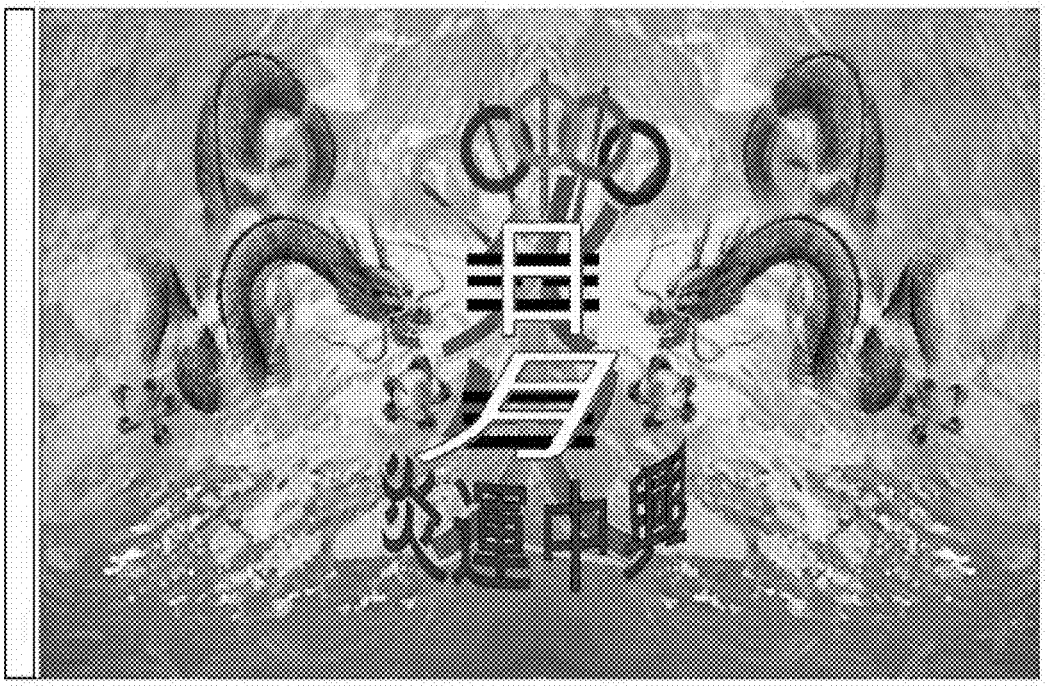
Figure 22B:
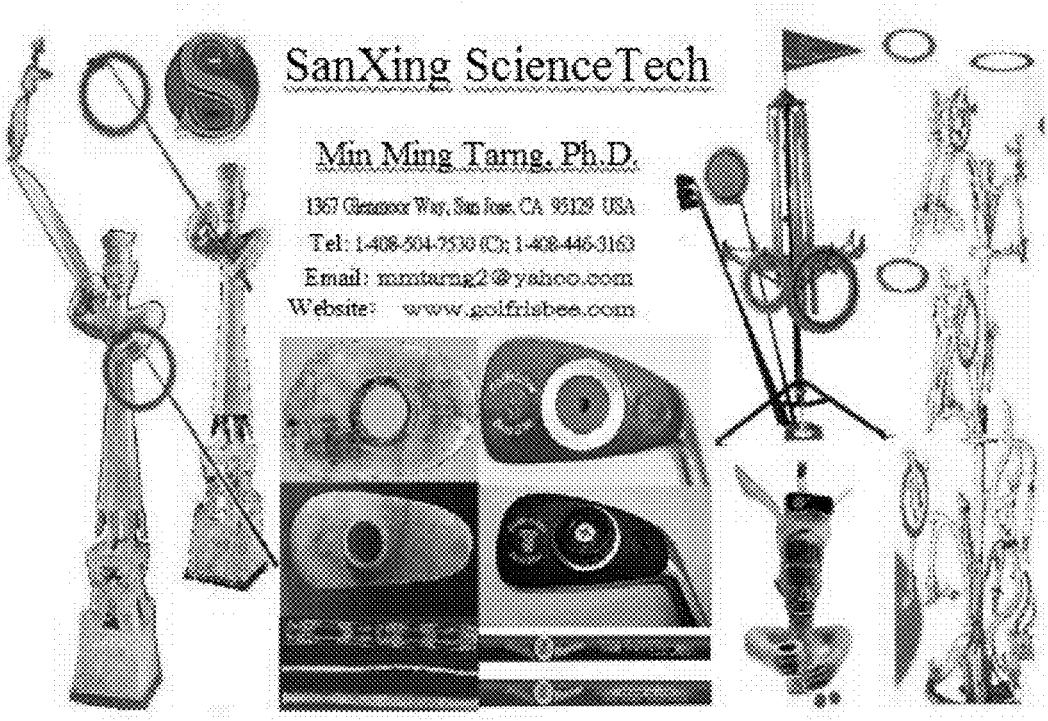
Figure 22C:
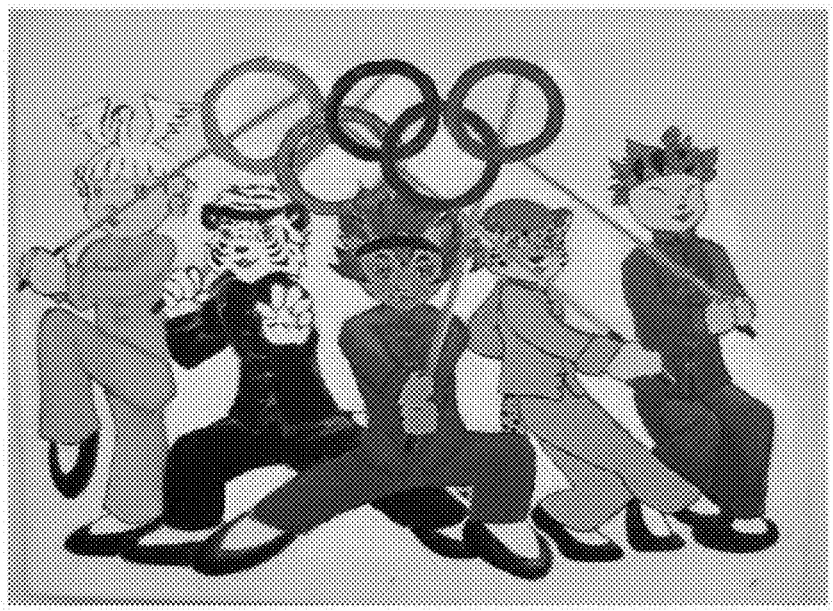
Figure 22D:
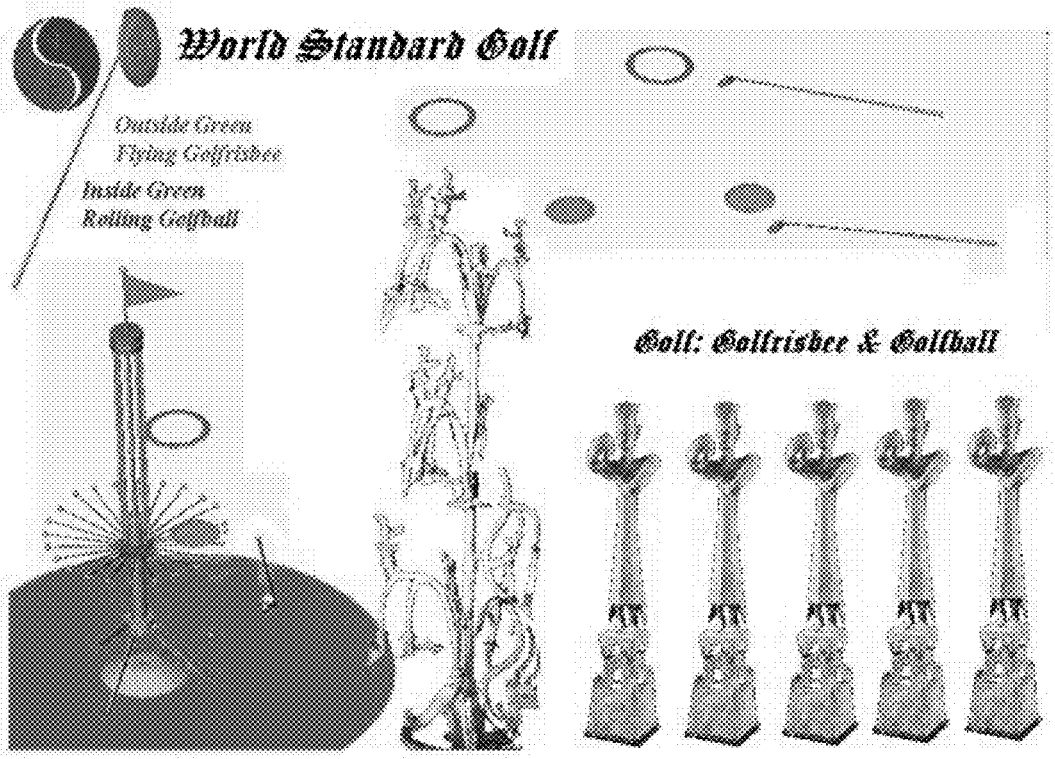

FIG. 22A is the YanYun Flag. It is Fire over Fire (炎) which means transfer of the Eastern Olympic YanYun torch. The Sun over Moon (易) is the totem for the King of King of Ming (明) who is engaged in the war to protect the Ancient Oriental Civilization. The five color rings on the five ringball-golf clubs is the logo for the YanYun. This five-golfring logo has the same meanings as the meanings of the Western Olympic Sports. FIG. 22B is the fly of the SanXing Science-Technology Company which is dedicated to promote the Triple Star golf and YanYun Sports. FIG. 22C is the five dolls of YanYun having the five-ringball golf to constitute the 5-ring symbol of YanYun. FIG. 22D is the fly of the Ringball Golf Association to show the ringball golf course.

As shown in FIG. 24A, the GolfDiscney apparatus further comprises golfdisc museum. As shown in FIG. 24B, outside the GolfDisney core structure, there is the Triple Star/ringball golf course. The tracks can be folded and interchange to have as many as holes/stop as possible. As shown in FIG. 18A, outside the green is played with long drive. As shown in FIG. 18B and FIG. 8C, the ring can be shot into the basket directly. As the ring falls on the green, the ring can be changed to be the ball. As shown in FIG. 8D the ball can be putt into the hole; or as shown in FIG. 21A, the ball can be hit to fly into the slot opening 117*s* of GaoShang slot 117.

The ringball golf course can be very compact to be located in the town. So it can be franchises as McDonald does. A GolfDiscney golfdisc course can be a miniature golfdisc course. A GolfDiscney apparatus golfdisc course also can be animated golfdisc course. As shown in FIG. 25, the core of the GolfDisney can be combined with the fast food such as McDonald, etc to have the chain store of the Franchises. The ringball golf can play back and forth repetitively in a limited space.

As shown in FIG. 1A and FIG. 26, the GolfDiscney apparatus further comprises a golfdisc topic park. As shown in FIG. 26, the golfishing pond can be added to the GolfDisney. The floating ring 9 having the video camera 9*c* carrying the fishing line 9*f* is thrown into the pond. The video camera 9*c* monitors the fishing activities beneath the water surface. The golfer can have both boating, fishing and golfing activities in the golfishing pond.

While the invention has been particularly shown and described with reference to the preferred embodiments thereof, it will be understood by those skilled in the art that various changes in form and details may be made therein without departing from the spirit and scope of the invention.

We claim:

1. A Golfdiscney game comprising:

Means for playing Golfdiscney on a playing area with targets,

Means for launching a flying disc at said targets,

Means for launching a ball at said targets,

Means for scoring points when playing on said playing area.

2. A GolfDiscney apparatus comprises a means for golfing sports, said means for golfing sports comprising a means for golfing club, a means for flying disc and a means for golfing ball;

on one side of a head of said means for golfing club having a adaptor to mount said flying disc;

another side of said head being used to hit said golfing ball to roll or fly.

3. A GolfDiscney apparatus comprises a means for golfing sports, said means for golfing sports comprising a means for golfing club and a means for flying disc;

said means for golfing sports having a means for plurality of adaptors to mount said means for flying disc on a mean for head of said means for golfing club, swiveling said means for golfing club, said means for flying disc rotating and taking off from said mean for head flying toward a means for target.

4. A GolfDiscney apparatus according to claim 1 of which said means for target comprises a means for plurality forks, said means for plurality forks can hook up said means for flying disc which having a means for hole to be hooked up by said means for plurality forks.

5. A GolfDiscney apparatus according to claim 1 of which said means for plurality forks further comprising a means for blocking said flying disc to catch said flying disc with said means for plurality fork.

6. A GolfDiscney apparatus according to claim 1 of which said means for flying disc being boomerang, said boomerang being mounted on a mean for head of said means for golfing club, swiveling said means for golfing club, said boomerang rotating and taking off from said mean for head flying toward a means for target.

7. A GolfDiscney apparatus according to claim 6 of which said means for target further comprising a Means for trapping and a means for guiding, said boomerang hitting on said means for guiding and being trapped by said means for trapping.

8. A GolfDiscney apparatus according to claim 2 further comprising a means for target, Hitting on said means for golfing ball, said means for golfing ball flying or rolling into said means for target.

9. A GolfDiscney apparatus according to claim 3 of which said means for flying disc further comprising an annular rim and a central section joined together by an annular shoulder, said rim having a lower edge defining a lower plane of said disc, and said central section having an upper zone defining an upper plane of said disc, said rim having a substantially equilateral triangular cross-section with a lower rounded corner forming said lower edge, an outer rounded corner, and an upper corner merging with said shoulder, with said outer corner located between said upper and lower planes, said shoulder decreasing in thickness from said rim to said central section, with the thickness of said shoulder at said rim in the order of twice the thickness of said central section, and with the outer surface of said disc from said rim outer corner to said central section having a continuous smooth curved lifting surface, and the upper surface of said central section being substantially flat when the disc is stationery, with said central section being sufficiently thin and flexible to dome upwards when in flight.

10. A GolfDiscney apparatus according to claim 9 of which said annular rim further comprises a separator lip on an upper surface and located on or near said outer rounded corner, said separator lip extending to a narrow peak which is higher than the immediately adjacent portion of said upper surface;

said flying disc having an option to add the air slot between said upper surface and said separator lip to have bumper effect to reduce impacting force.

11. A GolfDiscney apparatus according to claim 3 of which said means for flying disc being a golfring comprising a closed-figure airfoil having a planform comprising; an upper and lower surface, a central opening, an inner perimeter encompassing said central opening, an outer perimeter encompassing said inner perimeter, an axis of revolution which is substantially normal to the planes described by said inner and outer perimeters, said airfoil having a cross-section comprising; a line defining said lower surface, a convex line defining said upper surface, said convex line reaching a zenith which is the highest point on the airfoil section of said golfring, a separator lip on said upper surface and located on or near said outer perimeter, said separator lip extending to a narrow peak which is higher than the immediately adjacent portion of said upper surface;

said flying disc having an option to add the air slot between said upper surface and said separator lip to have bumper effect to reduce impacting force.

12. A GolfDiscney apparatus according to claim 3 of which means for flying disc being a means of grenade, said means of grenade having a means for timing trigger or a means for wiring trigger, said means of grenade can be triggered to explode by means for timing trigger or pulling a wire triggering means for wiring trigger.

13. A GolfDiscney apparatus according to claim 3 of which said means for plurality of adaptors being made of means of resilient material covering means of hard structure to increase holding force to increase flying distance of said means for flying disc.

14. A GolfDiscney apparatus according to claim 2 further comprising a means for target, said means for target comprising a means of golfing basket for said flying disc and a means of golfing slot for said golfing ball;

said means of golfing basket and said means of golfing slot being mounted on a means of pole, said means for flying disc flying into said means of golfing basket and said means for golfing ball flying or rolling into said golfing slot for said golfing ball.

15. A GolfDiscney apparatus according to claim 1 of which said means for golfdisc course being a means for miniature golfdisc course.

16. A GolfDiscney apparatus according to claim 1 of which said means for golfdisc course being a means for animated golfdisc course.

17. A GolfDiscney apparatus according to claim 1 further comprises a means for parade of said means for plurality of golfing clubs and a means plurality of torches.

18. A GolfDiscney apparatus according to claim 1 further comprises a means for fire station.

19. A GolfDiscney apparatus according to claim 1 further comprises a means for golfdisc topic park.

20. A GolfDiscney apparatus according to claim 1 further comprises a means for golfdisc museum.

* * * * *